US011221584B2

(12) United States Patent
Yasui et al.

(10) Patent No.: US 11,221,584 B2
(45) Date of Patent: Jan. 11, 2022

(54) IMAGE FORMING APPARATUS AND CARTRIDGE WITH A COUPLING MEMBER THAT CONTACTS ANOTHER COUPLING MEMBER BY AN ELECTROSTATIC ADSORPTION FORCE

(71) Applicant: CANON KABUSHIKI KAISHA, Tokyo (JP)

(72) Inventors: Kojiro Yasui, Numazu (JP); Seiji Hara, Suntou-gun (JP); Hiroki Ogino, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/604,848

(22) PCT Filed: Apr. 11, 2018

(86) PCT No.: PCT/JP2018/015282
§ 371 (c)(1),
(2) Date: Oct. 11, 2019

(87) PCT Pub. No.: WO2018/190386
PCT Pub. Date: Oct. 18, 2018

(65) Prior Publication Data

US 2020/0089161 A1 Mar. 19, 2020

(30) Foreign Application Priority Data

Apr. 12, 2017 (JP) ..... JP2017-079264
Apr. 12, 2017 (JP) ..... JP2017-079265
(Continued)

(51) Int. Cl.
*G03G 21/18* (2006.01)
*G03G 21/16* (2006.01)

(52) U.S. Cl.
CPC ..... *G03G 21/1857* (2013.01); *G03G 21/1647* (2013.01)

(58) Field of Classification Search
USPC ..... 399/111
See application file for complete search history.

(56) References Cited

U.S. PATENT DOCUMENTS 6,125,253 A * 9/2000 Tashima ..... G03G 15/757 399/167
6,226,478 B1 * 5/2001 Watanabe ..... F16D 1/101 399/117
(Continued)

FOREIGN PATENT DOCUMENTS

JP 07-334036 A 12/1995
JP H10-153940 A 6/1998
(Continued)

OTHER PUBLICATIONS

International Preliminary Report on Patentability, issued in corresponding Parent International Application No. PCT/JP2018/015282 dated Oct. 15, 2019.
(Continued)

*Primary Examiner* — Q Grainger
(74) *Attorney, Agent, or Firm* — Venable LLP

(57) ABSTRACT

Provided is an image forming apparatus, having: a power source; a first coupling member configured to be rotated by a driving force transferred from the power source; and a cartridge including a second coupling member configured to rotate in a state of being adsorbed to the first coupling member, and a rotating member connected with the second coupling member, wherein the first coupling member has a first driving force transfer surface which is perpendicular to a rotation axis of the first coupling member, the second coupling member has a second driving force transfer surface which is perpendicular to a rotation axis of the second
(Continued)

coupling member, and the driving force is transferred from the first coupling member to the second coupling member in a state where an adsorption force is generated mutually between the first driving force transfer surface and the second driving force transfer surface.

5 Claims, 32 Drawing Sheets

(30) Foreign Application Priority Data

Apr. 12, 2017 (JP) ..... JP2017-079266
Apr. 6, 2018 (JP) ..... JP2018-073999

(56) References Cited

U.S. PATENT DOCUMENTS 8,270,877 B2 9/2012 Tomatsu et al.
2002/0018666 A1 2/2002 Noda et al.
2003/0156848 A1 8/2003 Kawai et al.
2005/0254858 A1 11/2005 Numagami et al.
2009/0238604 A1 9/2009 Peckjian
2013/0302066 A1 11/2013 Kawai
2014/0133884 A1* 5/2014 Toyoda ..... G03G 15/80 399/111
2014/0205322 A1 7/2014 Watanabe et al.
2015/0147093 A1* 5/2015 Mori ..... F16H 7/02 399/167
2015/0277338 A1 10/2015 Hamada et al.
2015/0338825 A1 11/2015 Leemhuis et al.

FOREIGN PATENT DOCUMENTS

JP 3408082 B2 5/2003
JP 2003-223091 A 8/2003
JP 2005-352438 A 12/2005
JP 3839932 B2 11/2006
JP 2008-292557 A 12/2008
JP 2014-191105 A 10/2014
JP 2015-191122 A 11/2015

OTHER PUBLICATIONS

Japanese Office Action, dated Apr. 21, 2020, in corresponding Japanese Application No. 2018073999.

* cited by examiner

IMAGE FORMING APPARATUS AND CARTRIDGE WITH A COUPLING MEMBER THAT CONTACTS ANOTHER COUPLING MEMBER BY AN ELECTROSTATIC ADSORPTION FORCE

TECHNICAL FIELD

The present invention relates to a driving force transfer mechanism that transfers driving force from an apparatus main body to a cartridge and the like in an image forming apparatus.

BACKGROUND ART

In a process cartridge type electrophotographic image forming apparatus, a power transfer member connected to a driving source disposed in the apparatus main body and a photosensitive drum and the like are linked in such a way that the driving force can be transferred, so as to supply the rotary driving force to such a rotating member as a photosensitive drum disposed in a process cartridge. Various configurations have been proposed for the driving force transfer mechanism to rotationally drive the photosensitive drum and the like. Japanese Patent No. 3408082 discloses a configuration in which a twisted concave portion is formed in a coupling disposed in an apparatus main body, and a twisted convex portion is formed in a coupling disposed in a photosensitive drum, so that the photosensitive drum is driven by interfitting the concave portion and the convex portion. Japanese Patent No. 3839932 discloses a configuration in which an earth contact, which is connected when the coupling of the photosensitive drum and the coupling of the apparatus main body are interfitted, is formed, so that the grounding is performed by the rotating portion at the edge of the photosensitive drum.

SUMMARY OF INVENTION

Technical Problem

In the case of the above mentioned coupling configuration which transfers the driving force by interfitting the twisted concave and convex portions, a gap must be created between the concave and convex portions in the interfitting area, because of the dimensional error which is generated during manufacture. This gap generates a looseness when the photosensitive drum and the like rotate, which may drop the driving transfer performance of the driven portion, such as the photosensitive drum.

It is an object of the present invention to provide a technique to allow stable transfer of the driving force.

Solution to Problem

It is another object of the present invention to provide a following image forming apparatus. An image forming apparatus having: a power source; a first coupling member configured to be rotated by a driving force transferred from the power source; and a cartridge including a second coupling member configured to rotate in a state of being adsorbed to the first coupling member, and a rotating member connected with the second coupling member. The first coupling member has a first driving force transfer surface which is perpendicular to a rotation axis line of the first coupling member, the second coupling member has a second driving force transfer surface which is perpendicular to a rotation axis line of the second coupling member, and the driving force is transferred from the first coupling member to the second coupling member in a state where an adsorption force is generated mutually between the first driving force transfer surface and the second driving force transfer surface.

Further features of the present invention will become apparent from the following description of exemplary embodiments (with reference to the attached drawings).

DESCRIPTION OF EMBODIMENTS

Modes for implementing the present invention will now be exemplarily described in detail based on embodiments with reference to the drawings. It is to be understood that dimensions, materials, shapes, relative arrangements, and the like of components described in the embodiments are intended to be changed as deemed appropriate in accordance with configurations and various conditions of apparatuses to which the present invention is to be applied. In other words, the scope of the present invention is not intended to be limited to the embodiments described below.

Example 1

An image forming apparatus according to an example of the present invention will be described with reference to FIG. 1 to FIG. 6. The image forming apparatus to which the present invention is applied is an image forming apparatus that forms an image on a recording material using the electrophotographic image forming system, and is, in concrete terms, a copier, a printer (e.g. LED printer, laser printer), a facsimile, a word processor and the like. Further, the image forming apparatus to which the present invention is applied is an image forming apparatus which is based on the process cartridge system. In other words, in this image forming apparatus, a photosensitive drum (image bearing member), which is an electrophotographic photosensitive member, and a process unit which acts on the photosensitive drum, are integrated as a process cartridge, so that this process cartridge is detachable from the image forming apparatus main body. The process cartridge may be constituted by a plurality of units, such as a photosensitive drum, a charging unit, a cleaning unit including a cleaning device, and a developing unit including a developing roller (developer carrying member) and a developer container which contains developer. Each of these units may be configured as a standalone cartridge which is detachable from the apparatus main body. In the present invention, "cartridge" refers not only to the process cartridge, but also to a cartridge integrating each of the above mentioned units.

In the following description, "longer direction" refers to the rotation axis direction of the photosensitive drum. In the longer direction, the side where the photosensitive drum receives the driving force from the image forming apparatus main body is the "driving side" (the driven coupling 63 side in FIG. 1), and the opposite side thereof is the "non-driving side".

Figure 2:
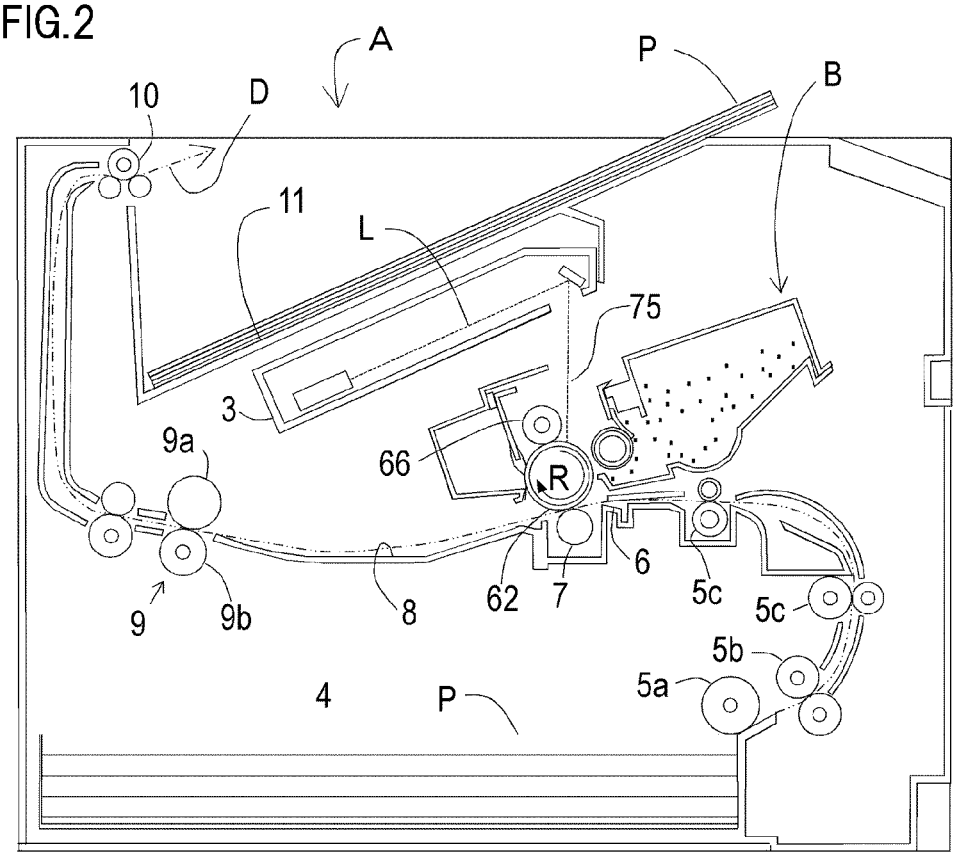
FIG. 2 is a schematic cross-sectional view depicting an image forming apparatus according to an example of the present invention.
Figure 3:
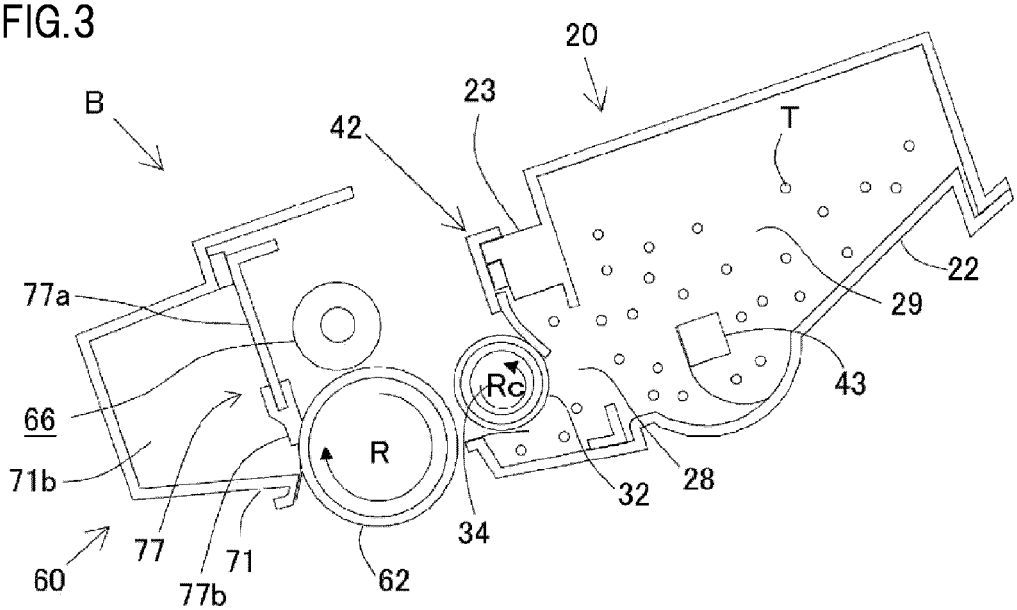
FIG. 3 is a schematic cross-sectional view depicting a process cartridge according to an example of the present invention.

A general configuration and the image forming process of the image forming apparatus of Example 1 will be described with reference to FIG. 2 and FIG. 3. FIG. 2 is a schematic cross-sectional view depicting the image forming apparatus main body (hereafter called "apparatus main body A") of the image forming apparatus, and a process cartridge (hereafter called "cartridge B") according to examples of the present invention. FIG. 3 is a schematic cross-sectional view depicting the configuration of the cartridge B. In other words, the apparatus main body A of the image forming apparatus has a configuration of the image forming apparatus from which the cartridge B is excluded.

<General Configuration of Electrophotographic Image Forming Apparatus>

As illustrated in FIG. 2, the image forming apparatus according to Example 1 is a laser beam printer using the electrophotographic technology, where the cartridge B is detachable from the apparatus main body A. An exposing apparatus 3 (laser scanner unit) is disposed above the cartridge B attached to the apparatus main body A. A sheet tray 4, which houses recording material (hereafter called "sheet material P") on which the image is formed, is disposed below the cartridge B. Further, a pickup roller 5*a*, a feeding roller pair 5*b*, a transport roller pair 5*c*, a transfer guide 6, a transfer roller 7, a transport guide 8, a fixing apparatus 9, a discharge roller pair 10, a discharge tray 11 and the like are sequentially disposed in the apparatus main body A in the transporting direction D of the sheet material P. The fixing apparatus 9 is constituted by a heat roller 9*a* and pressure roller 9*b*.

<General Configuration of Cartridge>

As illustrated in FIG. 3, the cartridge B is constituted by a cleaning unit 60 and developing unit 20. The cleaning unit 60 is constituted by a cleaning frame 71, a photosensitive drum (hereafter called "drum") 62, a charging roller 66, a cleaning blade 77 and the like. Meanwhile, the developing unit 20 is constituted by a base member 22, a developer container 23, a developing blade 42, a developing roller 32, a magnet roller 34, a transport member 43, toner T and the like. The cartridge B is configured by the cleaning unit 60 and the developing unit 20, which are rotatably combined with each other.

<Configuration of Cleaning Unit>

Figure 1:
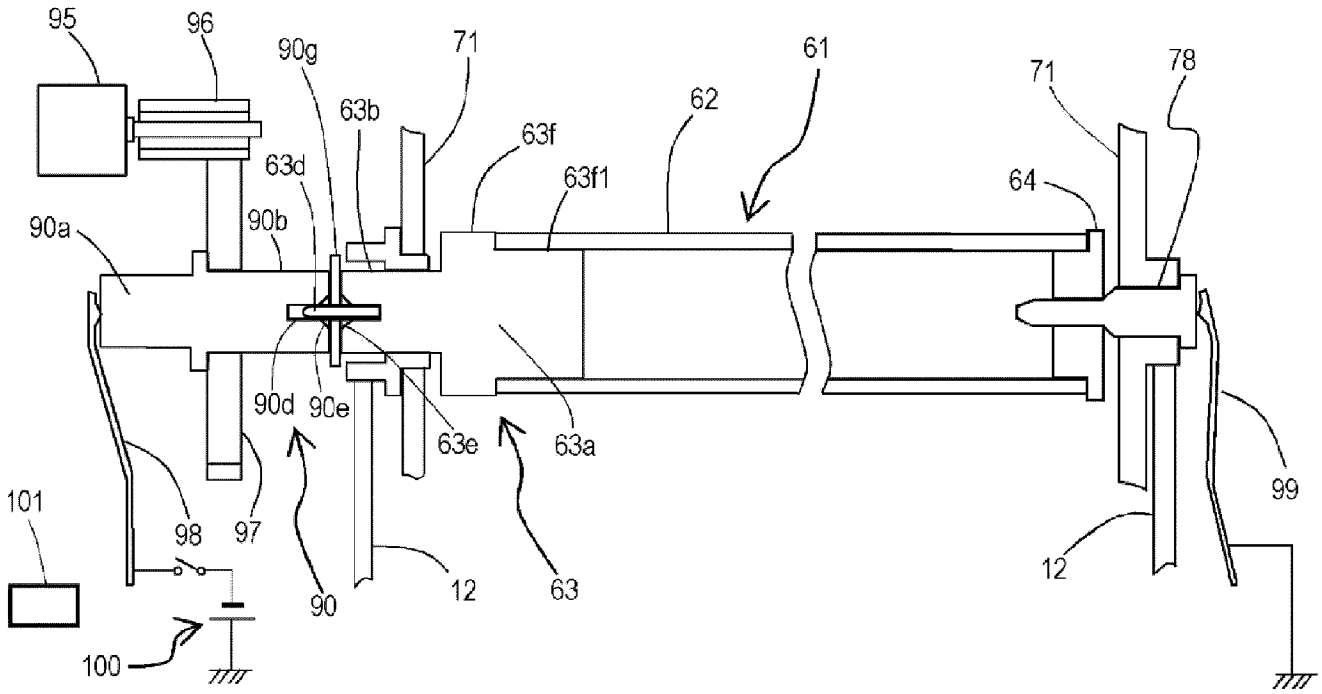
FIG. 1 is a schematic cross-sectional view depicting a driving force transfer mechanism according to Example 1 of the present invention.
Figure 4:
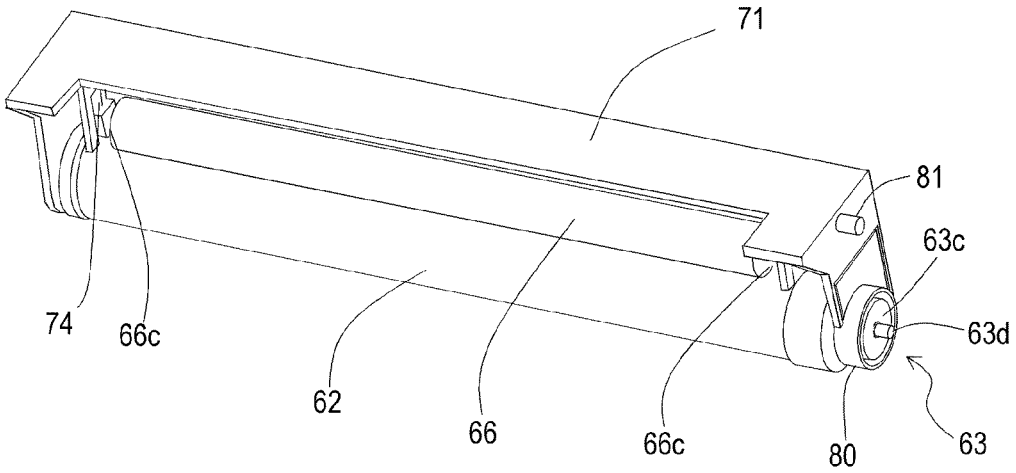
FIG. 4 is a schematic perspective view depicting a cleaning unit according to Example 1 of the present invention.
Figure 5:
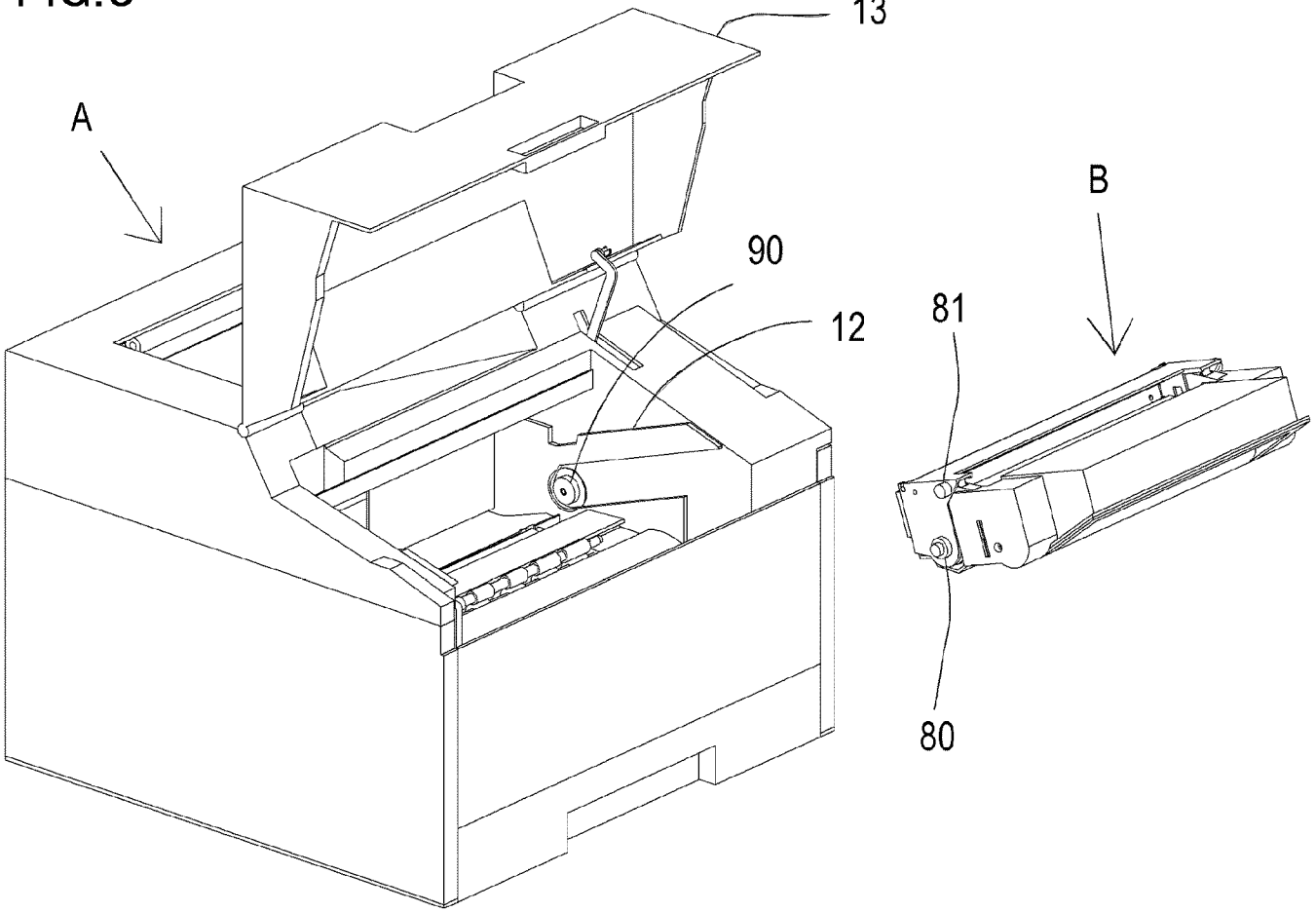
FIG. 5 is a schematic perspective view depicting a state of attaching/detaching the processing cartridge to/from the apparatus main body.

The configuration of the cleaning unit 60 will be described with reference to FIG. 1 and FIG. 3 to FIG. 5. FIG. 1 is a schematic cross-sectional view of a driving force transfer mechanism according to this example, where a configuration near a drum unit 61, including the configuration of the apparatus main body A, is illustrated. FIG. 4 is a schematic perspective view depicting the configuration of the cleaning unit 60. FIG. 5 is a schematic perspective view depicting the state of attaching/detaching the cartridge B to/from the apparatus main body A, and illustrated the state when a door 13 of the apparatus main body A to attach/detach the cartridge B is open.

As illustrated in FIG. 3, the cleaning blade 77 is constituted by: a support member 77*a* formed by a metal plate; and an elastic member 77*b* formed by an elastic material such as urethane rubber, and is disposed at a predetermined position by fixing both ends of the support member 77*a* to the cleaning frame 71 with screws (not illustrated). The elastic member 77*b* contacts a drum 62, and removes the residual toner from the outer peripheral surface of the drum 62. The removed toner is stored in a waste toner chamber 71*b* of the cleaning unit 60.

As illustrated in FIG. 4, an energizing member 74 and charging roller bearings 66*c* are installed in the cleaning frame 71. The shaft of the charging roller 66 is inserted into the charging roller bearings 66*c*. The charging roller 66 is energized toward the drum 62 by the energizing member 74, such as a spring, and is rotatably supported by the charging roller bearings 66*c*, so as to rotate as the drum 62 rotates. Power is supplied to the charging roller 66 using an electrode plate (not illustrated) as a power supply path.

The drum 62 has an aluminum cylinder of which outer peripheral surface is coated with an organic photoconductor layer (OPC photosensitive member), and the aluminum cylinder functions as a conducting portion of the drum 62. In the drum 62, as illustrated in FIG. 1, a driven coupling 63, which has a drum flange function portion 63*f*, is connected to one edge (driving side) of the cylindrical body in the longer direction, and a flange 64 (edge member having a flange-shaped portion) is connected to the other edge (non-driving side) of the cylindrical body. The drum flange function portion 63*f*, which is integrated with the driven coupling 63, and the flange 64, contact the end face of the cylindrical body of the drum 62 respectively in the shaft direction. In other words, the driven coupling 63 and the flange 64 are integrated with the drum 62, and constitute an electrophotographic photosensitive drum unit (hereafter called a "drum unit 61"). There is a shaft hole at the center of the flange 64, and the drum shaft 78 is inserted into and fitted with this shaft hole.

To connect the drum 62, the driven coupling 63 and the flange 64, crimping, adhesion, welding or the like can be used. The flange function portion 63*f* and the flange 64 have conductivity, and a drum shaft 78 (first electrode), which also has conductivity, is electrically conducted with the earth electrode of the apparatus main body A. Further, a coupling base 63*a*, which receives the driving force from the apparatus main body A, is disposed in the flange function portion 63*f*. The drum unit 61 is rotatably supported on the cleaning frame 71.

In the cleaning unit 60, as illustrated in FIG. 5, a positioning portion 80, having a peripheral surface which is concentric with the drum shaft 78, and a rotation stopping portion 81, are disposed on each end in the longer direction respectively, so as to be accurately positioned in the apparatus main body A when the cleaning unit 60] is attached to the apparatus main body A. By this configuration, the cartridge B, including the developing unit 20 connected to the cleaning unit 60, can be accurately positioned in the apparatus main body A.

<Cartridge Attachment/Detachment>

As illustrated in FIG. 5, the door 13 is rotatably installed in the apparatus main body A. When the door 13 is opened, a link mechanism (not illustrated) operates interlocking with the operation of the door 13, whereby a driving coupling 90, disposed in the apparatus main body A, moves in the longer direction—retracting direction—of the cartridge B (rotation axis direction of the driving coupling 90). The apparatus main body A includes a guide rail 12, and a cartridge B is installed in the apparatus main body A along the guide rail 12. At this time, the positioning portion 80 and rotation stopping portion 81 in the cleaning unit 60 mentioned above are engaged with the positioning portion (not illustrated) of the apparatus main body A, whereby the cartridge B is positioned in the apparatus main body A. When the door 13 is closed, the link mechanism (not illustrated) operates interlocking with the operation of the door 13, and the driving coupling 90 moves in the direction of approaching the driven coupling 63 disposed in the cartridge B, that is, in the opposite direction of the above case of opening the door 13, so that the driving force transfer surfaces of the couplings are joined.

As illustrated in FIG. 1, the driving coupling 90, which is driven by a motor 95 of the apparatus main body A, is adsorbed to the driven coupling 63 (FIG. 6) disposed in the cartridge B because of the later mentioned electrostatic force, by a controller (control unit) 101 of the apparatus main body A when necessary. As a result, the drum 62, connected with the driven coupling 63, receives the driving force from the apparatus main body A, and rotates.

<Image Forming Process>

An outline of the image forming process will be described with reference to FIG. 2 and FIG. 3. Based on a print start signal, the drum 62 is rotationally driven in the arrow R direction at a predetermined peripheral speed (process speed). The charging roller 66, on which bias voltage is applied, contacts the outer peripheral surface of the drum 62, and uniformly charges the outer peripheral surface of the drum 62. The exposing apparatus 3 outputs a laser light L in accordance with the image information. This laser light L transmits through an exposure window 74 on the upper surface of the cartridge B, and scans and exposes the outer peripheral surface of the drum 62. Thereby an electrostatic latent image corresponding to the image information is formed on the outer peripheral surface of the drum 62.

As illustrated in FIG. 3, in the developing unit 20, i.e., a developing apparatus, the toner T inside a toner chamber 29 is stirred and transported by the rotation of the transport member 43, and is fed into a toner supply chamber 28. The toner T is carried on the surface of the developing roller 32 by the magnetic force of a magnet roller 34 (fixed magnet). The toner T is frictionally charged by a developing blade 42, while controlling the layer thickness of the toner T on the peripheral surface of the developing roller 32. The toner T is transferred to the drum 62 in accordance with the electrostatic latent image, and is visualized as a toner image (developer image).

As illustrated in FIG. 2, a sheet material P, stored at the bottom of the apparatus main body A, is fed from the sheet tray 4 by the pickup roller 5*a*, the feeding roller pair 5*b* and the transport roller pair 5*c* at the output timing of the laser light L. Then this sheet material P is supplied to a transfer position between the drum 62 and the transfer roller 7 via the transfer guide 6. At this transfer position, the toner image is sequentially transferred from the drum 62 to the sheet material P. The sheet material P, on which the toner image was transferred, is separated from the drum 62, and is transferred to the fixing apparatus 9 along the transport guide 8. Then the sheet material P passes through a nip section between the heat roller 9*a* and the pressure roller 9*b* constituting the fixing apparatus 9. After the fixing processing using pressure and heat is performed at this nip section, the toner image is fixed to the sheet material P. The sheet material P, on which the toner image was fixed, is transported to the discharge roller pair 10, and is discharged to the discharge tray 11.

As illustrated in FIG. 3, after the transfer, the residual toner on the outer peripheral surface of the drum 62 is removed by the cleaning blade 77, and the cleaned drum 62 is used again for the image forming process. The toner removed from the drum 62 is stored in the waste toner chamber 71*b* of the cleaning unit 60. In the above description, the charging roller 66, the developing roller 32, and the cleaning blade 77 constitute a process unit which acts on the drum 62.

<Driving Force Transfer Coupling (Driving Force Transfer Mechanism)>

Figure 6:
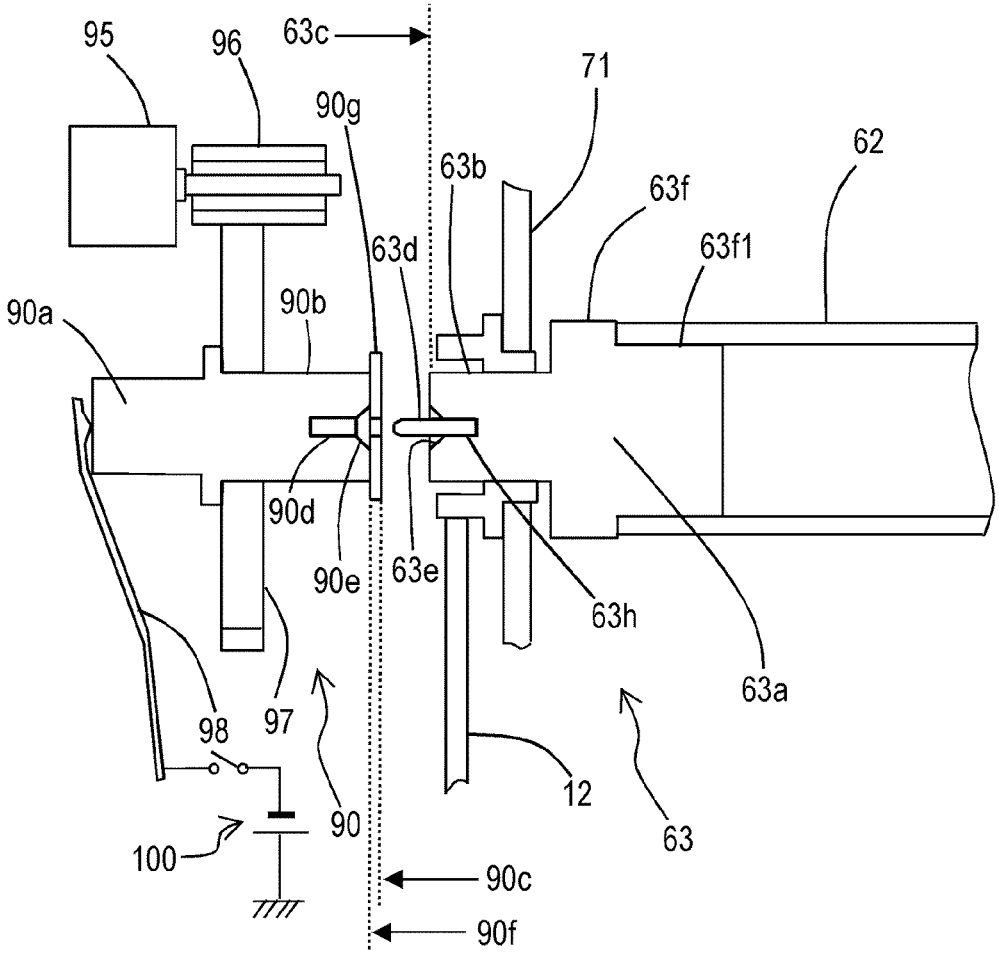
FIG. 6 is a schematic cross-sectional view depicting the driving force transfer mechanism according to Example 1 of the present invention.

A configuration of a driving force transfer coupling, which is the essential part of the present invention, will be described in detail with reference to FIG. 1 and FIG. 6. FIG. 6 is a schematic cross-sectional view of the driving force transfer coupling (driving force transfer mechanism) according to this example, and illustrates a status before the driving coupling 90 and the driven coupling 63 are connected. The driving force transfer coupling of the present invention is constituted by the driving coupling 90 disposed in the apparatus main body A, and the driven coupling 63 disposed in the cartridge B. The configuration of the driven coupling 63, which is a coupling on the driven side disposed in the cartridge B, will be described first.

As illustrated in FIG. 1 and FIG. 6, the driven coupling 63 (coupling unit) is disposed on one edge of the drum 62, which is installed in the cartridge B, in the longer direction. The driven coupling 63 includes the coupling base 63*a*. The driving force transfer function portion 63*b* of which diameter is 16 mm, and the drum flange function portion 63*f*, are integrated on the drum coupling base 63*a*. On the front end surface of the driving force transfer function portion 63*b*, a driving force transfer surface 63*c* (a second electrode), which functions as a driving force transfer function portion that contacts the surface of the driving coupling 90 disposed in the apparatus main body A, is formed as a surface extending in a direction perpendicular to the rotation axis of the drum 62 and the driven coupling 63.

Here the surface roughness (center line average roughness) Ra of the driving force transfer surface 63*c* is set to 0.2 μm. The surface roughness Ra that can be set is 0.2 μm or less. If the surface roughness Ra exceeds 0.2, the electrostatic adsorption force decreases. The surface roughness Ra of the coupling member and that of the dielectric body are specified based on the center line average surface roughness that is measured using a surface roughness measuring instrument, as mentioned in JIS Surface Roughness Standard "JIS B 0601 (2001)", for example.

A circular boss 63*d* (diameter: 4 mm), of which one end interfits with the driving coupling 90, is disposed on the rotation axis of the drum 62 of the driving force transfer surface 63*c*, so as to determine the rotation center. The circular boss 63*d* is a separate member from the driven coupling 63, and the other end of the circular boss 63*d* is interfitted in a hole 63*h* of the driven coupling 63. The hole 63*h* is formed on the rotation axis of the drum 62 of the driving force transfer surface 63*c* to be a 4 mm diameter, and a 2 mm C chamfered edge 63*e* is formed around the entry (opening) of the hole 63*h*. The engaged portion (interfitted portion) of the hole 63*h* and the circular boss 63*d* are firmly fixed by epoxy adhesive. The method of fixing the circular boss 63*d* to the coupling base 63*a* is not limited to epoxy adhesive, but may be fixed by screwing, press fitting by knurling processing or the like.

The driven coupling 63 includes an interfitting portion 63*f* 1 which has an outer peripheral surface formed to match with the inner peripheral surface of the cylindrical end of the drum 62, at the opposite side of the driving force transfer function portion 63*b* in the axis direction of the drum 62 of the drum flange function portion 63*f*. When the driven coupling 63 is fixed to the drum 62, the interfitting portion 63*f* 1 and the drum 62 are crimped in the state where the interfitting portion 63*f* 1 is interfitted with the drum 62 on the inner surface thereof and the drum flange function portion 63*f* is positioned in the drum 62 (to contact with to the end face of the cylindrical edge). The method of fixing the drum flange function portion 63*f* is not limited to crimping, but may be by adhesion or the like.

The material of each component will be described. The material of the coupling base 63*a* used here is aluminum having conductivity. However, the material of the coupling base 63*a* is not limited to aluminum. For example, metal (e.g. iron, copper), conductive ceramic or conductive resin normally used for a process cartridge, such as a molded product generated by adding a conducting agent to polyacetal, polyester, epoxy resin or the like, may be used. For the conducting agent, an electronic conducting agent, ion conducting agent or the like can be selected. A guideline is that the volume resistivity of the driven coupling 63 becomes $1\times10^{10}$ Ωcm or less. By selecting the above configuration and material, the driven coupling 63 is electrically conducted with the drum 62.

Further, the flange 64, described above in the section on the configuration of the cleaning unit 60, has conductivity, and the drum shaft 78 which also has conductivity is electrically conducted with the ground of the apparatus main body A. By the above configuration, the driven coupling 63 is electrically connected to the ground of the apparatus main body A via the drum shaft 78 when the process cartridge is attached to the apparatus main body A, and is positioned on the ground side of the driving coupling 90.

The material of the circular boss 63*d* is polyacetal (insulating material) so as to be electrically insulated from the driving coupling 90, and is separated from the coupling base 63*a* having conductivity, in the state of being electrically insulated. Here the material of the circular boss 63*d* can also be a material which allows the circular boss 63*d* to be electrically insulated from the coupling base 63*a*, and ceramic, polyester, epoxy resin or the like can be used. A guideline for this insulation is that volume resistivity becomes $1\times10^{15}$ Ωcm or more.

The configuration of the driving coupling 90, which is the coupling on the driving side disposed in the apparatus main body A, will be described. As illustrated in FIG. 1, the driving coupling 90 is constituted by a coupling base 90*a* and the electrostatic adsorption function portion 90*g*.

The coupling base 90*a* has a driving force transfer function portion 90*b*, which is formed in a cylindrical shape (diameter: 16 mm). The electrostatic adsorption function portion 90*g* is adhered and fixed to the tip of the driving force transfer function portion 90*b*. The driving force transfer function portion 90*b* has a corresponding surface 90*f*, which faces the driving force transfer surface 63*c* of the driven coupling 63 when the cartridge B is attached to the apparatus main body A. The corresponding surface 90*f* and the driving force transfer surface 63*c* are surfaces which extend in a direction perpendicular to the rotation axis of the driving coupling 90. The driving force transfer surface 90*c* is also a surface perpendicular to the rotation axis (rotation axis line) of the driving coupling 90. Furthermore, at the rotation center of the corresponding surface 90*f* of the coupling base 90*a*, an interfitting hole 90*d* (Φ4) into which the circular boss 63*d* of the driven coupling 63 is inserted and interfitted, is disposed. The circular boss 63*d* interfitted in the interfitting hole 90*d* contacts the driving force transfer function portion 90*b* and the electrostatic adsorption function portion 90*g* as well. Further, a 2 mm C chamfered edge 90*e* is formed around the entry of the interfitting hole 90*d*.

The electrostatic adsorption function portion 90*g* (third electrode) is constituted by a circular sheet member having a Φ4 through hole at the center, of which surface roughness Ra is 0.2 μm, thickness is 120 μm, and outer diameter is Φ20 mm. The thickness of the electrostatic adsorption function portion 90*g* here is not especially limited, and may be appropriately set in accordance with the later mentioned electrostatic adsorption force and required power. The surface roughness Ra can be set appropriate if it is 0.2 μm or less. The surface roughness Ra is set to 0.2 or less because the electrostatic adsorption force decreases if the surface roughness Ra exceeds 0.2. The electrostatic adsorption function portion 90*g* is fixed to the corresponding surface 90*f* of the coupling base 90*a* using a conductive double-sided tape, at which center is a hole having an 8 mm diameter, the same as the diameter of the C chamfered edge 90*e* formed around the interfitting hole 90*d*. For fixing, the Φ4 through hole of the electrostatic adsorption function portion 90*g* and the Φ4 interfitting hole 90*d* are aligned so that the circular boss 63*d* can be inserted into the through hole of the electrostatic adsorption function portion 90*g*. Here the size of the hole formed in the above mentioned conductive double-sided tape can be appropriately selected in accordance with the required adhesive strength, as long as it is larger than the diameter of the C chamfered edge 90*e* around the interfitting hole 90*d*. Thereby the electrostatic adsorption function portion 90*g* functions as the driving force transfer surface (first driving force transfer surface) 90*c* of the driving force transfer function portion 90*b*, which contacts with the driving force transfer surface (second driving force transfer surface) 63*c* of the driving force transfer function portion 63*b* of the driven coupling 63.

The material of each component will be described. The material of the coupling base 90*a* used here is aluminum having conductivity. However, the material of the coupling base 90*a* is not limited to aluminum. For example, metal (e.g. iron, copper), conductive ceramic or conductive resin normally used for a process cartridge, such as a molded product generated by adding a conducting agent to polyacetal, polyester, epoxy resin or the like, may be used. For the conducting agent, an electronic conducting agent, ion conducting agent or the like may be selected. A guideline is that the volume resistivity of the driving coupling 90 becomes $1\times10^{10}$ Ωcm or less.

The material of the electrostatic adsorption function portion 90*g* used here is a modified polyimide, which functions as a dielectric body, and of which volume resistivity is $1\times10^{12}$ Ωcm. The electrostatic adsorption function portion 90*g* here can be appropriately selected in accordance with the required electrostatic adsorption force in the range of the volume resistivity $1\times10^{10}$ Ωcm to $1\times10^{14}$ Ωcm. The material thereof is not especially limited either, and polyacetal, polyvinylidene fluoride, urethane rubber or the like can be used, and the conducting agent to adjust the volume resistivity can also be appropriately selected, such as an electronic conducting agent and an ion conducting agent. The electronic conducting agent that can be used is: carbon black or graphite having electronic conductivity; oxide (e.g. tin oxide); metal (e.g. copper, silver); conductive particles generated by coating oxide or metal on the particle surfaces to have conductivity. The ion conducting agent, for example, is an ion conducting agent having ion exchange properties, such as quaternary ammonium salt or sulfonic acid salt, which presents ion conductivity.

The dielectric body here is refers to a substance in which current does not flow easily, and which generates dielectric polarization when an electric field is applied, and includes a substance having a resistance component and a dielectric component in the electrogenesis mechanism, such as an insulator containing conductive particles. Here the volume resistivity of the electrostatic adsorption function portion 90*g* (sheet member) is measured at a 1000 V applied voltage using the Mitsubishi Chemical Analytech Hiresta Co., Ltd. UP MCP-HT450 unit and a UR ring probe.

The conductive double-sided tape used to fix the coupling base 90*a* and the electrostatic adsorption function portion 90*g* used here is the conductive double-sided tape No. 5805 manufactured by Hitachi Maxell Ltd. The method of connecting the coupling base 90*a* and the dielectric body is not limited to the conductive double-sided tape, but may be appropriately selected, such as using a conductive adhesive.

The driving coupling 90, on the other hand, is coaxially connected to a large gear 97 which transfers the driving force of the motor 95 (driving source) to the drum 62. The large gear 97 is a helical gear, and this helical gear is engaged with a small gear 96 which is fixed to or integrated with the shaft of the motor 95. Here the helical direction of the helical gear of the large gear 97 is set such that the thrust force of the large gear 97 is applied to the cartridge B side when the large gear 97 is driven by the small gear 96.

The material of the large gear 97 used here is sliding grade polyacetal, which is used for electrophotographic image forming apparatuses. The material of the large gear 97 must electrically insulate the large gear 97 from the driving force transfer coupling. Therefore the material of the large gear 97, is not limited to the sliding grade polyacetal, but may be appropriately selected if the volume resistivity of the material is $1\times10^{15}$ Ωcm or more. The material of the small gear 96 used here is also the sliding grade polyacetal, which is used for electrophotographic image forming apparatuses. This material can be appropriately selected based on the required characteristics of the product, such as lifespan, without being restricted by the volume resistivity.

Alternatively the material of the large gear 97 may be a material having the same conductivity as the driving coupling 90, so that the large gear 97 and the driving coupling 90 are integratedly molded. In this case, a material of which volume resistivity is $1\times10^{15}$ Ωcm or more is selected for the small gear 96, and the upstream side of the small gear 96 during driving is insulated. In other words, the driving coupling 90 and the driving motor 95 are insulated by selecting a material of which volume resistivity is $1\times10^{15}$ Ωcm or more, for any component located between the driving coupling 90 and the driving motor 95.

The connection of the driving coupling 90 and the large gear 97 will be described. The driving coupling 90 and the large gear 97 are connected by press fitting by performing knurling on the interfitting portion of the driving coupling 90. This connection is not limited to press fitting, but may be adhesion, insert molding or the like, as long as the required driving transfer torque is satisfied. The driving coupling 90 contacts a feeding contact 98 disposed on the apparatus main body at the edge on the opposite side of the cartridge B in the rotation axis direction of the driving force transfer coupling. The feeding contact 98 is electrically conducted with a high voltage power supply 100 included in the apparatus main body A. By this configuration, the high voltage power supply 100 and the driving coupling 90 are electrically conducted. The power feeding ON/OFF from the high voltage power supply 100 to the driving coupling 90 is controlled by the controller (control unit) 101 disposed in the apparatus main body A.

The function of connecting the driving force transfer coupling by attaching the cartridge B to the apparatus main body A will be described. When the door 13 of the apparatus main body A is opened in the above mentioned configuration, the driving coupling 90, disposed in the apparatus main body A, moves away from the cartridge B in the rotation axis direction. Then the cartridge B is attached to the apparatus main body A. If the door 13 is closed here, the driving coupling 90, which just moved to the retracting position, moves toward the cartridge B. By this movement, the circular boss 63*d* disposed in the driven coupling 63 and the interfitting hole 90*d* formed in the driving coupling 90 are engaged, and the rotation center of the driving coupling 90 is determined. Further, the driving force transfer surfaces 90*c* and 63*c* of the driving coupling 90 and the driven coupling 63 contact with each other as the driving force transfer function portions.

<Driving Transfer Mechanism>

A driving transfer mechanism in the above mentioned driving force transfer surfaces 90*c* and 63*c*, for the driving force transfer coupling to drive the photosensitive drum, will be described with reference to FIG. 1 and FIG. 6. In the present invention, the electrostatic adsorption function generated by the Johnsen-Rahbek force is used as a means of causing friction between the driving force transfer surfaces 90*c* and 63*c*. The Johnsen-Rahbek force is a force generated when the volume resistivity of the dielectric body (electrostatic adsorption function portion 90*g*) is decreased, since this makes it easier for the charges in the dielectric body to move, and a large amount of charges are induced in the outermost surface of the dielectric layer (driving force transfer surface 90*c*) which is the adsorption surface. Generally the Johnsen-Rahbek force that is generated is large, compared with the force that is generated when an insulator, of which resistance is very high, is used as the dielectric body (electrostatic adsorption function portion 90*g*) (this force is called the "Coulomb force"). In other words, the charges applied to the electrode (feeding contact 98) move to the outermost surface of the dielectric layer (driving force transfer surface 90*c*) via the dielectric layer (electrostatic adsorption function portion 90*g*). A part of the charges which moved to the outermost surface of the dielectric layer (driving force transfer surface 90*c*) flow into the adsorbed target (driving force transfer surface 63*c*), and because of these charges, the adsorbed target (driving force transfer surface 63*c*) is charged by electrostatic induction or dielectric polarization, whereby the electrostatic adsorption force is generated.

As described above, the electrostatic adsorption force changes in proportion to the size of the region where the current flows between the electrodes and the applied voltage. Therefore the first electrode (drum shaft 78), which is an earth path, functions as a ground if at least one point of the energizing region is ensured. In the case of the second electrode (driving force transfer surface 63*c*) and the third electrode (electrostatic adsorption function portion 90*g*), on the other hand, the region where the adsorption force is generated differs depending on the size of the conducted surface area. Therefore the second electrode (driving force transfer surface 63*c*) and the third electrode (electrostatic adsorption function portion 90*g*) require a size of the contact area in accordance with the required electrostatic adsorption force, and the surface roughness of the electrode is one means of ensuring this contact area effectively. For this reason, in the present invention, the surface roughness Ra of the electrode surface, to generate the electrostatic adsorption force, is 0.2 or less. Thereby the contact area to energize the second and third electrodes can be decreased compared with the case when the surface roughness Ra is greater than 0.2.

The driving transfer function of the driving force transfer coupling during the print operation will be described. As mentioned in the section on attaching/detaching the CRG cartridge, the driving force transfer surfaces 90*c* and 63*c* of the driving force transfer couplings are in the contacted state when the cartridge B is attached to the apparatus main body A. Then based on the print signal, the controller 101, disposed in the apparatus main body A, applies a −1 kV voltage from the high voltage power supply 100 to the driving force transfer couplings via the feeding contact 98. Thereby the current flows to the ground in the following sequence: coupling base 90*a*→electrostatic adsorption function portion 90*g* (dielectric layer)→driving force transfer surface 90*c*→driving force transfer surface 63*c*→coupling base 63*a*→conducting portion on inner surface of photosensitive drum 62→flange 64→drum shaft 78→earth contact 99.

According to the above mentioned mechanism of generating the Johnsen-Rahbek force, this current flow generates the following phenomena. In other words, the charges applied to the coupling base 90*a*, which is an electrode (electrode on one side), move to the driving force transfer surface 90*c*, which is the surface of the electrostatic adsorption function portion 90*g*—outermost surface of the dielectric layer—via the electrostatic adsorption function portion 90*g*, which is a dielectric layer (dielectric body)). Because of these charges, the driving force transfer surface 63*c* of the driven coupling 63, which is the adsorbed target (electrode on the other side), is charged by electrostatic induction or dielectric polarization. As a result, the electrostatic adsorption force is generated between the driving force transfer surface 90*c* and the driving force transfer surface 63*c*. Then the motor 95, disposed in the apparatus main body A, is driven, and the large gear 97 is driven via the small gear 96. By this operation, the electrostatic adsorption force is converted into the friction force between the driving force transfer surface 90*c* and the driving force transfer surface 63*c*, whereby the drum 62 is driven.

In concrete terms, the configuration of Example 1, which is a configuration to generate the electrostatic adsorption force between a pair of electrodes which face each other via the dielectric body, can be described as follows. In other words, in the driving coupling 90 (first coupling member), the joining portion (opposite surface 90*f* and neighboring region thereof) with the electrostatic adsorption function portion 90*g* (dielectric body) corresponds to one electrode out of the pair of electrodes facing each other. Further, in the driven coupling 63 (second coupling member), the joining portion (driving force transfer surface 63*c* and neighboring region thereof) with the electrostatic adsorption function portion 90*g* corresponds to the other electrode out of the pair of electrodes facing each other. If the high voltage power supply 100 applies the voltage between the driving coupling 90, the electrostatic adsorption function portion 90*g* and the driven coupling 63, minus charges are induced in the driving force transfer surface 90*c* of the electrostatic adsorption function portion 90*g*. Because of this, plus charges are induced in the driving force transfer surface 63*c* of the driven coupling 63. Since charges are disposed in this way, the electrostatic adsorption force is generated between the driving coupling 90 and the electrostatic adsorption function portion 90*g*, and between the electrostatic adsorption function portion 90*g* and the driven coupling 63 respectively, and the driving coupling 90, the electrostatic adsorption function portion 90*g* and the driven coupling 63 are adsorbed to each other. This electrostatic adsorption force adjust the voltage applied by the high voltage power supply 100 so that the rotationally driving force, which is transferred from the motor 95 (power source) to the driving coupling 90, can be transferred to the driven coupling 63 via the electrostatic adsorption function portion 90*g* without loss. In Example 1, the configuration to apply voltage which generates the above mentioned electrostatic adsorption force, including the high voltage power supply 100, controller (control unit) 101, feeding contact 98 and earth contact 99, corresponds to the voltage applying portion according to the present invention.

In actual experiment, about a 170 μA current flow and about 1 kgfcm driving transfer torque was acquired when −1 kV voltage is applied.

Here in the coupling base 90*a* on the driving side and the coupling base 63*a* on the driven side, the 2 mm C chamfered edges 90*e* and 63*e* are formed around the interfitting portion of the circular boss 63*d*, and the electrostatic adsorption function portion 90*g*, having a through hole of which internal diameter is approximately the same as the diameter of the circular boss 63*d*, is disposed. Further, the outer diameter of the electrostatic adsorption function portion 90*g* is larger by 4 mm than the outer diameters of the driving force transfer function portions 90*b* and 63*b* of each coupling base 90*a* and 63*a*. Therefore the creepage distance between the coupling base 90*a* and the coupling base 63*a* via the electrostatic adsorption function portion 90*g* substantially becomes 4 mm. The creepage distance between the coupling base 90*a* and the coupling base 63*a* via the electrostatic adsorption surfaces respectively is set to a distance that is sufficient to suppress the generation of leakage (flow of current which does not contribute to electrostatic adsorption). To prevent this leakage, an approximate creepage distance is set in accordance with the apparatus configuration and the like.

When the voltage exceeding the withstand voltage of the electrostatic adsorption function portion is applied, a dielectric breakdown occurs, and the electrostatic adsorption force cannot be acquired. Therefore the voltage, to acquire the electrostatic adsorption force, is set to be not more than the withstand voltage of the electrostatic adsorption function portion 90*g*.

<Transferable Torque and Electrostatic Adsorption Force>

Figure 7A:
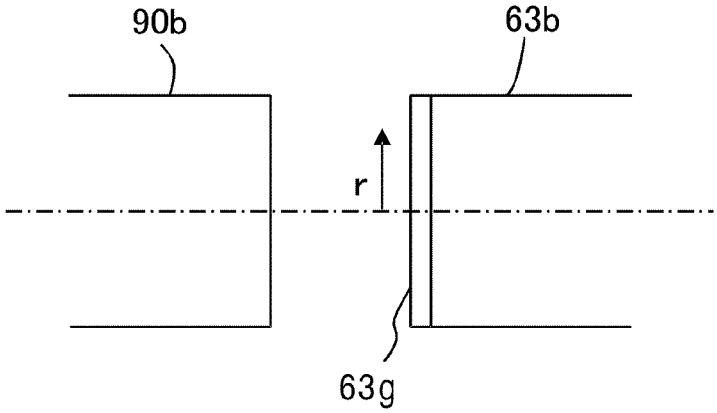
FIG. 7A shows the relationship between the electrostatic adsorption force and the transferrable torque.

The relationship between the transferable torque and the electrostatic adsorption force in the driving power transfer mechanism using the electrostatic adsorption force, based on the coupling configuration illustrated in FIG. 7A, will be described. The coupling configuration illustrated in FIG. 7A is a simplified configuration when the aligning mechanism using the circular boss is omitted in the coupling configuration of Example 1. In concrete terms, the front end surface of the driving force transfer function portion 90*b* of the driving coupling 90 and the front end surface of the driving force transfer function portion 63*b* of the driven coupling 63 which faces the driving coupling 90 are circular end faces in which the interfitting holes are omitted respectively. The electrostatic adsorption function portion 63*g*, where the through hole to insert the circular boss of Example 1 is omitted, is adhered to the driven coupling 63. The electrostatic adsorption function portion 63*g* is formed to have the same diameter as the driving force transfer function portions 90*b* and 63*b*. In other words, the front end surface of the driving force transfer function portion 90*b* of the driven coupling 63 is the driving force transfer surface, so that the driving force is transferred when this driving force transfer surface and the electrostatic adsorption function portion 63*g* are electrostatically adsorbed to each other.

Figure 7B:
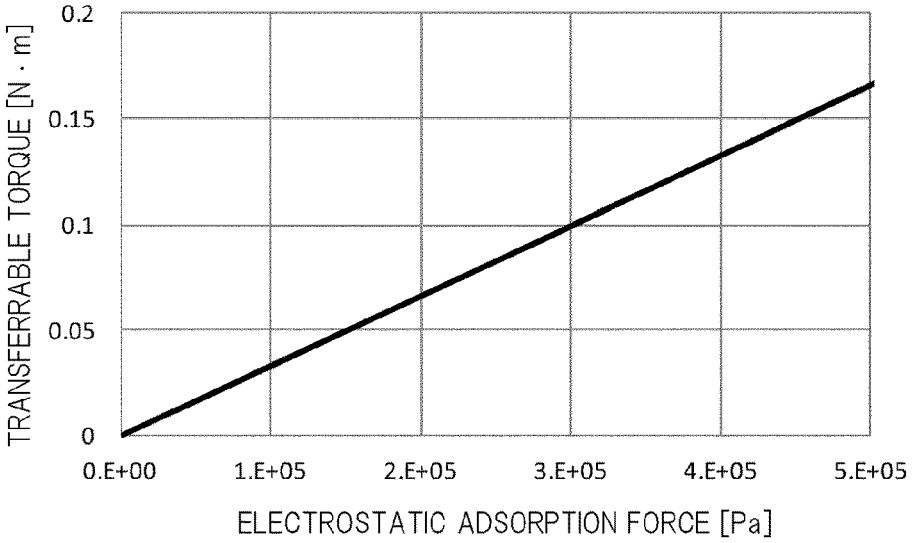
FIG. 7B shows the relationship between the electrostatic adsorption force and the transferrable torque.

FIG. 7B is a graph depicting the relationship between the electrostatic adsorption force and the transferable torque. The electrostatic adsorption force and the transferable torque are given by the following expression.

In Expression (1), T: transferable torque [N·m], μ: friction coefficient between the electrostatic adsorption function portion 63*g* and the driving coupling 90, D: outer diameter [m] of the electrostatic adsorption function portion 63*g*, p(r): electrostatic adsorption force [Pa], and r: position in the radius direction from the rotation center [m].

If the electrostatic adsorption force is constant within the driving force transfer surface, Expression (1) is expressed as follows.

Expression (2) can be expressed by the graph as in FIG. 7B. FIG. 7B is a calculation result when the outer diameter D is 16 mm, and the friction coefficient μ is 0.3. According to FIG. 7B, the transferable torque increases in proportion to the electrostatic adsorption force. For example, if the transferable torque is set to 0.1 Nm, about 300 kPa of electrostatic adsorption force can be acquired.

Figure 8:
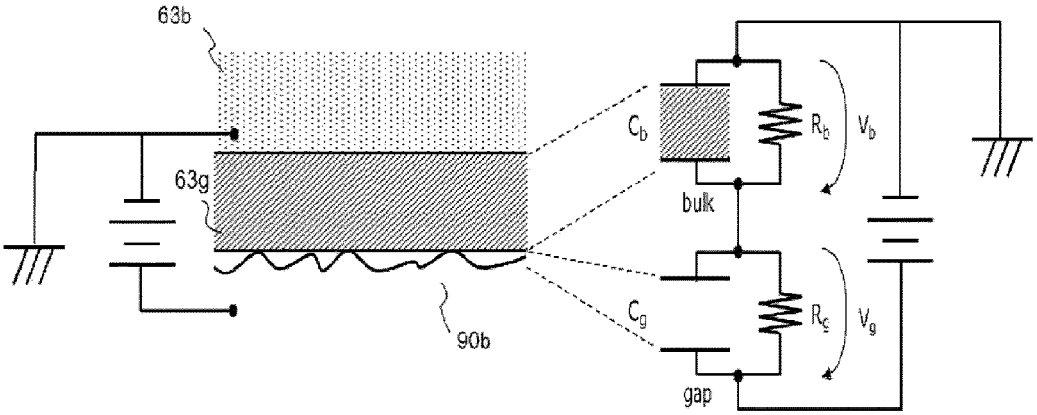
FIG. 8 is an equivalent circuit diagram of a coupling configuration using the electrostatic adsorption force.

The electrostatic adsorption force will be described with reference to FIG. 8 to FIG. 9B. FIG. 8 is an equivalent circuit diagram depicting the micro contact state between the driving force transfer function portion 90*b* of the driving coupling 90 and the electrostatic adsorption function portion 63*g*, and the electric properties thereof, in the coupling configuration in FIG. 7A. In FIG. 8, the electrostatic adsorption force, when sufficient time has elapsed after voltage is applied, is given by the following expression.

In Expression (3), 60: dielectric constant in the atmosphere, Rg: contact resistance [Ω] between the electrostatic adsorption function portion 63*g* and the driving force transfer function portion 90*b*, and Rb: volume resistance [Ω] of the electrostatic adsorption function portion 63*g*. Further, V: applied voltage, and d: average gap distance [m] between the driving force transfer function portion 90*b* and the electrostatic adsorption function portion 63*g*. Expression (3) indicates that the electrostatic adsorption force changes in accordance with the volume resistance Rb of the electrostatic adsorption function portion 63*e*, and the electrostatic adsorption force can be increased if the volume resistivity of the electrostatic adsorption function portion 63*g* is decreased.

Figure 9A:
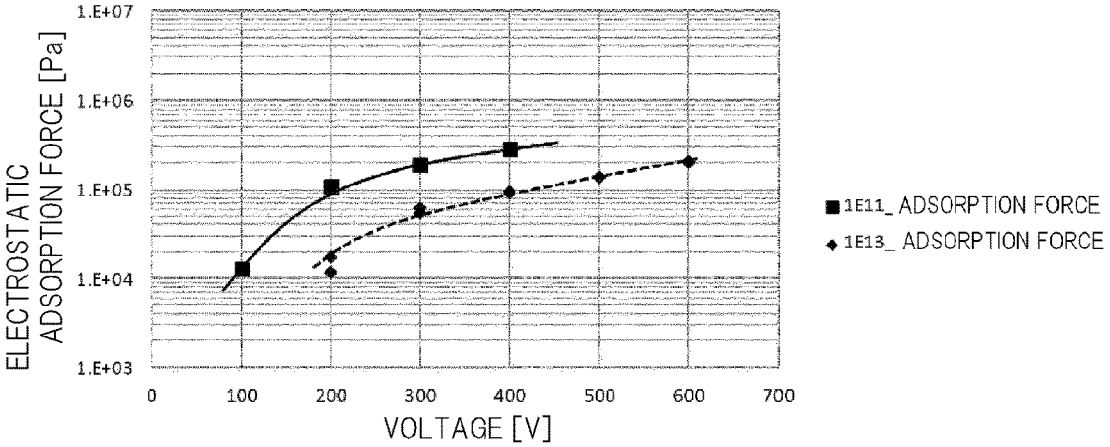
FIG. 9A is a graph depicting the relationship between the electrostatic adsorption force and the voltage.
Figure 9B:
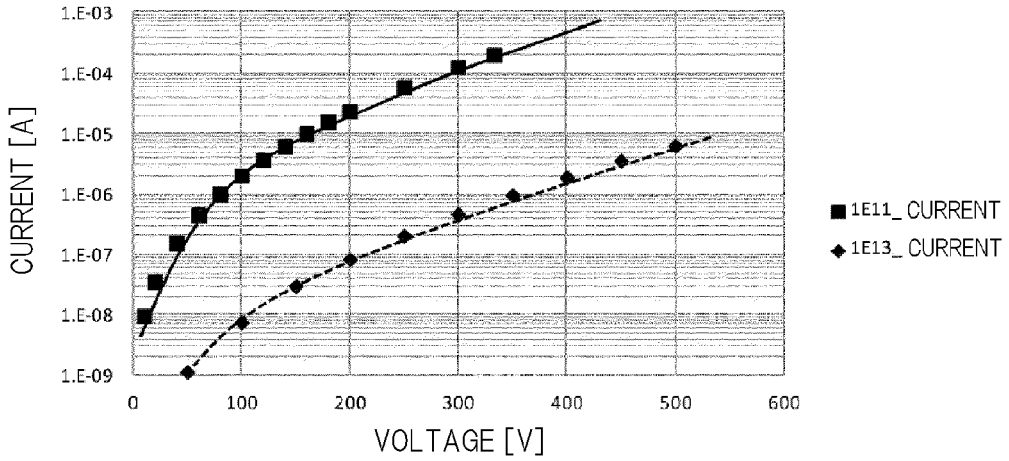
FIG. 9B is a graph depicting the relationship between the current and the voltage.

FIGS. 9A and 9B show the electrostatic adsorption force and the result of measuring the current that flows. The electrostatic adsorption force was measured by removing the cartridge B, including the electrostatic adsorption function portion 63*g*, from the apparatus main body A, contacting the electrostatic adsorption function portion 63*g* to an aluminum plate assuming this aluminum plate is the driving coupling 90, then measuring the force to separate the electrostatic adsorption function portion 63*g* from the aluminum plate. For this preliminary test, the volume resistivity of the electrostatic adsorption function portion 63*g* was $1\times10^{11}$ Ωcm and $1\times10^{13}$ Ωcm, and the thickness thereof was 75 μm. The volume resistivity here is determined from the current when the applied voltage is 100 V, and in the case of an intermediate resistance material, the volume resistivity is normally changed in accordance with the applied voltage, depending on the temperature characteristics of the material and the non-ohmic conduction mechanism.

According to the result of measuring the electrostatic adsorption force in FIG. 9A, the electrostatic adsorption force is higher as the volume resistivity is lower. This is as described in Expression (3). The electrostatic adsorption force acquired in an intermediate resistance region, where the volume resistivity is approximately $1\times10^{9}$ Ωcm to $1\times10^{14}$ Ωcm, is called the Johnsen-Rahbek force. The Johnsen-Rahbek force that is acquired can be large, but the power consumption must be monitored because a leak current is generated. In the actual current measurement result in FIG. 9B, about a 400 μA current is generated when the volume resistivity is $1\times10^{11}$ Ωcm and the applied voltage is 400 V, that is, the power consumption is 400 V×400 μA=0.16 W.

Figure 10A:
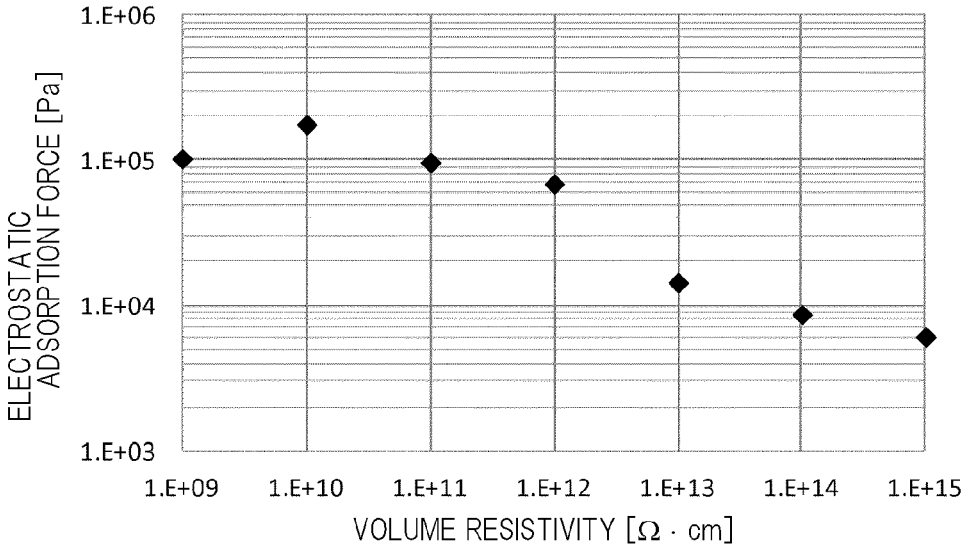
FIG. 10A is a graph depicting the relationship between the electrostatic adsorption force and the volume resistivity.
Figure 10B:
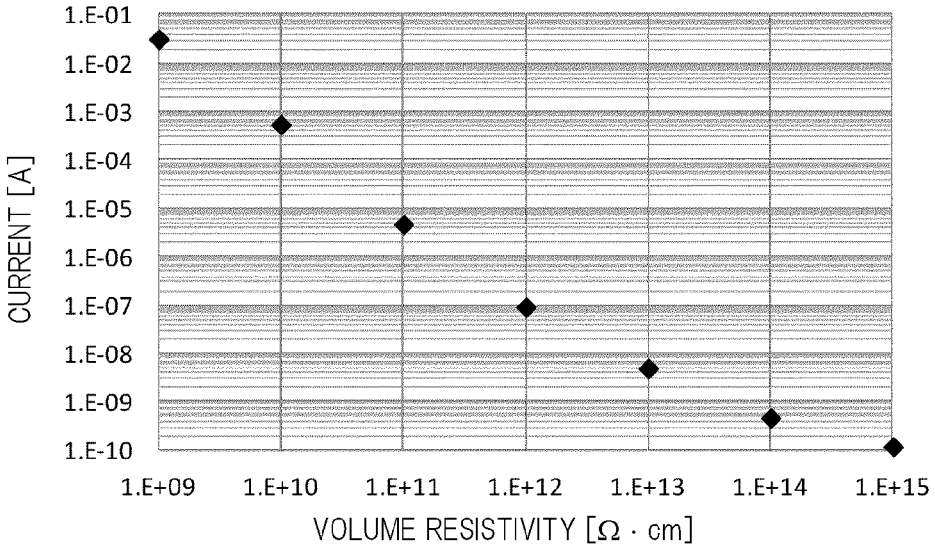
FIG. 10B is a graph depicting the relationship among the current and the volume resistivity.

If the volume resistivity is too low, on the other hand, the electrostatic adsorption force decreases, as the test result shows. FIGS. 10A and 10B show the electrostatic adsorption force and the result of the measuring current that flows, with respect to the volume resistivity, and is a result of performing the same test as the preliminary test described with reference to FIGS. 9A and 9B when the applied voltage is 200 V. As FIG. 8 shows, when the voltage resistivity is high, the amount of the charges stored in a gap decreases, since current does not flow. As a result, the electrostatic adsorption force, which depends on charges, decreases. In other words, the Johnsen-Rahbek force is not applied. If the volume resistivity is low, on the other hand, the conductive carbons, which are precipitated on the surface, increase, and the contact resistance Rg decreases. As Expression (3) shows, if Rg decreases with respect to the volume resistance Rb, the voltage Vg applied to the gap decreases. Then the electrostatic adsorption force decreases. In other words, even if the volume resistivity of the electrostatic adsorption function portion 63*g* is decreased, the electrostatic adsorption force does not always increase, and the electrostatic adsorption force reaches its peak at a certain volume resistivity.

<Advantages of this Example>

In this example, the aligning configuration to match the respective rotation center axes of the driving coupling 90 and the driven coupling 63 using the circular boss 63*d* (aligning function portion to determine the rotation center) is disposed in a region near the rotation center axis, that is, a center portion of the circular adsorption joining surfaces. The transfer of the rotation driving force in the circular joining surfaces that are perpendicular to the rotation axis line without loss is equivalent to a feature where the joining surfaces do not deviate from each other in the circumferential direction, that is, a relative shift between the driving coupling 90 and the driven coupling 63 in the rotating direction are to be suppressed. In order to suppress the shift of the joining surfaces in the circumferential direction, the adsorption force in the region on the outer periphery side, which is distant from the rotation axis center, is critical, since the joined area is relatively large at this location. As Expression (1) shows, the transferable torque T is determined by the integration of the product of the position in the radius direction r and the electrostatic adsorption force P(r) at this position. In other words, the electrostatic adsorption force on the outer side in the radius direction (r is larger) of the electrostatic adsorption function portion contributes even more so to the transferable torque than the inner side of the radius direction (r is smaller) thereof. Therefore if a sufficient adsorption force can be ensured in the region on the outer periphery side, the rotary driving force can be transferred without loss, even if the adsorption force is not applied to the region around the rotation axis center. In this example, the electrostatic adsorption joining surfaces of the driving coupling 90, the driven coupling 63 and the electrostatic adsorption function portion 90*g* are ring-shaped surfaces having an inner diameter and an outer diameter, and the aligning configuration is disposed at the rotation center portion on the inner side of the joining surfaces. Further, the circular boss 63*d*, which is the aligning member, is constituted by an insulating material, and chamfer is formed around the opening of the interfitting hole of each coupling. Furthermore, the inner diameter and the outer diameter of the electrostatic adsorption function portion 90*g* are extended to the inner diameter side and the outer diameter side respectively, compared with the joining region (joining surface) with each coupling. In other words, the outer diameter of the surface of the electrostatic adsorption function portion 90*g* facing each coupling is larger than the outer diameter of the joining region (joining surface) with each coupling, and the inner diameter of the surface thereof facing teach coupling is smaller than the inner diameter of the joining region (joining surface) with each coupling. Furthermore, the electrostatic adsorption function portion 90*g* has a through hole, of which inner diameter is approximately the same as the outer diameter of the circular boss 63, so as to contact the circular boss 63 on the inner diameter side of the ring-shaped joining surface. Thereby the driving coupling 90 and the driven coupling 63 are accurately aligned, and the electrostatic adsorption force is stably generated without leakage, and as a result, the driving force can be transferred without loss.

(Modification 1)

Modification 1 of Example 1 will be described next. In this modification, magnetic adsorption is used instead of electrostatic adsorption, in order to reduce power consumption of the driving force transfer coupling using electrostatic adsorption described in Example 1.

Figure 35:
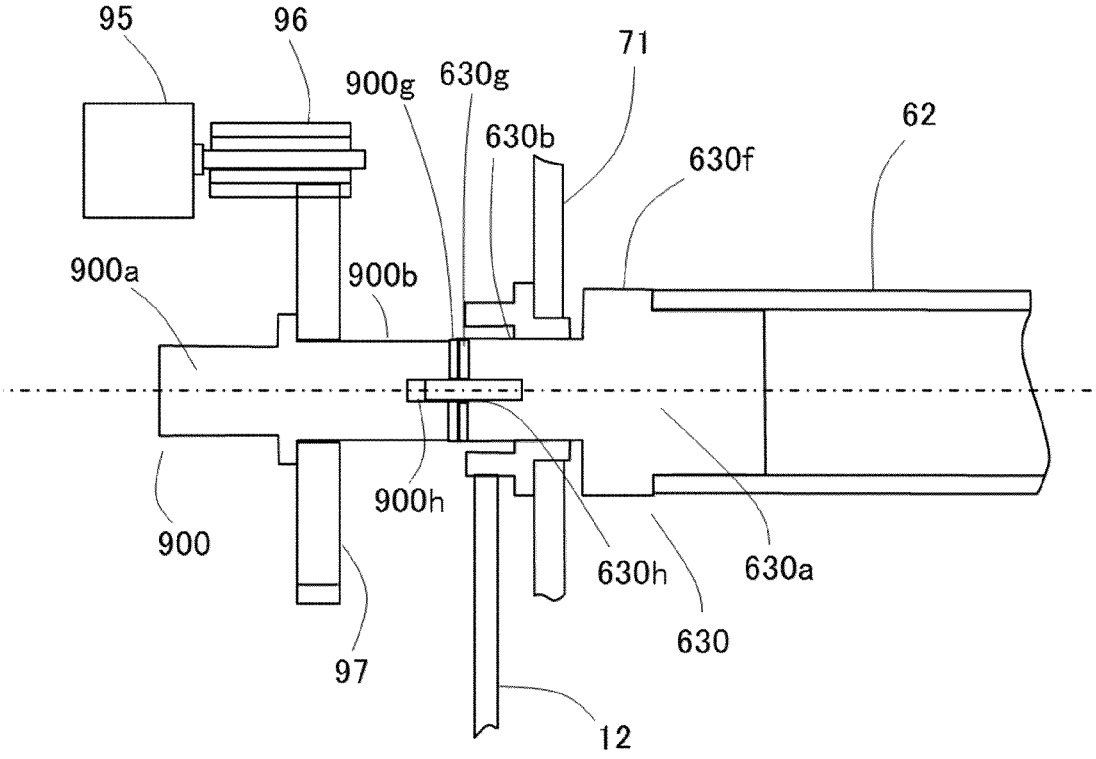
FIG. 35 is a schematic cross-sectional view of a driving force transfer mechanism according to Modification 1 of the present invention.
Figure 36:
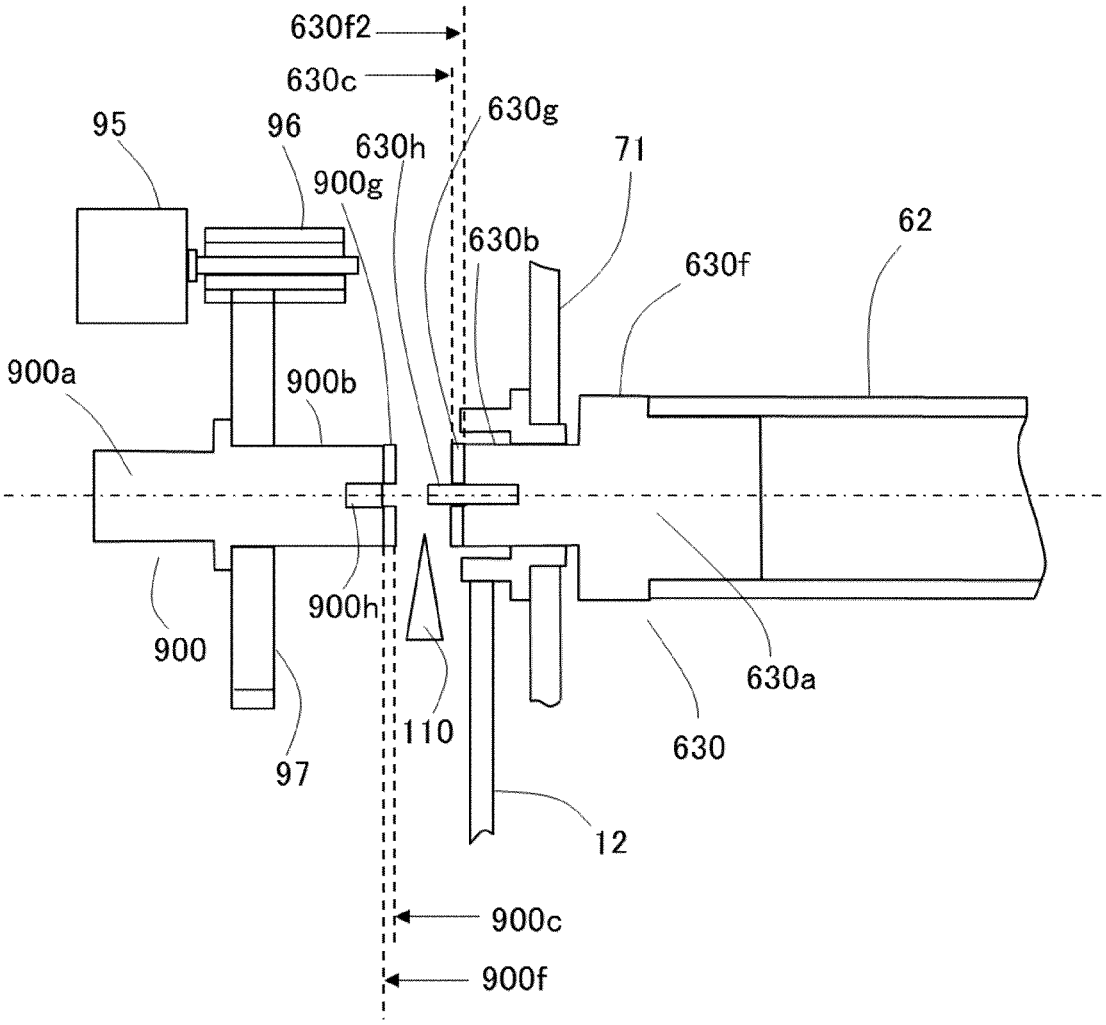
FIG. 36 is a schematic cross-sectional view depicting a driving force transfer mechanism according to Modification 1 of the present invention.

FIG. 35 is a schematic cross-sectional view depicting a driving force transfer mechanism according to Modification 1, and illustrates a state when a driving coupling 900 and a driven coupling 630 are connected. FIG. 36 is a schematic cross-sectional view depicting the driving force transfer mechanism according to Modification 1, and illustrates a state when the driving coupling 900 and the driven coupling 630 are disconnected. The other configuration is the same as Example 1, therefore description thereof is omitted.

As illustrated in FIG. 35 and FIG. 36, instead of the electrostatic adsorption function portion, a magnet portion 630*g* on the driven coupling 630 side and a magnetic body portion 900*g* on the driving coupling 900 side are disposed as the magnetic adsorption function portion.

The magnet portion 630*g* has a Φ4 through hole, and is fixed to a corresponding surface 630*f* 2 of a coupling base 630*a* with a double-sided tape or the like, such that the through hole and a Φ4 interfitting hole 630*h* are aligned. In the same manner, the magnetic body portion 900*g* also has a Φ4 through hole, and is fixed, with a double-sided tape or the like, to a corresponding surface 900*f* of a coupling base 900*a* so that this through hole and a Φ4 interfitting hole 900*h* are aligned.

As illustrated in FIG. 35, the circular boss 630*d* is inserted into the interfitting hole 900*d* by approaching the magnet portion 630*g* and the magnetic body portion 900*g* toward each other, and the rotation center axis of the driving coupling 900 and that of the driven coupling 630 are aligned, then a driving force transfer surface 630*c* of the magnet portion 630*g* and a driving force transfer surface 900*c* of the magnetic body portion 900*g* are magnetically adsorbed to each other. Thereby the driving coupling 900 and the driven coupling 630 are accurately aligned and connected. The driving force transfer surface 630*c* is a surface perpendicular to the rotation axis line of the driven coupling 630, and the driving force transfer surface 900*c* is a surface perpendicular to the rotation axis line of the driving coupling 900.

A method of disconnecting the driving coupling 900 and the driven coupling 630 will be described next. As illustrated in FIG. 36, a separating member 110, disposed in the apparatus main body A, is inserted between the driving force transfer surfaces 630*c* and 900*c*, so as to separate the driving force transfer surface 630*c* of the magnet portion 630*g* and the driving force transfer surface 900*c* of the magnetic body portion 900*g*. Thereby the magnet portion 630*g* and the magnetic body portion 900*g* are separated. At this time, the driving coupling 900 moves to the left side in FIG. 36 in the rotation axis direction, so as to create a space from the driven coupling 630 for the separating member 110 to enter. A link mechanism (not illustrated) connects the door 13 and the separating member 110 so that the separating member 110 can be inserted, interlocking with the operation to open the door 13. By this link mechanism, the operation to extract the separating member 110 from the part between the driving force transfer surfaces 630*c* and 900*c* is performed, interlocking with the operation to close the door 13.

By this configuration, the driving force can be transferred without causing looseness to the driving force transfer couplings. In this modification, a ferrite magnet is used for the magnet portion 630*g*, and iron is used for the magnetic body portion 900*g*. However the material of the magnet portion 630*g* is not limited to a ferrite magnet, but a permanent magnet (e.g. neodymium magnet) may be used. The material of the magnetic body portion 900*g* is not limited to iron either, and such a magnetic body as ferrite, cobalt, nickel and gadolinium may be selected.

Needless to say, the desired driving transfer force can be acquired by appropriately selecting the surface area of the magnetic body portion 900*g* and the magnetic force of the magnet portion 630*g*.

The magnetic body portion may be disposed on the driven coupling 630 side, and the magnet portion may be disposed on the driving coupling 900 side.

Example 2

Example 2 will be described with reference to FIG. 11 and FIG. 12. Example 1 has a configuration in which the electrostatic adsorption function portion 90*g* (dielectric layer) is disposed in the driving coupling 90, but the present invention is not limited to this configuration.

Figure 11:
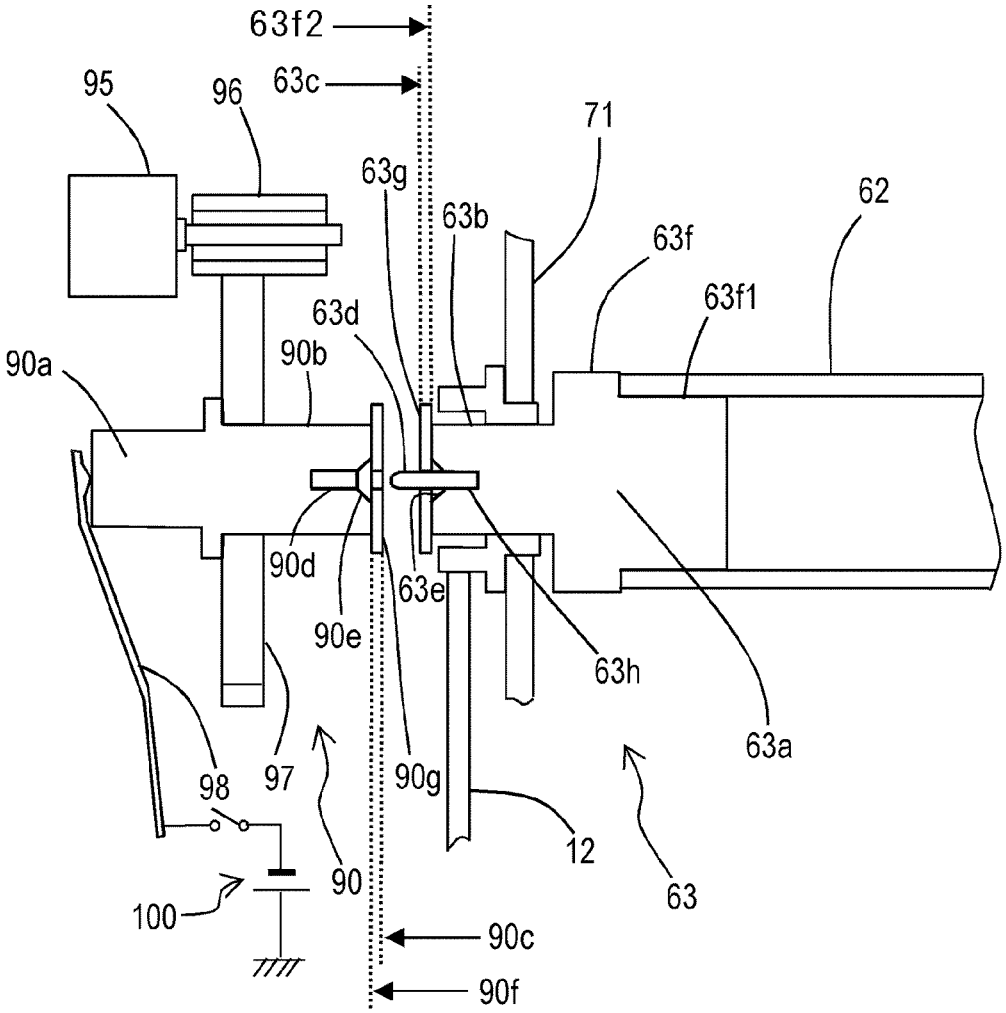
FIG. 11 is a schematic cross-sectional view depicting a driving force transfer mechanism according to Example 2 of the present invention.

FIG. 11 is a schematic cross-sectional view depicting the driving force transfer mechanism according to Example 2, and illustrates a state before the driving coupling 90 and the driven coupling 63 are connected. FIG. 12 is a schematic cross-sectional view depicting the driving force transfer mechanism according to Example 2, and illustrates a state when the driving coupling 90 and the driven coupling 63 are connected.

Figure 12:
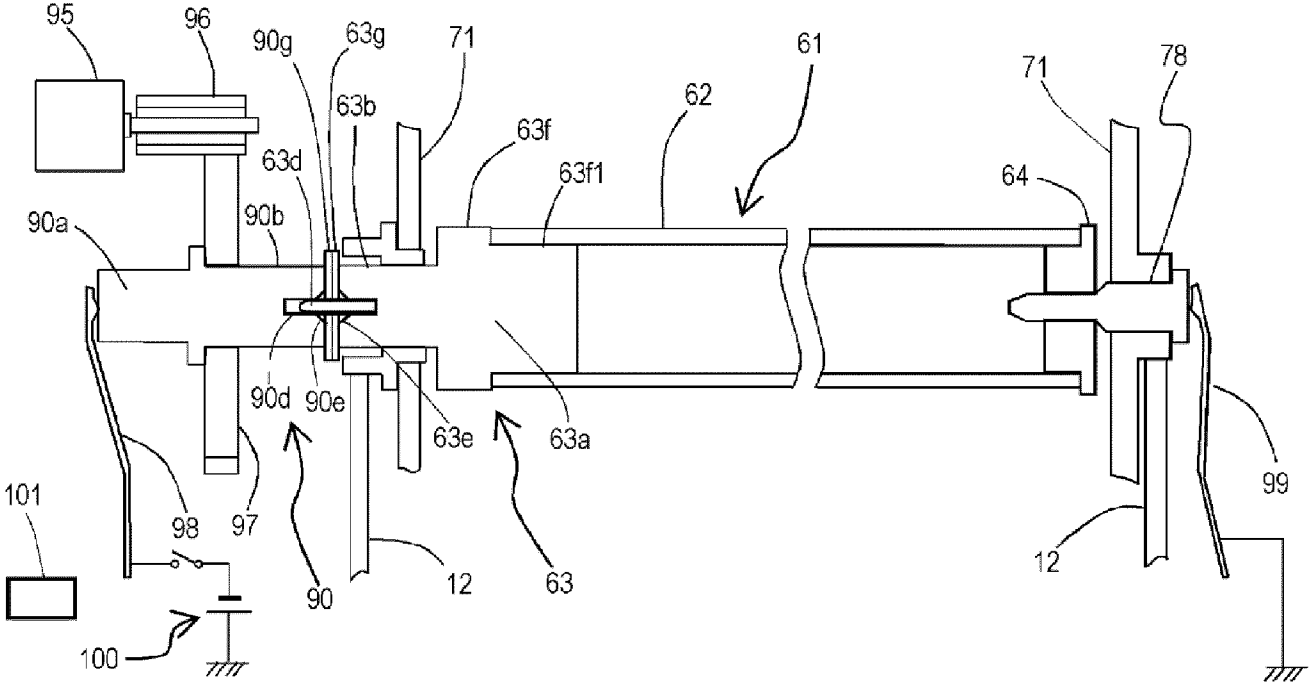
FIG. 12 is a schematic cross-sectional view depicting the driving force transfer mechanism according to Example 2 of the present invention.

As illustrated in FIG. 11 and FIG. 12, the electrostatic adsorption function portion (dielectric layer) may be divided into an electrostatic adsorption function portion 63*g* (second dielectric body) on the driven coupling 63 side, and an electrostatic adsorption function portion 90*g* (first dielectric body) on the driving coupling 90 side. The electrostatic adsorption function portion 63*g* has a Φ4 through hole, and is fixed to the corresponding surface 63*f* 2 of the coupling base 63*a* with conductive double-sided tape or the like, such that this through hole and a Φ4 interfitting hole 63*h* are aligned. In the same manner, the electrostatic adsorption function portion 90*g* also has a Φ4 through hole, and is fixed to the corresponding surface 90*f* of the coupling base 90*a* with conductive double-sided tape or the like, such that this through hole and a Φ4 interfitting hole 90*d* are aligned. When voltage is applied, dielectric polarization is generated in the electrostatic adsorption function portions 63*g* and 90*g* respectively, and the driving force transfer surface 63*c* of the electrostatic adsorption function portion 63*g* and the driving force transfer surface 90*c* of the electrostatic adsorption function portion 90*g* are electrostatically adsorbed to each other. Thereby the driving coupling 90 and the driven coupling 63 are connected.

Example 3

Example 3 will be described with reference to FIG. 13 and FIG. 14.

Figure 13:
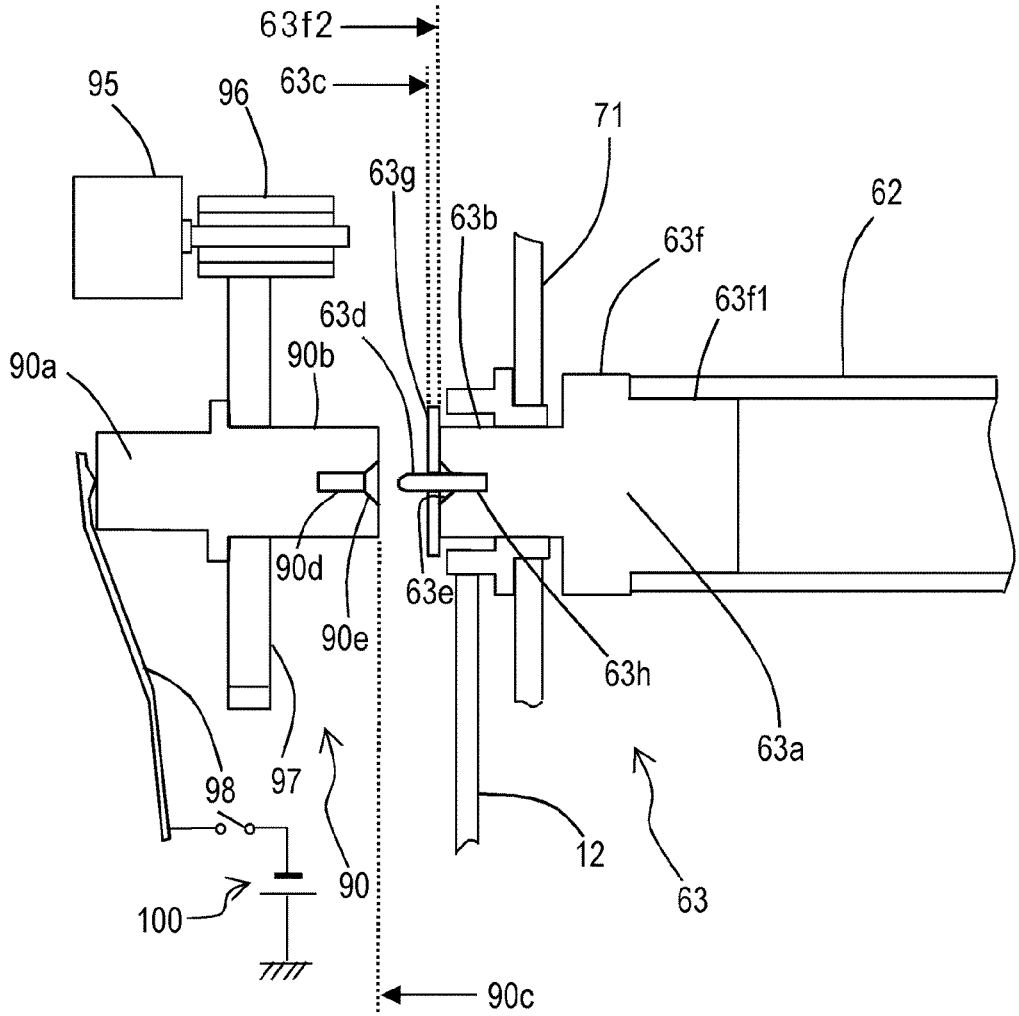
FIG. 13 is a schematic cross-sectional view depicting a driving force transfer mechanism according to Example 3 of the present invention.

FIG. 13 is a schematic cross-sectional view depicting a driving force transfer mechanism according to Example 3, and illustrates a state before the driving coupling 90 and the driven coupling 63 are connected. FIG. 14 is a schematic cross-sectional view depicting the driving force transfer mechanism according to Example 3, and illustrates a state when the driving coupling 90 and the driven coupling 63 are connected.

Figure 14:
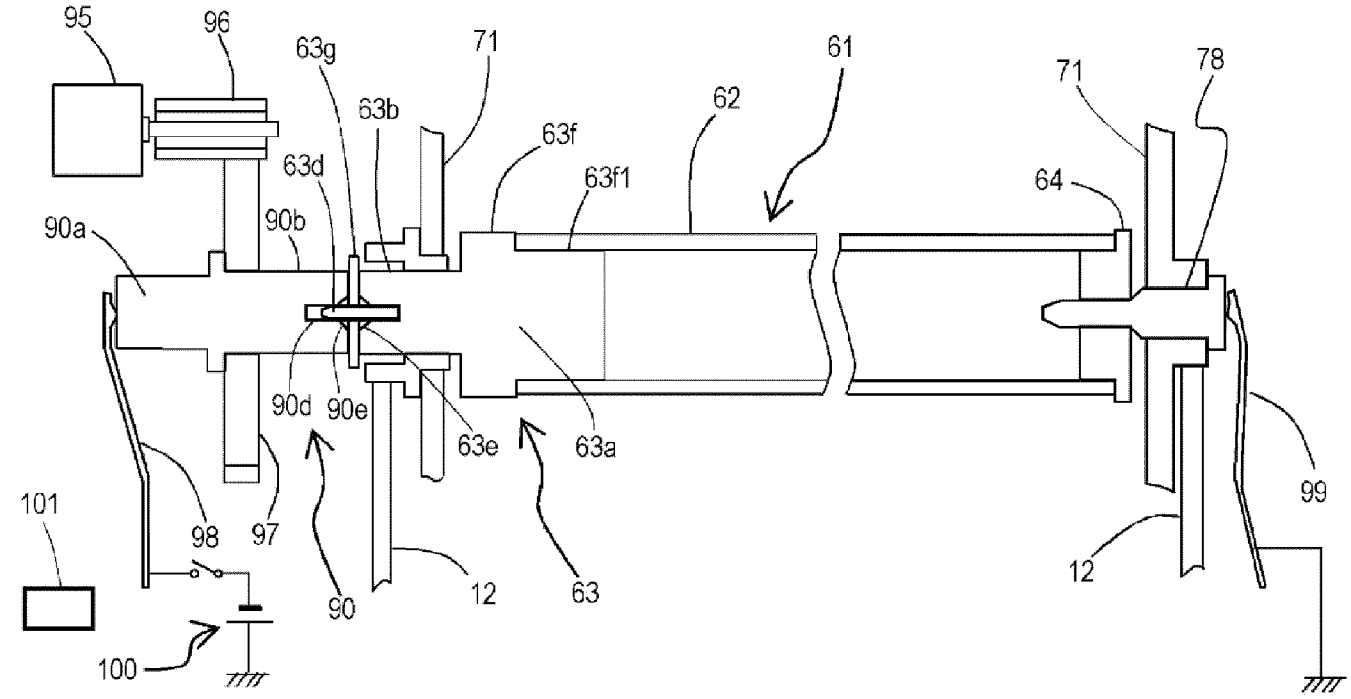
FIG. 14 is a schematic cross-sectional view depicting the driving force transfer mechanism according to Example 3 of the present invention.

As illustrated in FIG. 13 and FIG. 14, the electrostatic adsorption function portion may be disposed in the driven coupling 63 instead of the driving coupling 90. The electrostatic adsorption function portion 63*g* has a Φ4 through hole, and is fixed to the corresponding surface 63*f* 2 of the coupling base 63*a* with conductive double-sided table or the like, such that this through hole and a Φ4 interfitting hole 63*h* are aligned. As described above, when voltage is applied, dielectric polarization is generated in the electrostatic adsorption function portion 63*g*, and the driving force transfer surface 63*c* of the electrostatic adsorption function portion 63*g* and the driving force transfer surface 90*c* of the driving coupling 90 are electrostatically adsorbed to each other. Thereby the driving coupling 90 and the driven coupling 63 are connected.

By the above described configuration and functions, the driving force can be transferred without causing looseness to the driving force transfer coupling. Here needless to say, the desired driving transfer force can be acquired by appropriately selecting the surface area of the electrostatic adsorption function portion 90*g* (dielectric body) and voltage applied to the electrostatic adsorption function portion 90*g*.

In this example, the process cartridge, in which the cleaning unit and the developing unit are integrated, was described, but the configuration of the cartridge, which is detachable from the apparatus main body, is not limited to the configuration described in this example. Needless to say, the present invention can be applied to a configuration in which the cleaning unit and the developing unit are independent units as a cleaning cartridge (drum cartridge) and a developing cartridge respectively and are attached to or detached from the apparatus main body.

The present invention can also be effectively applied to an apparatus configuration which uses a cleanerless process, where the cleaning blade is not included. The present invention is also applicable to a driving coupling of the developing unit. And the present invention is also applicable to a multicolor image forming process. Further, the present invention is also applicable to an electric clutch, which utilizes the ON/OFF function of the electrostatic adsorption function based on the ON/OFF of the voltage that is applied to the coupling.

The functions, materials and shapes of the components described in this example and the relative positions thereof are not intended to limit the scope of the present invention unless otherwise specified.

Example 4

Figure 16:
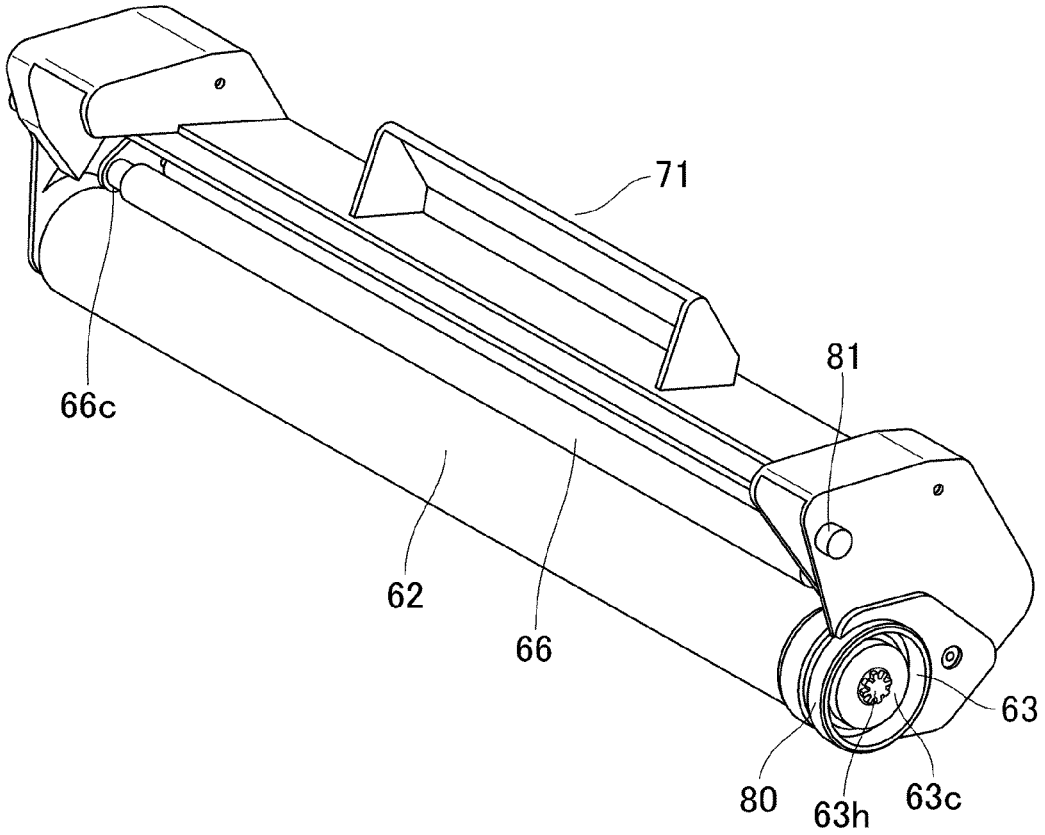
FIG. 16 is a schematic perspective view depicting a cleaning unit according to Example 4 of the present invention.
Figure 17:
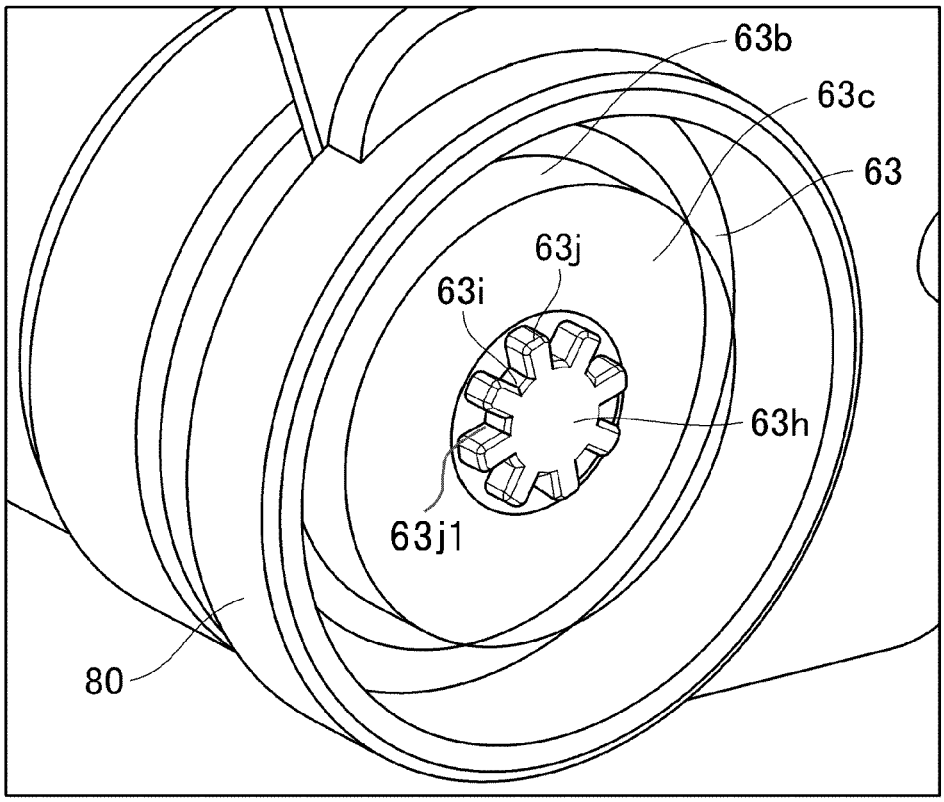
FIG. 17 is a schematic perspective view depicting a coupling of a process cartridge according to Example 4 of the present invention.
Figure 19:
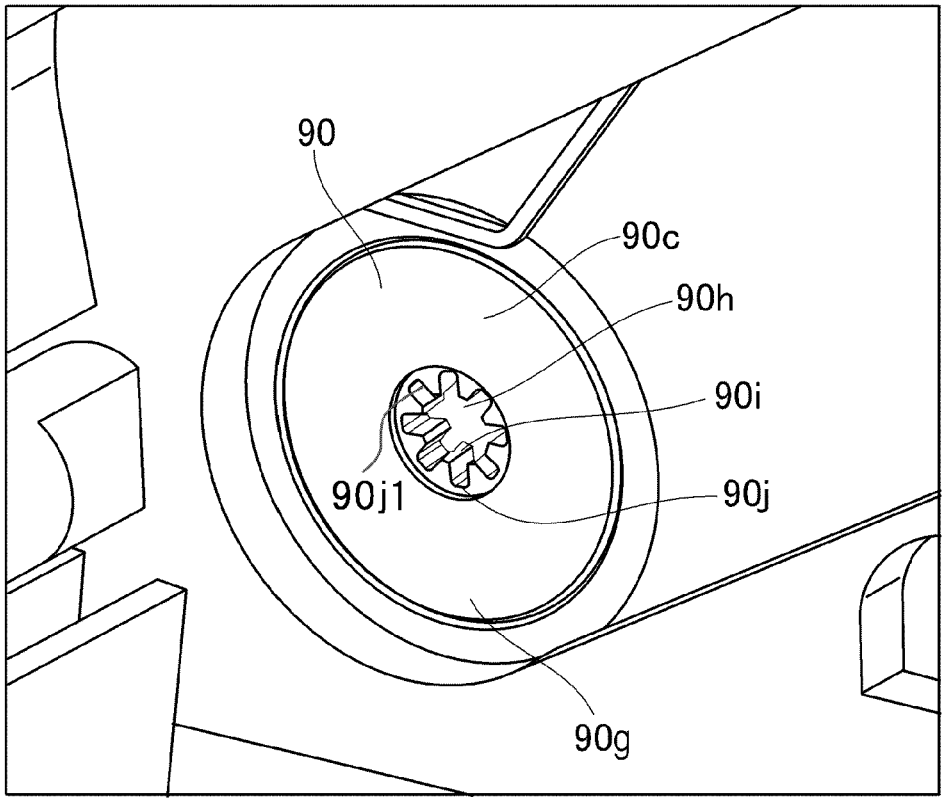
FIG. 19 is a schematic perspective view depicting a coupling of the apparatus main body according to Example 4 of the present invention.
Figure 20:
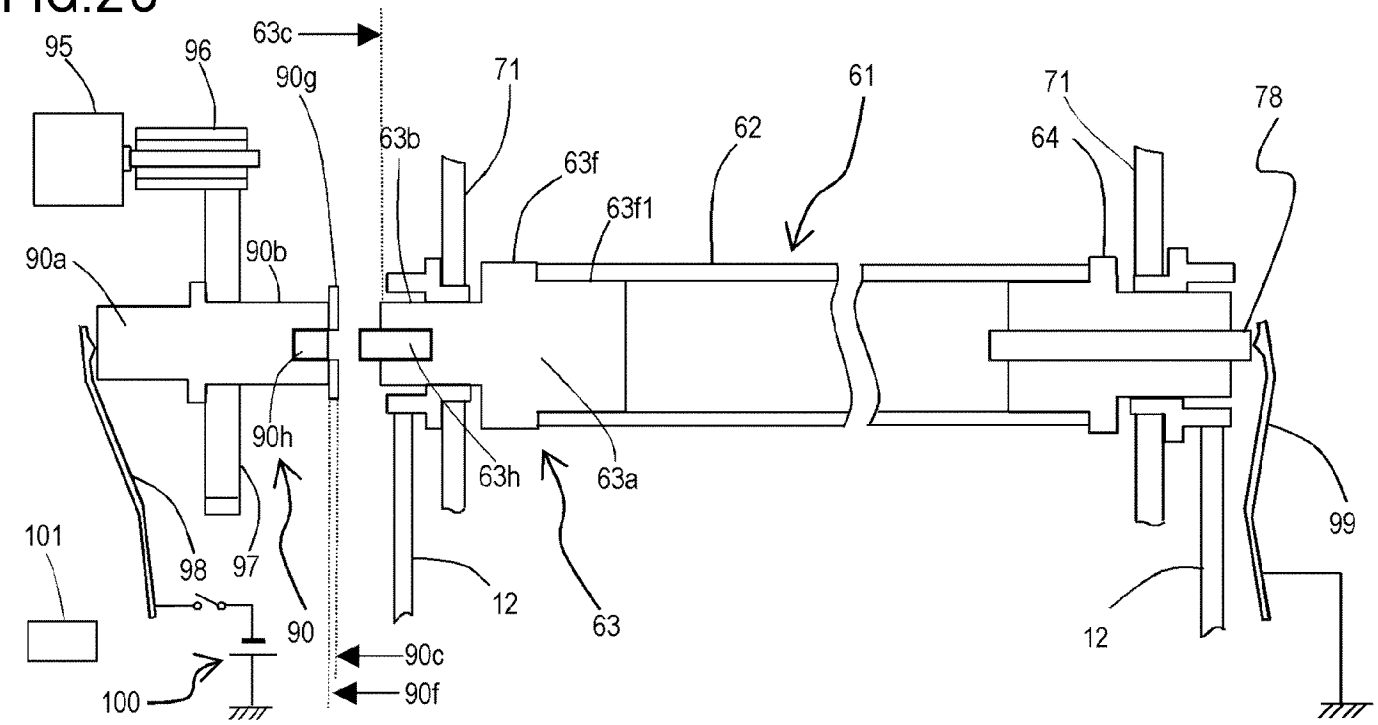
FIG. 20 is a schematic cross-sectional view depicting a driving force transfer mechanism according to Example 4 of the present invention.

The configuration of the driving force transfer coupling of Example 4 will be described in detail with reference to FIG. 15 to FIG. 20. FIG. 16 and FIG. 17 are schematic perspective views depicting a configuration of the driven coupling 63 of the cartridge B according to Example 4. FIG. 19 is a schematic perspective view depicting a configuration of the driving coupling 90 of the apparatus main body A according to Example 4. FIG. 20 is a schematic cross-sectional view depicting a driving force transfer mechanism according to this example, and illustrates a state before the driving coupling 90 and the driven coupling 63 are connected.

The driving force transfer coupling of the present invention is constituted by the driving coupling 90 disposed in the apparatus main body A, and the driven coupling 63 disposed in the cartridge B.

(Configuration of Driven Coupling 63 of Cartridge B)

A configuration of the driven coupling 63, which is a coupling on the driven side disposed in the cartridge B, will be described first.

Figure 15:
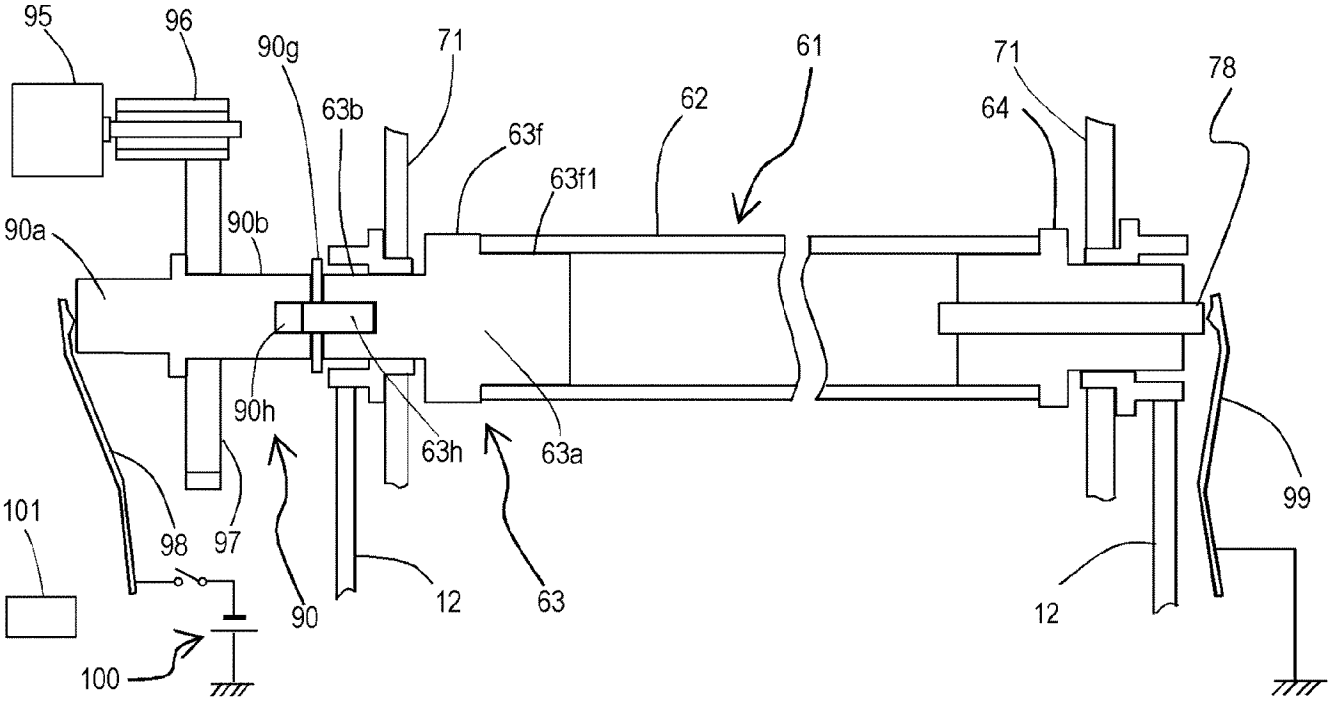
FIG. 15 is a schematic cross-sectional view depicting a driving force transfer mechanism according to Example 4 of the present invention.

As illustrated in FIG. 15, the driven coupling 63 (coupling unit) installed in the cartridge B is disposed at one edge of the drum 62 in the longer direction. The driven coupling 63 includes a coupling base 63*a*. On the drum coupling base 63*a*, a driving force transfer function portion 63*b* (diameter: 16 mm) and a drum flange function portion 63*f* are integrated. On the front end surface of the driving force transfer function portion 63*b*, the driving force transfer surface (second electrode) 63*c*, which is the driving force transfer function portion of which surface contacts with that of the driving coupling 90 disposed in the apparatus main body A, is disposed as a plane extending in the direction perpendicular to the rotation axis lines of the drum 62 and the driven coupling 63.

On the front end of the driving force transfer function portion 63*b*, a driven engaging portion 63*h*, which is a driving force transfer function portion that engages with the driving coupling 90, disposed in the apparatus main body A, is disposed. The driven engaging portion 63*h* has a spline shape constituted by 8 teeth, which extend in a direction opposite from the drum 62 on the rotation axis from the coupling base 63*a* to the drum 62, and has an aligning function surface 63*i* which is an aligning function portion (diameter: 5 mm) and a convex portion 63*j* (outer diameter: 7 mm). The driven engaging portion 63*h* is an engaging convex portion in which the driving engaging portion 90*h*, protruding in the rotation axis direction, is engaged. This engaging convex portion includes a shaft of which outer peripheral surface is the aligning function surface 63*i* which protrudes in the rotation axis direction, and convex portions 63*j*, which are engaging portions protruding from the outer surface of this shaft in the diameter direction. The convex portion 63*j* is disposed at 8 locations on the outer peripheral surface of the shaft in the circumferential direction at equal intervals, and each convex portion 63*j* protrudes out from the outer peripheral surface of the shaft in the diameter direction at a 1 mm height. Each convex portion 63*j* includes an engaging surface (second engaging surface) 63*j* 1 which intersects with the surface perpendicular to the rotation axis line of the driven coupling 63.

(Driving Force Transfer Coupling Connecting Function)

The driving force transfer coupling connecting function, when the cartridge B is attached to the apparatus main body A, will be described, with reference to FIG. 11 to FIG. 19.

Figure 18:
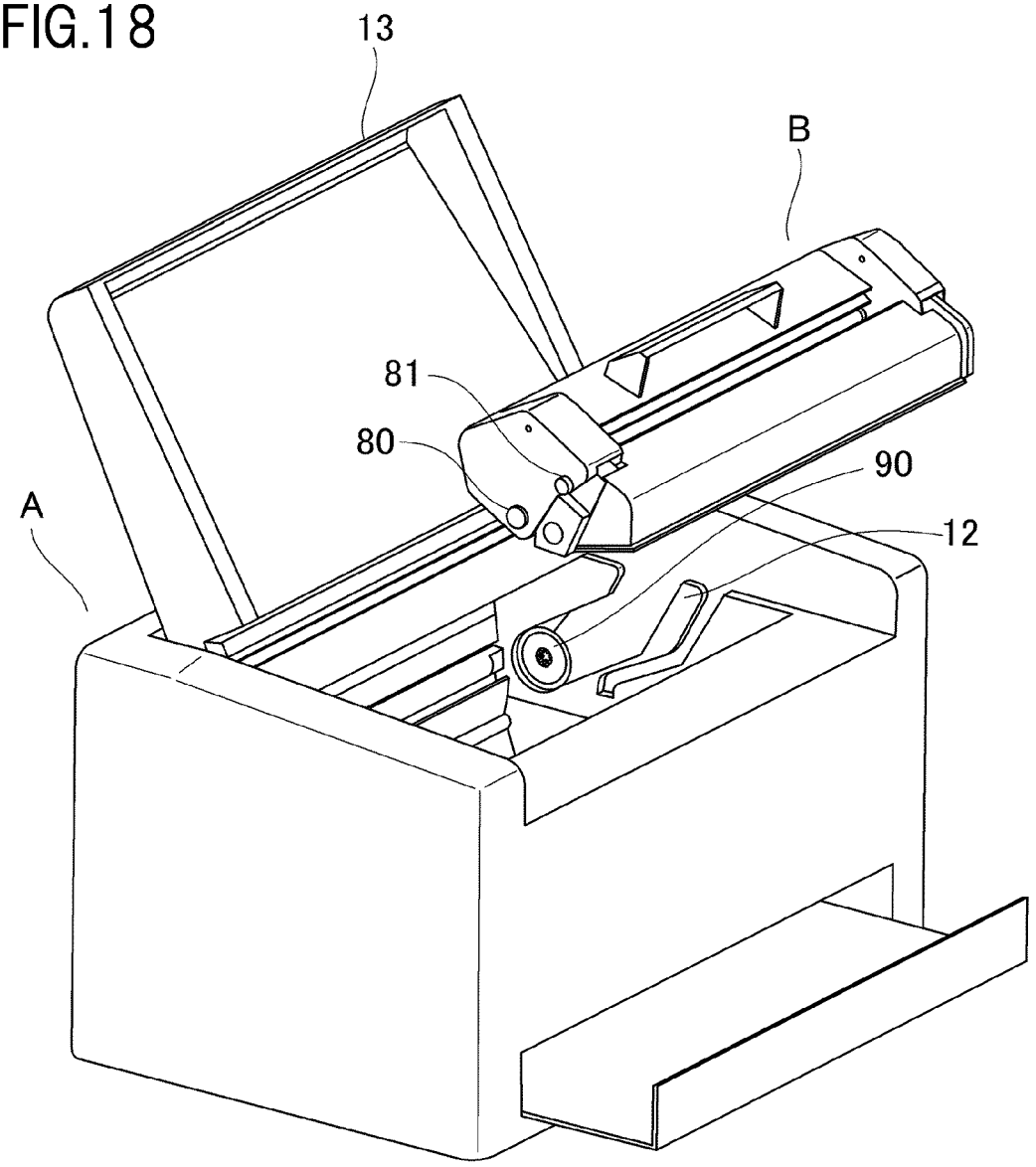
FIG. 18 is a schematic perspective view depicting a state of attaching/detaching the process cartridge to/from the apparatus main body according to Example 4 of the present invention.

Because of the above mentioned configuration, when the door 13 of the apparatus main body A is opened, the driving coupling 90, disposed in the apparatus main body A, moves away from the cartridge B in the rotation axis direction, as illustrated in FIG. 18.

Then the cartridge B is attached to the apparatus main body A. When the door 13 is closed, the driving coupling 90, which moves to the retracted position, rotates toward the cartridge B. By this rotation of the driving coupling 90, the phases of the spline shapes of the driving engaging portion 90*h* of the driving coupling 90 and the driven engaging portion 63*h* of the cartridge B match, and the driving coupling 90 further moves toward the driven coupling 63. Then the aligning function surface 90*i* of the driving engaging portion 90*h* and the aligning function surface 63*i* of the driven engaging portion 63*h* interfit with each other, and each concave portion 90*j* of the driving engaging portion 90*h* and each convex portion 63*j* of the driven engaging portion 63*h* engages with each other. Each concave portion 90*j* has an engaging surface (first engaging surface) 90*j* 1 which intersects with the surface perpendicular to the rotation axis line of the driving coupling 90. Then the driving force transfer surface 90*c* and the driving force transfer surface 63*c* contact with each other. At this time, the aligning function surface 63*i* of the driven engaging portion 63*h* interfits with the aligning function surface 90*i* of the driving coupling 90, whereby the rotation center of the drum 62, with respect to the driving coupling 90, is determined, and each convex portion 63*j* engages with each concave portion 90*j*, so as to function as the driving force transfer function portion. Here the state of each convex portion 63*j* of the driven engaging portion 63*h* engaging with each concave portion 90*j* of the driving coupling 90 is a state in which the driving force can be transferred from the coupling 90 to the driven coupling 63 by the contact of the surfaces (engaging surfaces 90*j* 1 and 63*j* 1) intersecting the surface perpendicular to the rotation axes (rotation axis lines) of the drum 62 and the driven coupling 63. The driving force transfer surface 90*c* is a surface perpendicular to the rotation axis line of the driving coupling 90.

(Driving Transfer Function of Coupling)

The driving transfer function of the driving force transfer coupling during the print operation will be described with reference to FIG. 15 and FIG. 17 to FIG. 19.

When the cartridge B is attached to the apparatus main body A, the driving engaging portion 93*h* of the driving coupling 90 and the driven engaging portion 63*h* of the driven coupling 63 are engaged as the driving force transfer function portion by closing the door 13, as illustrated in FIG. 1. Based on the print start signal, the motor 95, disposed in the apparatus main body A, is driven, and the large gear 97 is driven via the small gear 96. Interlocking with the driving of the large gear 97, the driving coupling 90, which is integrated with the large gear 97, is driven. Then when the driving coupling 90 rotates, the driven coupling 63 rotates as the driving force transfer function portion, because of the engagement (contact) between the engaging surface 90*j* 1 of each concave portion 90*j* of the driving coupling 90 and the engaging surface 63*j* 1 of each convex portion 63*j* of the driven coupling 63 constituting the driving force transfer function portion, and the driving force is transferred to the photosensitive drum 62. In actual experiment, when the driving engaging portion 93*h* of the driving coupling 90 and the driven engaging portion 63*h* of the driven coupling 63 engage, about a 1.6 kgfcm of driving transfer torque was acquired.

At this time, the controller 101, disposed in the apparatus main body A, applies a −1 kV voltage from the high voltage power supply 100 to the driving force transfer coupling via the feeding contact 98.

Thereby the current flows to the ground in the following sequence: coupling base 90*a*→electrostatic adsorption function portion 90*g* (dielectric layer)→driving force transfer surface 90*c*→driving force transfer surface 63*c*→coupling base 63*a*→conducting portion on inner surface of photosensitive drum 62→flange 64→drum shaft 78→earth contact 99.

According to the above mentioned mechanism of generating the Johnsen-Rahbek force, this current flow generates the following phenomena. In other words, the charges applied to the coupling base 90*a*, which is an electrode (electrode on one side), move to the driving force transfer surface 90*c*, which is the surface of the electrostatic adsorption function portion 90*g* (outermost surface of the dielectric layer) via the electrostatic adsorption function portion 90*g* (dielectric layer (dielectric body)). Because of these charges, the driving force transfer surface 63*c* of the driven coupling 63, which is the adsorbed target (electrode on the other side), is charged by electrostatic induction or dielectric polarization. As a result, the electrostatic adsorption force is generated between the driving force transfer surface 90*c* and the driving force transfer surface 63*c*. Then the motor 95, disposed in the apparatus main body A, is driven, and the large gear 97 is driven via the small gear 96. By this operation, the electrostatic adsorption force is converted into friction force between the driving force transfer surface 90*c* and the driving force transfer surface 63*c*, whereby the driven coupling 63 rotates as the driving coupling 90 rotates, and the drum 62 is driven.

<Advantages of this Example>

In Example 4, concave/convex engaging portion is formed by the driven engaging portion 63*h*, which is consists of convex portions formed in the driven coupling 63 (coupling member on one side) and the driving engaging portion 90*h*, which is constituted by the concave portions formed in the driving coupling 90 (coupling member on the other side). By this concave/convex engaging portion, the driven engaging portion 63*h* and the driving engaging portion 90*h* engage with each other in the rotating direction, so as to suppress the relative shift of the driven coupling 63 and the driving coupling 90 in the rotating direction of the driving coupling 90. On the other hand, by applying voltage to the driving coupling 90, the electrostatic adsorption function portion 90*g* and the driven coupling 63, the driven coupling 63 and the driving coupling 90 are electrostatically adsorbed to each other via the electrostatic adsorption function portion 90*g*, so as to suppress the above mentioned relative shift. By using the connection based on the electrostatic adsorption force, in addition to this mechanical connection based on the concave/convex engaging portion, the driving force can be stably transferred from the driving coupling 90 to the driven coupling 63 without causing looseness. In other words, in the case of the above mentioned configuration of the driving engaging portion 90*h* and the driven engaging portion 63*h*, a gap must be created between the engaging portions because of the dimensional error generated during manufacture. This gap may cause looseness in the rotating direction, and affect the driving transfer performance of the driven portions (e.g. photosensitive drum). In Example 4, the driving force transfer surface 90*c* and the driving force transfer surface 63*c* are connected as the driving force transfer function portions by the friction force using the electrostatic adsorption force, hence the above mentioned looseness between the driving engaging portion 90*h* and the driven engaging portion 63*h* in the rotating direction can be prevented. Further, Example 4 has two types of driving transfer portions: the driving transfer portion using engagement; and the driving transfer portion using friction force of the electrostatic adsorption force, whereby a larger driving force can be transferred from the apparatus main body A to the cartridge B. Therefore the driving force can be transferred from the driving coupling 90 of the apparatus main body A to the photosensitive drum 62 connected to the driven coupling 63 of the cartridge B without causing looseness in the rotating direction. By the configuration and functions described above, the driving coupling without looseness can be implemented.

Further, the driven engaging portion 63*h*, having convex portions of the concave/convex engaging portion is constituted by: the shaft which protrudes in the rotation axis direction; and the convex portions 63*j* (engaging portions) which protrude from the outer peripheral surface of the shaft in the diameter direction perpendicular to the rotation axis direction. The driving engaging portion 90*h*, having the concave portions of the concave/convex engaging portion, is constituted by: the hole which is recessed in the rotation axis direction and to which the shaft is interfitted; and the concave portions 90*j* (engaged portions) which are recessed from the inner peripheral surface of the hole in the diameter direction, and also recessed in the rotation axis direction, and in which the convex portions 63*j* are interfitted. When the cartridge B is attached, the driving coupling 90 and the driven coupling 63 approach each other in the rotation axis direction, and the aligning function surface 63*i* (outer peripheral surface of the shaft of the driven engaging portion 63*h*) and the aligning function surface 90*i* (inner peripheral surface of the hole of the driving engaging portion 90*h*) contact and slide with each other. Thereby the rotation center axis of the driving coupling 90 and the rotation center axis of the driven coupling 63 are aligned, that is, the aligning function can be implemented. At the same time, the convex portions 63*j* (engaging portion of the driven engaging portion 63*h*) interfit with the concave portions 90*j* by the chamfered edge of each convex portion, sliding along the corner of each concave portion 90*j*. Thereby the function to adjust the rotation phases between the driving coupling 90 and the driven coupling 63 is implemented. As a result, each convex portion 63*j* and each concave portion 90*j* are disposed at a matching position in the rotation axis direction, and engage with each other in the circumferential direction, whereby the relative shift between the driving coupling 90 and the driven coupling 63 in the rotating direction can be suppressed.

In Example 4, the engaging configuration and the aligning configuration (aligning function portion to determine the rotation center) of the driving coupling 90 and the driven coupling 63, using the driven engaging portion 63*h* and the driving engaging portion 90*h*, are disposed at the center portion of the circular electrostatic adsorption joining surfaces, that is, a region near the rotation axis. The transfer of the rotary driving force in the circular joining surfaces perpendicular to the rotation axis line without loss is equivalent to a feature where the joining surfaces do not deviate from each other in the circumferential direction, that is, the relative shift between the driving coupling 90 and the driven coupling 63 in the rotating direction are to be suppressed. In order to suppress the shift of the joining surfaces in the circumferential direction, the adsorption force in the region on the outer periphery side, which is distant from the rotation axis center and has a relatively large joining area, is critical. As Expression (1) shows, the transferable torque T is determined by integrating the product of the position in the radius direction r and the electrostatic adsorption force P(r) at this position. In other words, the electrostatic adsorption force on the outer side of the radius direction (r is larger) of the electrostatic adsorption function portion contributes more so to the transferable torque than the inner side in the radius direction (r is smaller) thereof. Therefore if sufficient adsorption force can be ensured in the region on the outer peripheral side, the rotary driving force can be transferred without loss, even if the adsorption force is not applied in the region around the rotation axis center. In this example, the electrostatic adsorption joining surfaces of the driving coupling 90, the driven coupling 63 and the electrostatic adsorption function portion 90*g* are ring-shaped surfaces having an inner diameter and outer diameter, and the concave/convex engaging portion, constituted by the driven engaging portion 63*h* and the driving engaging portion 90*h*, is disposed at the rotation center portion on the inner side of the joining surfaces. Further, the driven engaging portion 63*h* is separated from the driven coupling 63 and is fixed by inserting it into the interfitting hole which is in the driven coupling 63, is recessed in the rotation axis direction, and is constituted by an insulating material. Furthermore, the outer diameter of the electrostatic adsorption function portion 90*g* is extended from the joining region (joining surface) with each coupling on the outer diameter side respectively. In other words, the outer diameter of the surface of the electrostatic adsorption function portion 90*g* facing each coupling is larger than the outer diameter of the joining region (joining surface) with each coupling. Thereby the driving coupling 90 and the driven coupling 63 are accurately aligned, and the electrostatic adsorption force is stably generated without leakage, and as a result, the driving force can be transferred without loss.

Here in this example, the electrostatic adsorption function portion 90*g* (dielectric layer) is disposed in the driving coupling 90, but may be disposed in the driven coupling 63. The electrostatic adsorption function portion (dielectric layer) may be disposed in both the driving coupling 90 and the driven coupling 63.

Further in Example 4, the process cartridge in which the cleaning unit and the developing unit are integrated was described, but the configuration of the cartridge, which is detachable from the apparatus main body, is not limited to the configuration described in this example. Needless to say, the present invention can be applied to a configuration in which the cleaning unit and the developing unit are independent units as the cleaning cartridge (drum cartridge) and the developing cartridge respectively.

In this example, when the door 13 is closed, the driving coupling 90 of the apparatus main body A rotates toward the driven coupling 63 disposed in the cartridge B, and the couplings are engaged with each other, but the present invention is not limited to this configuration. For example, a large gear 97 rotates toward the process cartridge B, interlocking with the driving of the motor 95 of the apparatus main body A, because of the function of the small gear 96 and the helical gear configured in the large gear 97, whereby the driving coupling 90 and the driven coupling 63 are engaged.

In Example 4, the driving force transfer function portion is constituted by the driving engaging portion 90*h* of the apparatus main body A which has concave portions, and the driven engaging portion 63*h* of the cartridge B which has convex portions, but the present invention is not limited to this configuration. For example, the driving engaging portion 90*h* of the apparatus main body A may have insulating convex portions, and the driven engaging portion 63*h* of the cartridge B may have conducting concave portions.

(Modification 2)

According to Modification 2, the electrostatic adsorption of the driving force transfer surface 63*c* and the driving coupling 90 of Example 4 is changed to magnetic adsorption. In concrete terms, the driving force transfer surface 63*c* of Example 4 becomes the surface of the magnet portion, and the driving force transfer surface 90*c* thereof becomes the surface of the magnetic body portion. The same effect as Example 4 can be acquired even if this configuration is used.

Example 5

Figure 21:
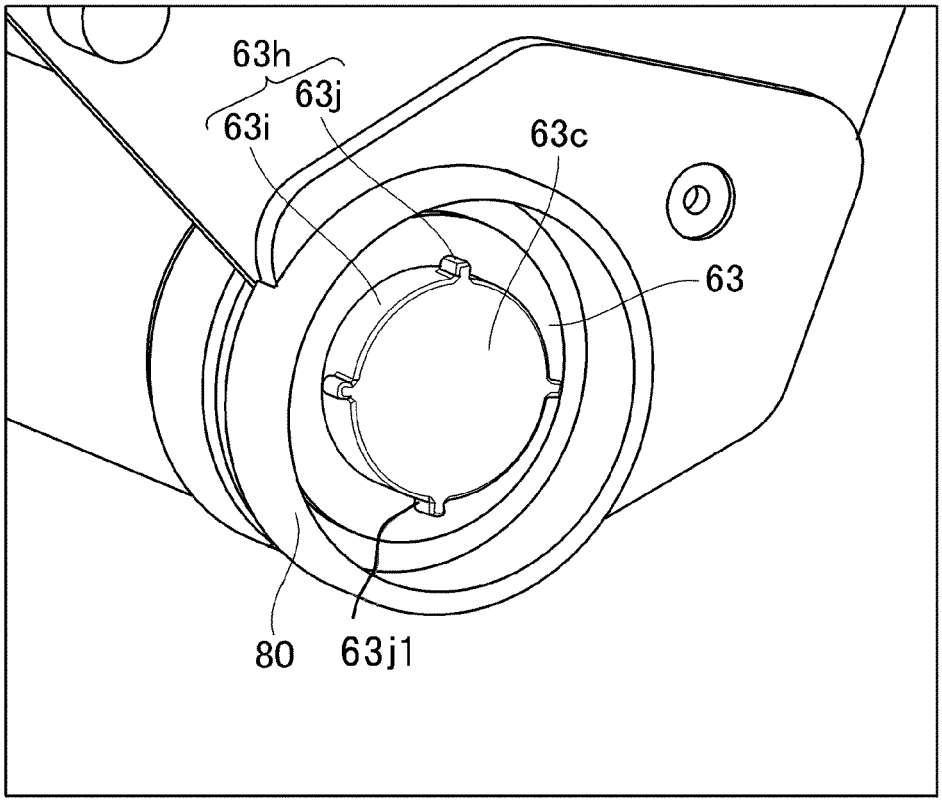
FIG. 21 is a schematic cross-sectional view depicting a driving force transfer mechanism according to Example 5 of the present invention.
Figure 22:
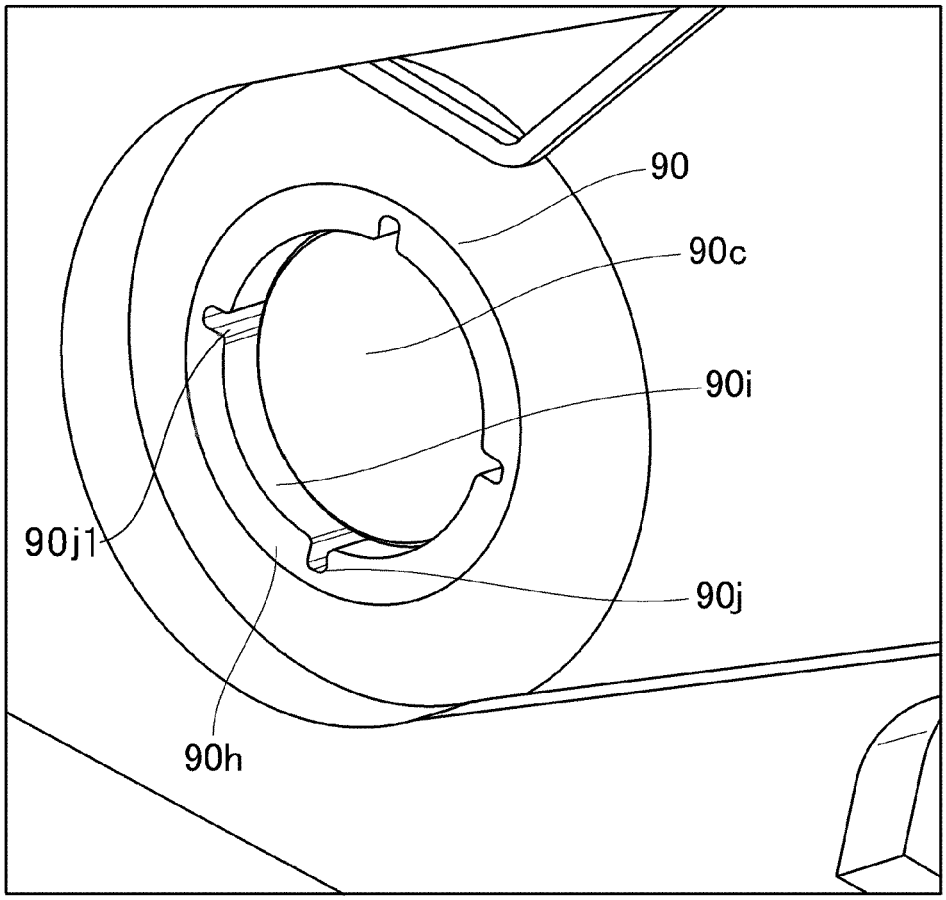
FIG. 22 is a schematic cross-sectional view depicting the driving force transfer mechanism according to Example 5 of the present invention.

Example 5 will be described with reference to FIG. 21 and FIG. 22. In Example 4, as the driving force transfer function portion, the driving engaging portion 90*h* of the apparatus main body A and the driven engaging portion 63*h* of the cartridge B are disposed near the center portion of the couplings respectively, but the present invention is not limited to this configuration. In other words, in Example 5, the concave/convex engaging portion, constituted by the driving engaging portion 90*h* and the driven engaging portion 63*h*, is disposed near the rotation axis in the region where the driving coupling 90 and the coupling 63 face each other, and the connecting portion, by the electrostatic adsorption force, is disposed in the outer peripheral region surrounding the concave/convex engaging portion. However as illustrated in FIG. 21 and FIG. 22, the mechanical connection portion of the concave/convex engaging portion and the connecting portion, using the electrostatic adsorption force, may be disposed in reverse. In other words, a concave portion, which is recessed in the rotation axis direction, is disposed in the rotation center portion of the region of the driving coupling 90 facing the driven coupling 63, and the bottom face of this concave portion becomes a circular electrostatic adsorption surface 90*c*, and the driving engaging portion 90*h*, which constituted the concave/convex engaging portion, is disposed on the outer periphery of this concave portion. The driving engaging portion 90*h* is constituted by an insulating member, which is a separate member from the driving coupling 90. On the other hand, a convex portion, which protrudes in the rotation axis direction, is disposed in the rotation center portion of the region of the driven coupling 63 facing the driving coupling 90, and a circular electrostatic adsorption surface 63*c* is formed on the front end of this convex portion by adhering and fixing the electrostatic adsorption function portion (dielectric body). Then the driven engaging portion 63*h*, which constitutes the concave/convex engaging portion, is disposed on the outer periphery of this convex portion. The driven engaging portion 63*h* is integrated with the coupling base 63*a* of the driven coupling 63. The couplings may be connected with each other by engaging the driving engaging portion 90*h* and the driven engaging portion 63*h*. By this configuration as well, similarly to the above mentioned examples, the concave portion 90*j* and the convex portion 63*j* are engaged when the aligning function surface 90*i* of the driving engaging portion 90*h* and the aligning function surface 63*i* of the driven engaging portion 63*h* interfit with each other, whereby the engaging surfaces 90*j* 1 and 63*j* 1 contact with each other. Then the driving force transfer surface 90*c* and the driving force transfer surface 63*c* contact with each other.

(Other)

The present invention can be effectively applied to an apparatus configuration which uses a cleanerless process where the cleaner blade is not used. The present invention is also applicable to the driving coupling of the developing unit. Further, the present invention is also applicable to the multicolor image forming process. The function, materials and shapes of the components and the relative positions thereof described in Example 5 are not intended to limit the scope of the present invention unless otherwise specified.

(Modification 3)

According to Modification 3, the electrostatic adsorption of the driving force transfer surface 63*c* and the driving coupling 90 of Example 5 is changed to magnetic adsorption. In concrete terms, the driving force transfer surface 63*c* of Example 5 becomes the surface of the magnet portion, and the driving force transfer surface 90*c* thereof becomes the surface of the magnetic body portion. The same effect as Example 5 can be acquired even if this configuration is used.

Example 6

Example 6 will be described with reference to FIG. 23 to FIG. 29.

<Overview of Driving Force Transfer Coupling>

Figure 23:
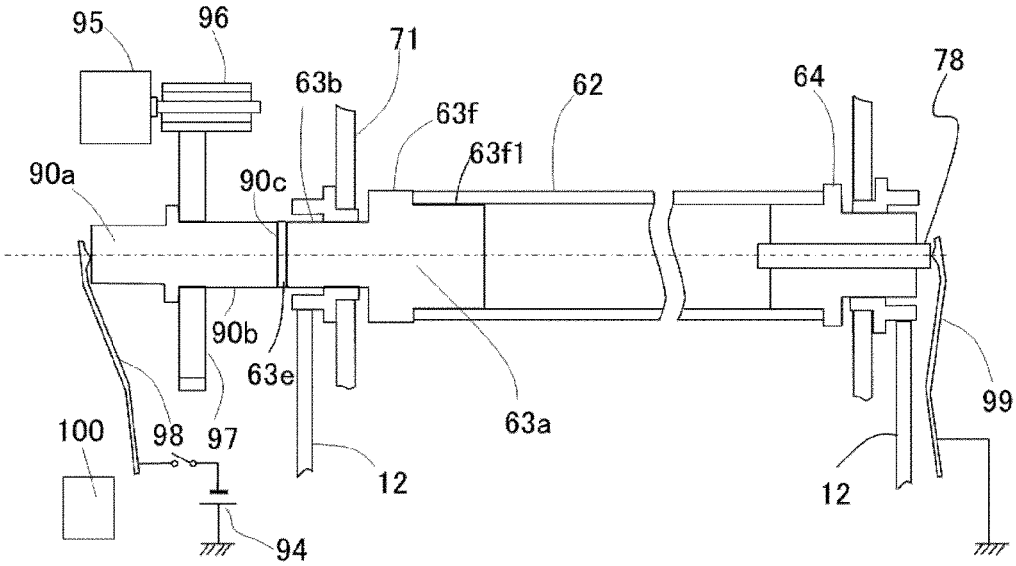
FIG. 23 is a cross-sectional view depicting a coupling, a photosensitive drum, and a driving device according to Example 6 of the present invention.
Figure 24:
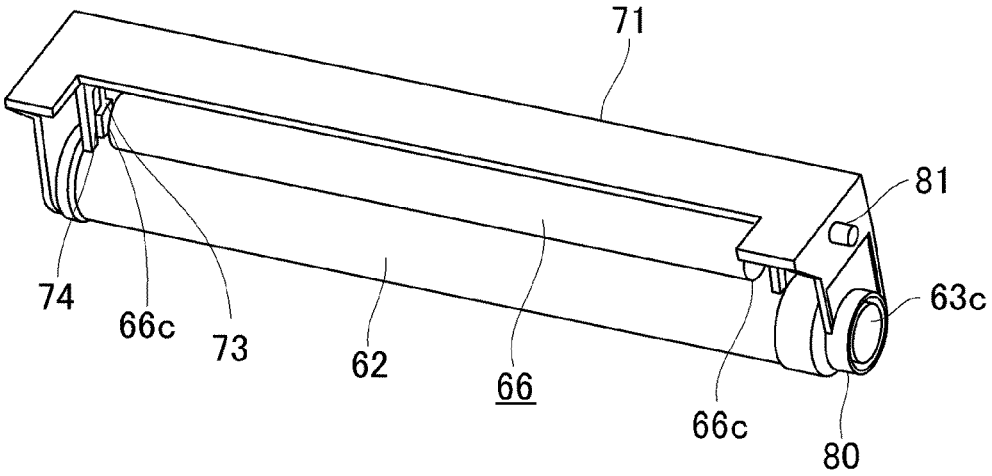
FIG. 24 is a perspective view depicting a cleaner unit according to Example 6 of the present invention.
Figure 25:
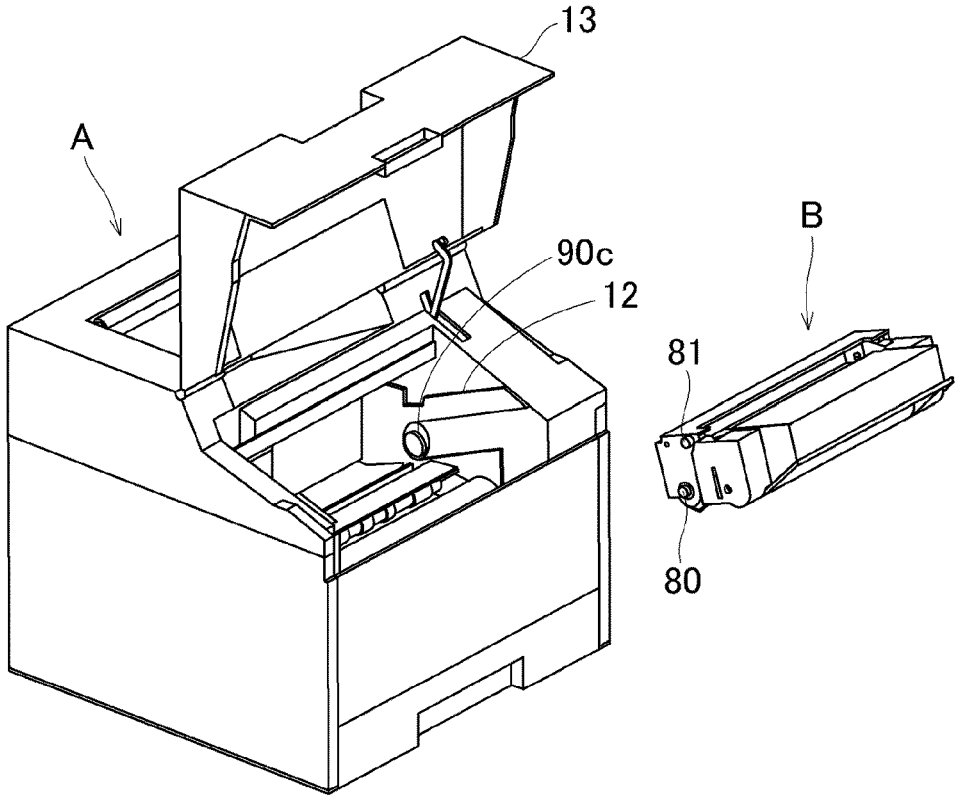
FIG. 25 is a perspective view of an apparatus main body and a process cartridge according to Example 6 of the present invention.

A configuration of a driving force transfer coupling according to Example 6 will be described in detail with reference to FIG. 23. The driving force transfer coupling of the present invention is constituted by the driving coupling 90 disposed in the apparatus main body A, and the driven coupling 63 disposed in the cartridge B. The configuration of the driven coupling 63 disposed in the cartridge B will be described first. As illustrated in FIG. 23, the driven coupling 63 (coupling unit) is disposed on one edge of the photosensitive drum 62, which is installed in the cartridge B, in the longer direction. This driven coupling 63 includes the coupling base 63*a*. The driving force transfer function portion 63*b*, (diameter: 16 mm) and the drum flange function portion 63*f* are integrated on the coupling base 63*a*. On the front end surface of the driving force transfer function portion 63*b*, that is, on the region where the driving coupling 90 and the driven coupling 63 face each other, an electrostatic adsorption function portion 63*e* (dielectric body) to adsorb the end faces of the couplings to each other, is fixed. For this fixing, a conductive double-sided tape (not illustrated) is used, but an appropriate adhesion method may be selected in accordance with the required adhesion strength. Here the surface roughness (center line average roughness) of the electrostatic adsorption function portion 63*e* is set to Ra=0.2 μm. The surface roughness Ra of the coupling member and the later mentioned dielectric body can be determined based on the center line average surface roughness that is measured using a surface roughness measuring instrument, as stated in the JIS Surface Roughness Standard "JIS B 0601 (2001)", for example.

In the drum flange function portion 63*f*, an interfitting portion 63*f* 1 is disposed at the opposite side of the driving force transfer function portion 63*b* in the axis direction of the photosensitive drum 62. When the drum flange function portion 63*f* is installed in the photosensitive drum 62, the interfitting portion 63*f* 1 is interfitted and crimped in the inner surface of the photosensitive drum 62, so as to fix the drum flange function portion 63*f* and the photosensitive drum 62. The method of fixing the drum flange function portion 63*f* is not limited to crimping, but may be by adhesion or the like.

The material of each component will be described next. The material of the coupling base 63*a* here is aluminum having conductivity. However, the material of the coupling base 63*a* is not limited to aluminum, but may be any material having conductivity, such as metal (e.g. iron, copper), conductive ceramic, and conductive resin which is normally used for process cartridges. In concrete terms, a molded product generated by adding the conducting agent to polyacetal, polyester, epoxy resin or the like may be used. A guideline is that the volume resistivity of the coupling base 63*a* becomes $1\times10^{10}$ Ωcm or less.

The material of the electrostatic adsorption function portion 63*e* used here is intermediate resistance polyimide, which functions as a dielectric body. The intermediate resistance polyimide is manufacturing by dispersing carbon black for adjusting resistivity in a polyimide liquid varnish, pouring this liquid varnish into a mold, and removing the solvent by heating. The volume resistivity and thickness of the electrostatic adsorption function portion 90*e* will be described later. The material of the electrostatic adsorption function portion 63*e* is not especially limited, but may be polyacetal, polyvinylidene fluoride, urethane rubber or the like, and the conducting agent, to adjust the volume resistivity, can also be appropriately selected, such as an electronic conducting agent and an ion conducting agent. The electronic conducting agents that can be used include: carbon black or graphite having electronic conductivity; oxide (e.g. tin oxide); metal (e.g. copper, silver); and conductive particles generated by coating oxide or metal on the particle surface to create conductivity. The ion conducting agent is an ion conducting agent having ion exchange properties, such as quaternary ammonium salt or sulfonic acid salt, which exhibits ion conductivity. The dielectric body in the present invention refers to a substance where the current does not flow easily, and which generates dielectric polarization when an electric field is applied, and includes a substance which has a resistance component and a dielectric component in the electrogenesis mechanism, such as an insulator containing conductive particles. Here the volume resistivity of the electrostatic adsorption function portion 63*e* mentioned above is measured at a 1 kV applied voltage using the Mitsubishi Chemical Analytech Hiresta Co., Ltd. UP MCP-HT450 unit and a UR ring probe.

By selecting the above configuration and materials, the driven coupling 63 is electrically conducted with the photosensitive drum 62, and when the cartridge B is installed in the apparatus main body A, the cartridge B is electrically connected with the ground of the apparatus main body A via the drum shaft 78.

<Configuration of Electrostatic Adsorption Function Portion to Reduce Power Consumption>

Figure 26A:
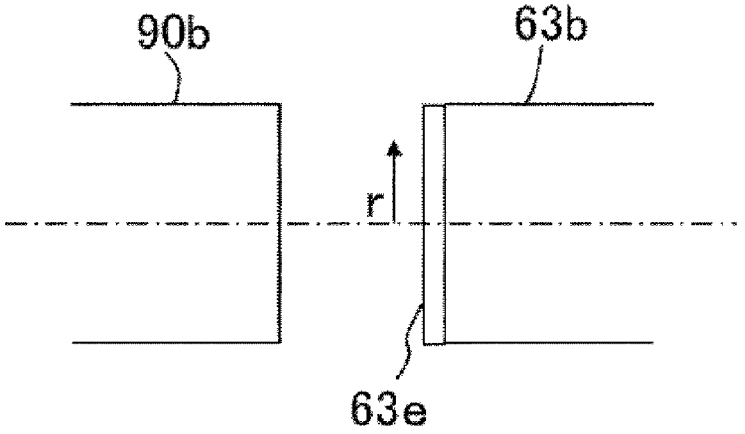
FIG. 26A shows a configuration of an electrostatic adsorption function portion according to Example 7 of the present invention when the volume resistivity and the thickness are constant.
Figure 26B:
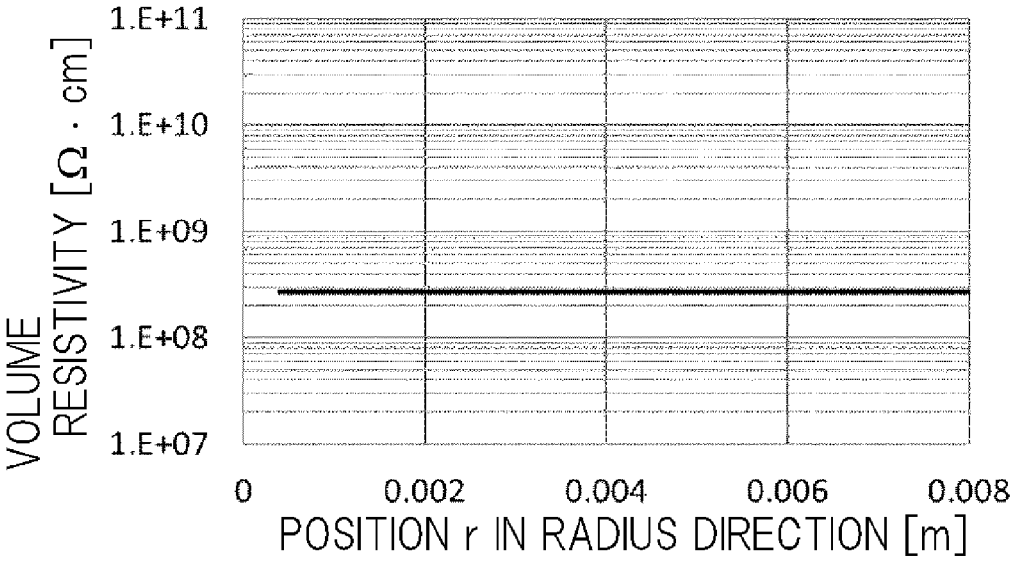
FIG. 26B is a graph depicting the distribution of the volume resistivity with respect to the position in the radius direction r of the electrostatic adsorption function portion according to Example 7 of the present invention when the volume resistivity and the thickness are constant.

A configuration of the electrostatic adsorption function portion 63*e* to reduce power consumption, which is the essence of the present invention, will be described in detail. First the electrostatic adsorption force, transferable torque and power consumption, when the electrostatic adsorption function portion 63*e* has no distribution in the volume resistivity and in thickness, will be described with reference to FIGS. 26A to 26D. FIG. 26A is a diagram depicting a state before the driving force transfer function portion 90*b* and the electrostatic adsorption function portion 63*e* are connected. In FIG. 26A, the position of the electrostatic adsorption function portion 63*e*, from the rotation center in the radius direction, is defined as r. FIG. 26B is a graph depicting the distribution of the volume resistivity with respect to the position in the radius direction r, but as mentioned above, the volume resistivity is constant in this example. The material of the electrostatic adsorption function portion 63*e* is the same material used in FIGS. 26A to 26D, of which volume resistivity is $1\times10^{11}$ Ωcm, but when the applied voltage is 400 V, this volume resistivity is converted into $2.8\times10^{8}$ Ωcm.

Figure 26C:
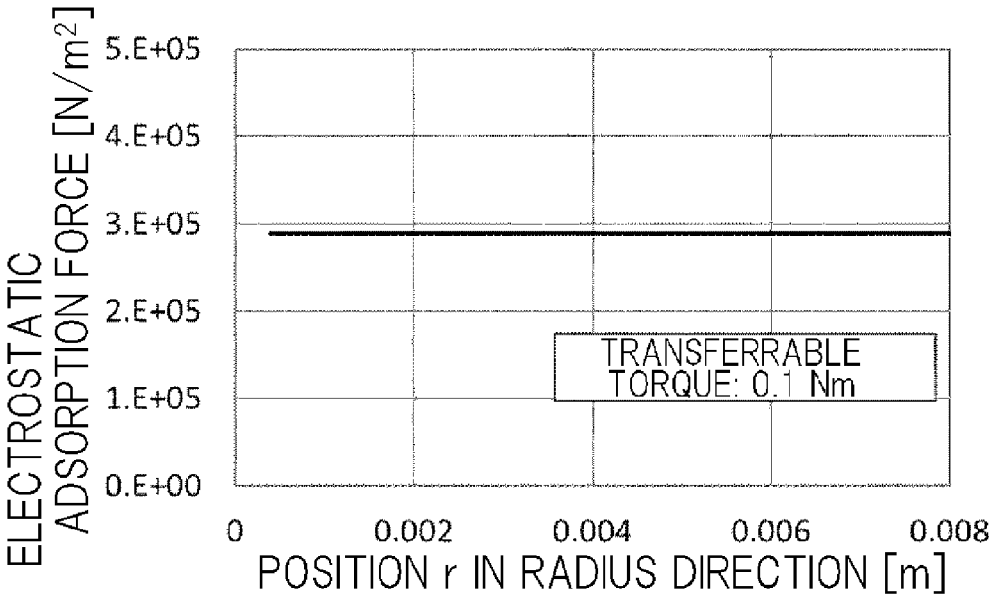
FIG. 26C is a graph depicting the distribution of the electrostatic adsorption force with respect to the position in the radius direction r of the electrostatic adsorption function portion according to Example 7 of the present invention when the volume resistivity and the thickness are constant.
Figure 26D:
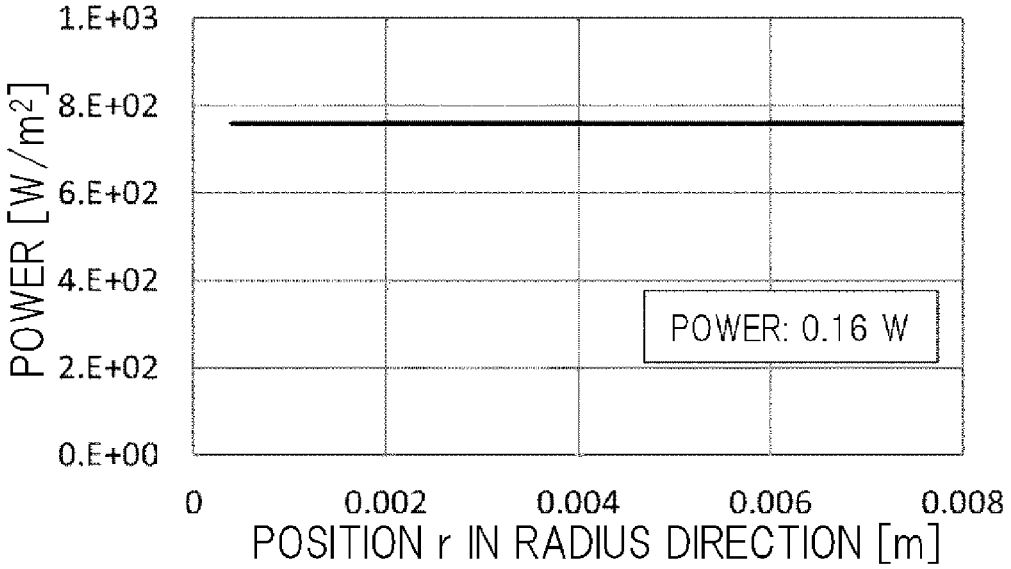
FIG. 26D is a graph depicting the distribution of the power consumption with respect to the position in the radius direction r of the electrostatic adsorption function portion according to Example 7 of the present invention when the volume resistivity and the thickness are constant.

When the volume resistivity of the electrostatic adsorption function portion 63*e* is set to be constant like this, the electrostatic adsorption force has no distribution, with respect to the position in the radius direction r and has a constant value, as shown in FIG. 26C. If this electrostatic adsorption force is substituted in Expression (2), the transferable torque is calculated as 0.1 Nm. Here in Expression (2), the diameter of the electrostatic adsorption function portion 63*e* is D=16 mm, and the friction coefficient is μ=0.3. Further, when the volume resistivity is constant, the power consumption has no distribution either, with respect to the position in the radius direction r, and has a constant value as shown in FIG. 26D. The total power consumption is calculated by integrating this power distribution, and in this case, the power consumption is 0.16 W. The power distribution in FIG. 26D shows the calculated values that are determined based on volume resistivity distribution in FIG. 26A, and the integrated value thereof, which is 0.16 W, matches with the actual measured value shown in FIGS. 26A to 26D. As described above, when the electrostatic adsorption function portion 63*e* has a constant volume resistivity and a constant thickness, the power consumption required for acquiring a 0.1 Nm transferable torque is 0.16 W.

Figure 27A:
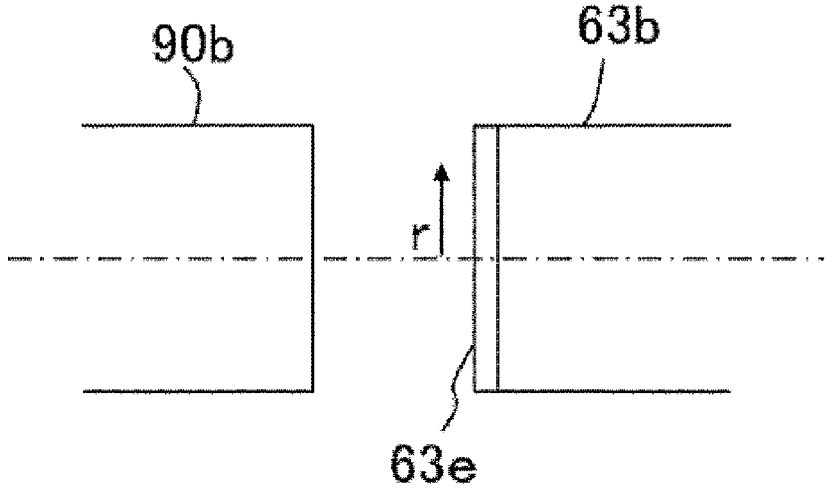
FIG. 27A shows a configuration of the electrostatic adsorption function unit according to Example 7 of the present invention when the volume resistivity is distributed.
Figure 27B:
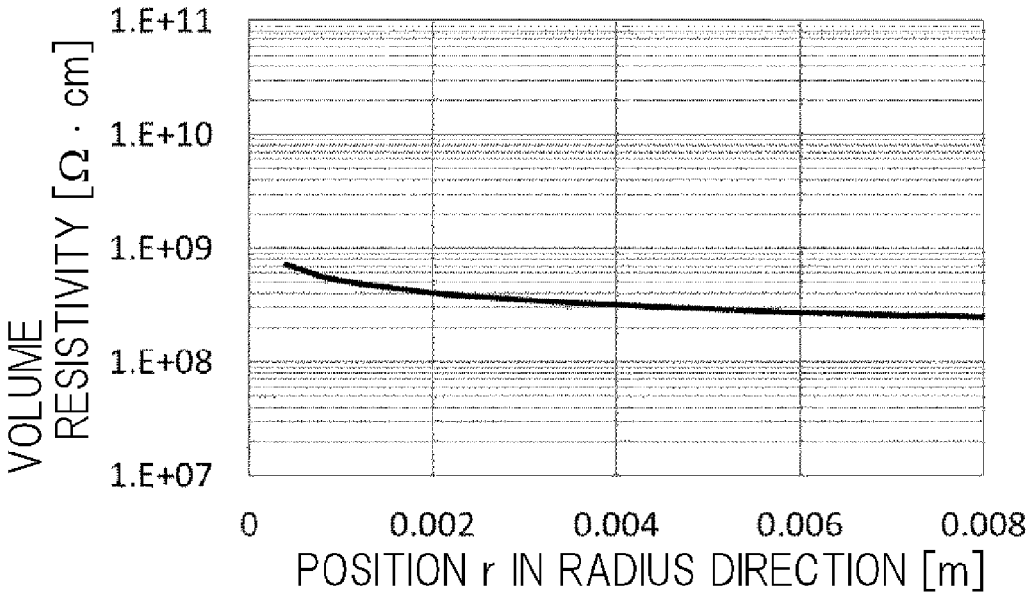
FIG. 27B is a graph depicting the distribution of the volume resistivity with respect to the position in the radius direction r of the electrostatic adsorption function unit according to Example 7 of the present invention unit when the volume resistivity is distributed.
Figure 27C:
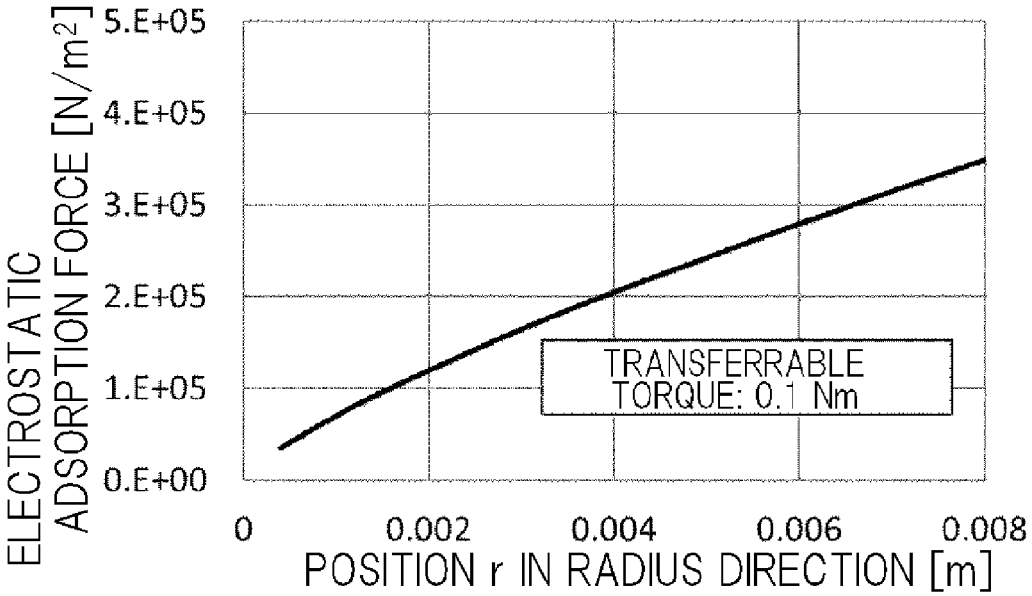
FIG. 27C is a graph depicting the distribution of the electrostatic adsorption force with respect to the position in the radius direction r of the electrostatic adsorption function portion according to Example 7 of the present invention when the volume resistivity is distributed.
Figure 27D:
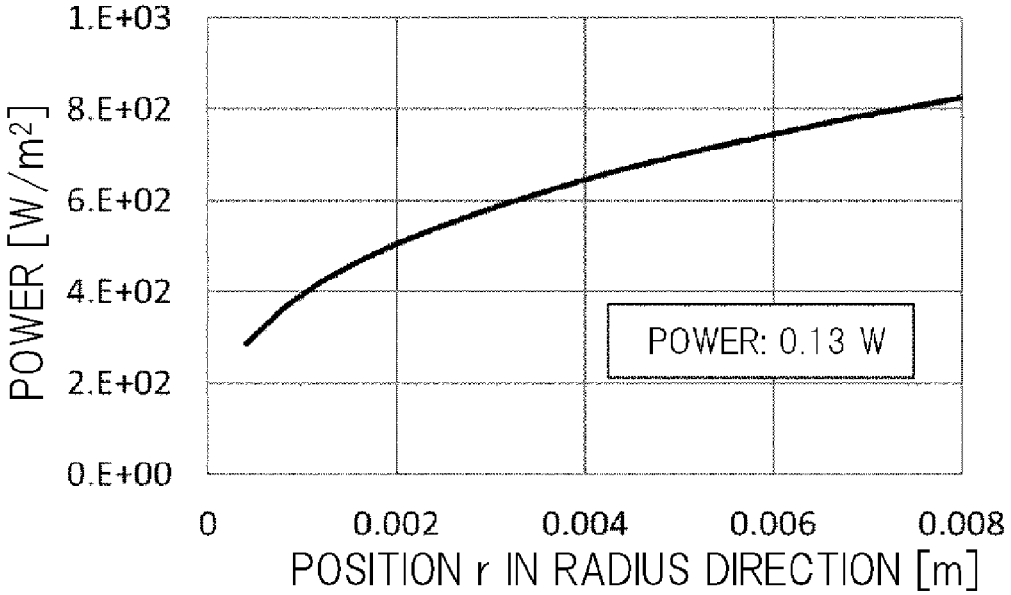
FIG. 27D is a graph depicting the distribution of the power consumption with respect to the position in the radius direction r of the electrostatic adsorption function portion according to Example 7 of the present invention when the volume resistivity is distributed.

Next, the power consumption, when the volume resistivity of the electrostatic adsorption function portion 63*e* has a distribution, according to Example 6, will be described with reference to FIGS. 27A to 27D. As shown in Expression (1), the transferable torque T is determined by the integration of the product of the position in the radius direction r and the electrostatic adsorption force P(r) at this position. Therefore the electrostatic adsorption force of the electrostatic adsorption function portion 63*e*, on the outer side in the radius direction (r is larger) (outer peripheral region), contributes more to the transferable torque than the inner side in the radius direction (r is smaller) (center region). Using this concept, the electrostatic adsorption force that is applied to the electrostatic adsorption function portion 63*e* on the outer side in the radius direction is set high, so as to decrease the overall power consumption. In concrete terms, particles of carbon black or the like, which are included in the intermediate resistance polyimide or the like constituting the electrostatic adsorption function portion 63*e*, to adjust resistance, are distributed so that the particle density increases as the region becomes more distant in the radius direction from the center region around the rotation axis center of the electrostatic adsorption function portion 63*e*. Thereby as the position in the radius direction r increases, the volume resistivity can be decreased even if the shape has not changed, as shown in FIG. 27B. By this configuration, the electrostatic adsorption force becomes higher as the position in the radius direction r increases, as shown in FIG. 27C. The transferable torque, which is calculated using Expression (1) based on the distribution of the electrostatic adsorption force shown in FIG. 27C, becomes 0.1 Nm, similarly to FIGS. 26A to 26D. Further, the power distribution, which is calculated based on the volume resistivity distribution in FIG. 27B, becomes like FIG. 27D. As shown in FIG. 27D, the power distribution also increases as position in the radius direction r increases. By integrating this power distribution, the overall power consumption is calculated, and in this case, the power consumption is 0.13 W.

Here FIG. 26A to FIG. 27D according to Example 6 are compared. When the volume resistivity is constant, as in FIGS. 26A to 26D, the power consumption is 0.16 W at transferable torque 0.1 Nm. When the volume resistivity is distributed without changing the shape and the electrostatic adsorption force is stronger in the outer side in the radius direction, as in FIGS. 27A to 27D, the power consumption is 0.13 W at transferable torque 0.1 Nm. In other words, the present invention can decrease the power consumption by 0.16−0.13=0.03 W, which means that the power consumption can be reduced 0.03/0.16≈19%.

Figure 28A:
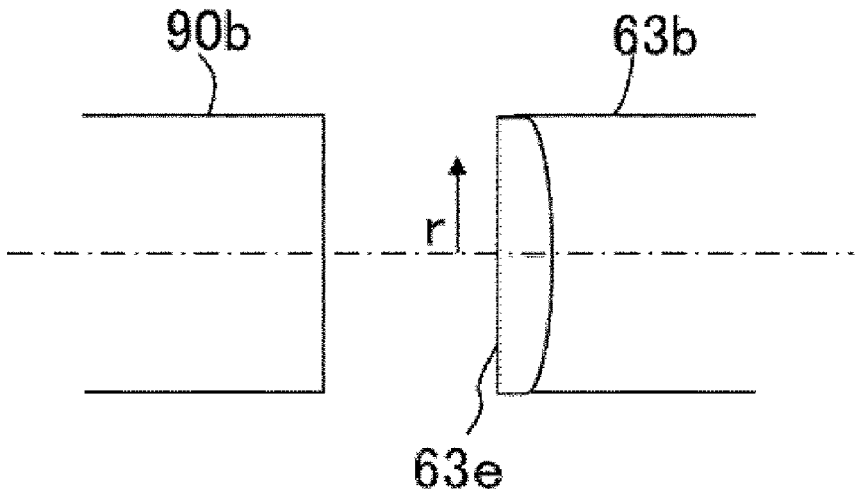
FIG. 28A shows a configuration of the electrostatic adsorption function portion according to Example 7 of the present invention when the thickness is distributed.
Figure 28B:
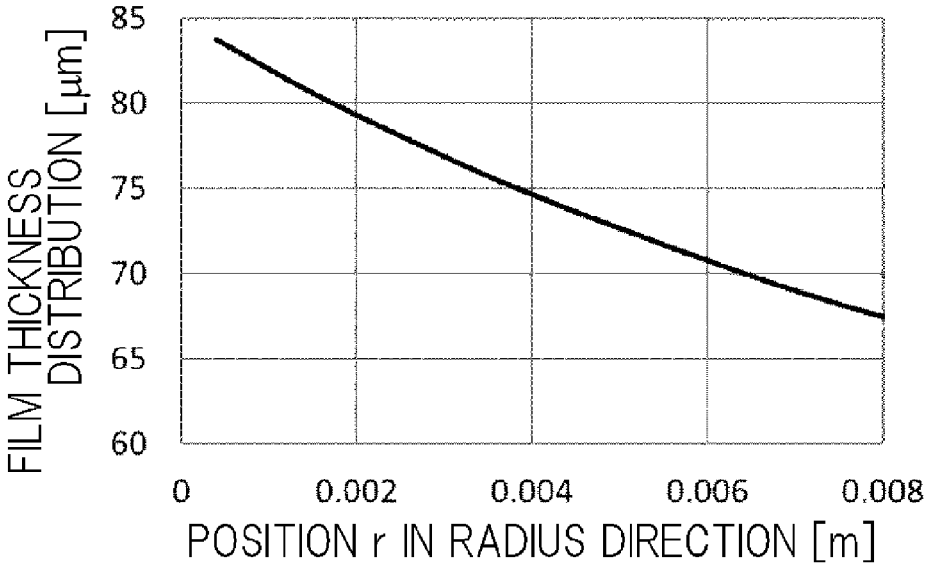
FIG. 28B is a graph depicting the distribution of the film thickness with respect to the position in the radius direction r of the electrostatic adsorption function portion according to Example 7 of the present invention when the thickness is distributed.
Figure 28C:
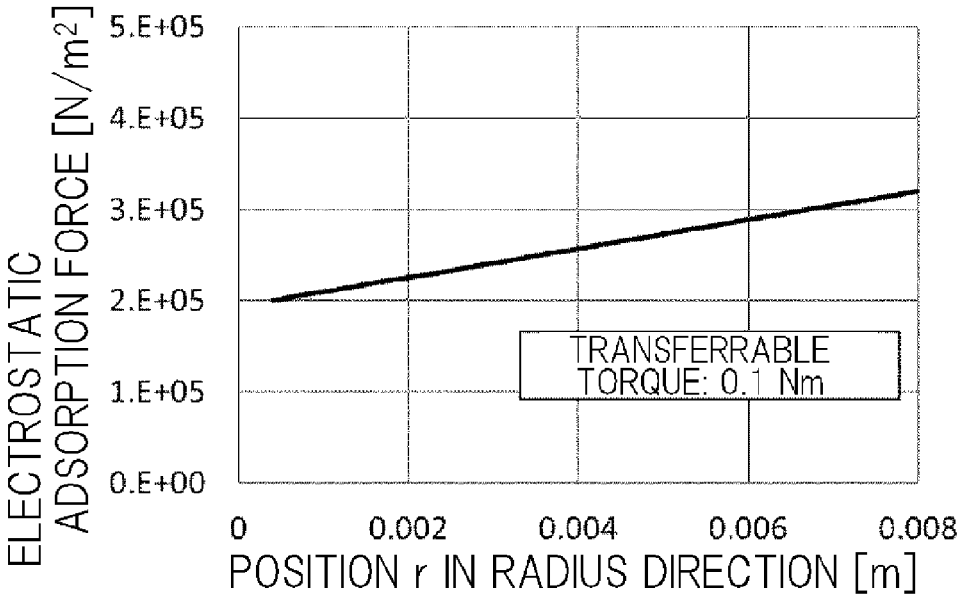
FIG. 28C is a graph depicting the distribution of the electrostatic adsorption force with respect to the position in the radius direction r of the electrostatic adsorption function portion according to Example 7 of the present invention when the thickness is distributed.
Figure 28D:
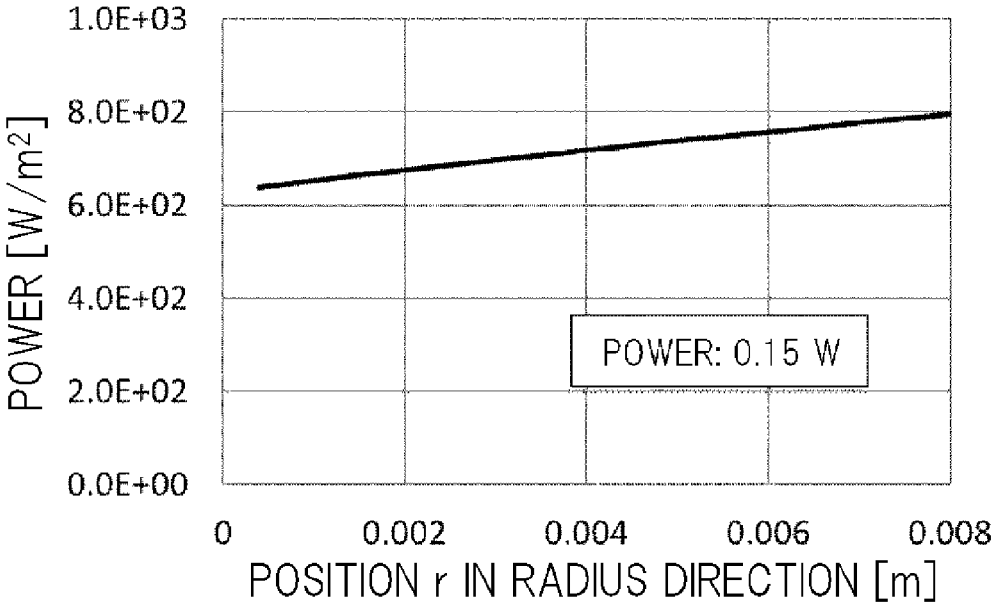
FIG. 28D is a graph depicting the distribution of the power consumption with respect to the position in the radius direction r of the electrostatic adsorption function portion according to Example 7 of the present invention when the thickness is distributed.

Next, another configuration to reduce the power consumption will be described with reference to FIGS. 28A to 28D. As illustrated in FIG. 28A, the thickness is distributed in order to increase the electrostatic adsorption force applied to the outer side of the electrostatic adsorption function portion 63*e* in the radius direction. In concrete terms, the thickness of the electrostatic adsorption function portion 63*e* is decreased as the position in the radius direction r increases, so that the electrostatic adsorption function portion 63*e* has a bowl shape when viewed in a direction perpendicular to the rotation axis direction, as shown in FIG. 28B. By this configuration, current does not flow easily around the center portion where the thickness in the rotation axis direction is large, because the resistance value (volume resistivity) increases, and current flows more easily as the position in the radius direction r increases, since the thickness decreases, and therefore the resistance value (volume resistivity) decreases. As shown in FIG. 28C, the electrostatic adsorption force increases at a position where the position in the radius direction r is large. The transferable torque, which is calculated using Expression (1) based on the distribution of the electrostatic adsorption force shown in FIG. 28C, becomes 0.1 Nm, similarly to FIGS. 26A to 26D. Further, the power distribution, which is calculated based on the volume resistivity distribution in FIG. 28B, becomes like FIG. 28D. As shown in FIG. 28D, the power distribution also increases as a position in the radius direction r increases. By integrating this power distribution, the overall power consumption is calculated, and in this case, the power consumption is 0.15 W. When the volume resistivity and the thickness of the electrostatic adsorption function portion has no distribution, the power consumption is 0.16 W, hence the power consumption reduction amount is 0.16−0.15=0.01 W, which means that the power consumption can be reduced 0.01/0.16≈6%.

As mentioned above, in this example, the intermediate resistance polyimide sheet is used for the electrostatic adsorption function portion 63*e*. The intermediate resistance polyimide sheet is manufactured by dispersing carbon black for adjusting resistance in a polyimide liquid varnish, pouring this liquid varnish into a mold, and removing the solvent by heating. To generate the distribution of thickness in the polyimide sheet, as shown in FIG. 28A, a mold, processed to be bowl-shaped, can be used.

Figure 29:
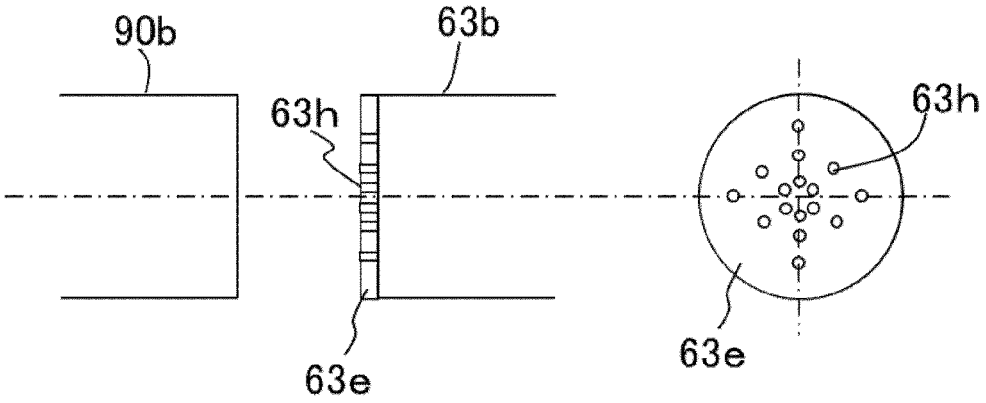
FIG. 29 is a diagram depicting the configuration of the electrostatic adsorption function portion according to Example 7 of the present invention when micro holes are added.

Another configuration to reduce power consumption will be described next with reference to FIG. 29. FIG. 29 is a diagram when micro holes 63*h* are added to the electrostatic adsorption function portion 63*e*. Here in order to increase the electrostatic adsorption force applied to the electrostatic adsorption function portion 63*e* on the outer side in the radius direction, the density of the micro holes 63*h* is higher in the center portion and lower in the outer side. In other words, a plurality of micro holes 63*h* are concentrated near the center around the rotation axis line of the electrostatic adsorption function portion 63*e*, and a number of micro holes 63*h* is decreased as the position is closer to the outer side in the radius direction. The electrostatic adsorption force increases in proportion to the contact area between the electrostatic adsorption function portion 63*e* and the driving transfer portion 90*b*, hence the contact area between the electrostatic adsorption function portion 63*e* and the driving transfer portion 90*b* increases on the outer area of the electrostatic adsorption portion 63*e* if the density of the micro holes 63*h* is less in the outer side than in the center portion. Further, air enters the area where micro holes exist. Air has high insulating properties, therefore the resistance value (volume resistivity) is higher in the center portion where micro holes concentrate, compared with the outer area in the radius direction, and the resistance value (volume resistivity) of the outer area in the radius direction is lower than the center area. As a result, the electrostatic adsorption force applied to the outer side of the electrostatic adsorption function portion 63*e* increases. The diameter of the micro hole 63*h* is preferably smaller than the film thickness of the electrostatic adsorption function portion 63*e*, and if the film thickness is 75 μm, for example, a guideline of the diameter of the micro hole 63*h* is about 10 to 50 μm.

To form micro holes 63*h* in the electrostatic adsorption function portion 63*e*, convex circular bosses are disposed when the polyimide sheet is molded, or holes may be formed by postprocessing, such as laser irradiation after the sheet is molded. In order to prevent discharge between the driving force transfer function portion 90*b* on the driving side and the driving force transfer function portion 63*b* on the non-driving side, the micro holes 63*h* may be half-punched, without penetrating through the electrostatic adsorption function portion 63*e*. In this case, it is preferable to set the electrostatic adsorption function portion 63*e* so that the concave surfaces of the micro holes 63*h* contact with the driving force transfer function portion 90*b* on the driving side. Further, the surface roughness of the electrostatic adsorption function portion 63*e* may be controlled instead of forming the micro holes 63*h*, whereby a similar power consumption reducing effect can be implemented. In concrete terms, the surface roughness at the center portion of the electrostatic adsorption function portion 63*e* is increased to about Ra=1 μm, and the surface roughness on the outer side thereof is decreased to about Ra=0.2 μm. Then the contact area between the electrostatic adsorption function portion 63*e* and the driving force transfer function portion 90*b* becomes smaller in the outer side of the electrostatic adsorption function portion 63*e*, and as a result, the electrostatic adsorption force increases in the outer side of the electrostatic adsorption function portion 63*e*, and the overall power consumption can be reduced. The amount of reduction, which is the same as FIG. 28, is omitted here.

By the configuration and functions described above, when the driving coupling 90 and the driven coupling 63 are connected, sufficient electrostatic adsorption force can be ensured in the outer periphery region, rather than in the region around the rotation axis center. In the region around the rotation axis center, the rotary driving force can be transferred even if the electrostatic adsorption force is not applied. In other words, the relative shift of the driving coupling 90 and the driven coupling 63 in the rotating direction can be controlled. Further, power consumption can be reduced in the driving force transfer couplings, which are designed to avoid looseness.

In Example 6, the process cartridge, in which the cleaner unit and the developing unit are integrated, was described. However the present invention is also applicable to the configuration where the cleaner unit and the developing unit can be independently attached to/detached from the image forming apparatus main body as a cleaner cartridge and a developing cartridge respectively. Further, this configuration is applicable to a cleanerless process, where the cleaner blade is not used, or to the driving coupling of the developing unit. Furthermore, this configuration is also applicable to a multicolor image forming process.

In Example 6, the electrostatic adsorption function portion 63*e* (dielectric layer) is disposed in the driven coupling 63, but may be disposed in the driving coupling 90. The electrostatic adsorption function portion (dielectric layer) may be disposed in both the driving coupling 90 and the driven coupling 63. Further, the electrostatic adsorption function portion is also applicable as an electric clutch, utilizing the ON/OFF of the electrostatic adsorption function based on the ON/OFF of the voltage applied to the coupling.

(Modification 4)

According to Modification 4, the electrostatic adsorption of the electrostatic adsorption function portion 63*e* and the driving coupling 90 of Example 6 is changed to magnetic adsorption. In concrete terms, the electrostatic adsorption function portion 63*e* of Example 6 is changed to magnetic adsorption function portion 63*e* which is a magnet, and the driving force transfer surface 90*b* is changed to a surface of a magnetic body. Then the micro holes 63*h* are formed in the magnetic adsorption function portion 63*e* such that a number of micro holes 63*h* increases as they locate closer to the inner side in the radius direction. According to this configuration, the magnetic adsorption function portion 63*e* is disposed in the outer side (r is larger) in the radius direction (outer region), which can contribute more to an increase in the transferable torque, compared with the inner side (r is smaller) in the radius direction (center region). Therefore the volume of the magnetic adsorption function portion 63*e*, which is disposed at the inner side in the radius direction, can be decreased, and the volume of the magnetic adsorption function portion 63*e* as a whole can be decreased. Therefore cost and weight of the driven coupling 63 and the cartridge B can be reduced, while suppressing a drop in the transferable torque.

Example 7

Example 7 of the present invention will be described with reference to FIG. 30A to FIG. 34. Similarly to Example 6, Example 7 concerns the structure of the electrostatic adsorption function portion, for reducing the power consumption of the driving force transfer coupling. In Example 6, the distributions of the volume resistivity and the thickness of the electrostatic adsorption function portion are changed smoothly, which may make the manufacture of the electrostatic adsorption function portion difficult. Therefore in Example 7, a configuration to make the manufacture of the electrostatic adsorption function portion easier, while reducing the power consumption of the driving force transfer coupling, will be described. The configurations and operations of the image forming apparatus, the cleaner unit, the developing unit, the process cartridge and the like are the same as Example 6. In Example 7, only the differences from Example 6 will be described, omitting detailed description on other portions.

Figure 30A:
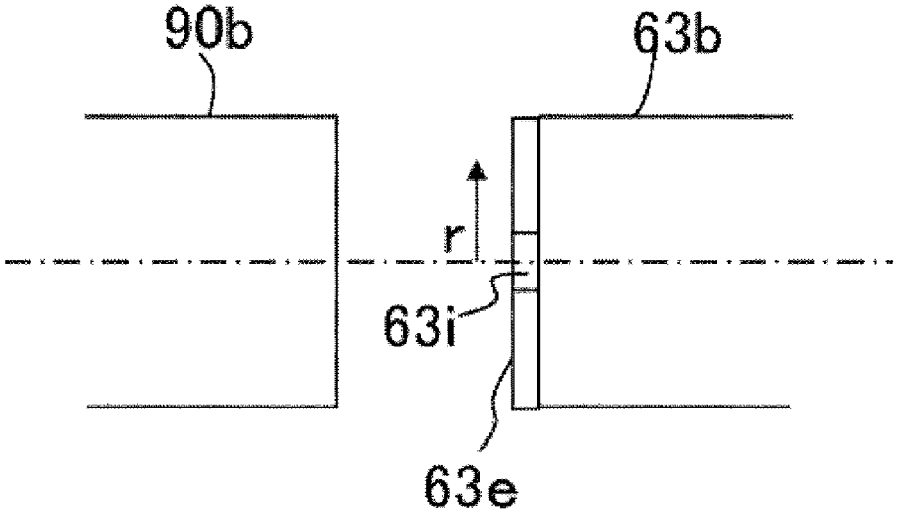
FIG. 30A shows a configuration of an electrostatic adsorption function portion according to Example 8 of the present invention when an intermediate resistance portion and a high resistance portion are formed.

FIGS. 30A to 30D are diagrams depicting a configuration of the driving force transfer coupling according to Example 7. In Example 7, the volume resistivity and the thickness of the electrostatic adsorption function portion 63*e* are changed in steps. FIG. 30A is a diagram when an intermediate resistance electrostatic adsorption function portion 63*e* and a high resistance electrostatic adsorption function portion 63*i* are combined. Here similarly to Example 6, a polyimide sheet is used for the electrostatic adsorption function portion. The volume resistivity of the polyimide sheet can be adjusted by controlling the amount of carbon black to be dispersed. In other words, the amount of carbon black dispersed in the polyimide sheet is higher in the intermediate resistance electrostatic adsorption function portion 63*e* than in the high resistance electrostatic adsorption function portion 63*i*. To integrate the intermediate resistance electrostatic adsorption function portion 63*e* and the high resistance electrostatic adsorption function portion 63*i*, as illustrated in FIG. 30A, the respectively molded electrostatic function adsorption portions may be bonded. The electrostatic adsorption function portion may be manufactured by two-color molding by pouring two types of liquid varnishes into a die. Here a polyimide sheet, of which volume resistivity is $5\times10^{10}$ Ωcm, is used as the intermediate resistance electrostatic adsorption function portion 63*e*, and a polyimide sheet, of which volume resistivity is $1\times10^{15}$ Ωcm, is used as the high resistance electrostatic adsorption function portion 63*i*.

Figure 30B:
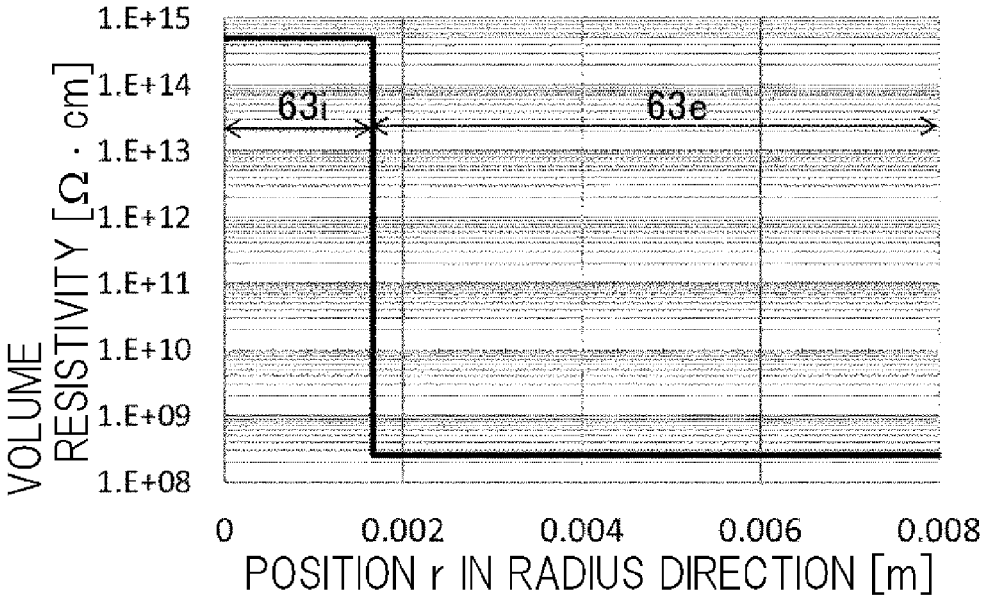
FIG. 30B is a graph depicting the distribution of the volume resistivity with respect to the position in the radius direction r of the electrostatic adsorption function portion according to Example 8 of the present invention when an intermediate resistance portion and a high resistance portion are formed.
Figure 30C:
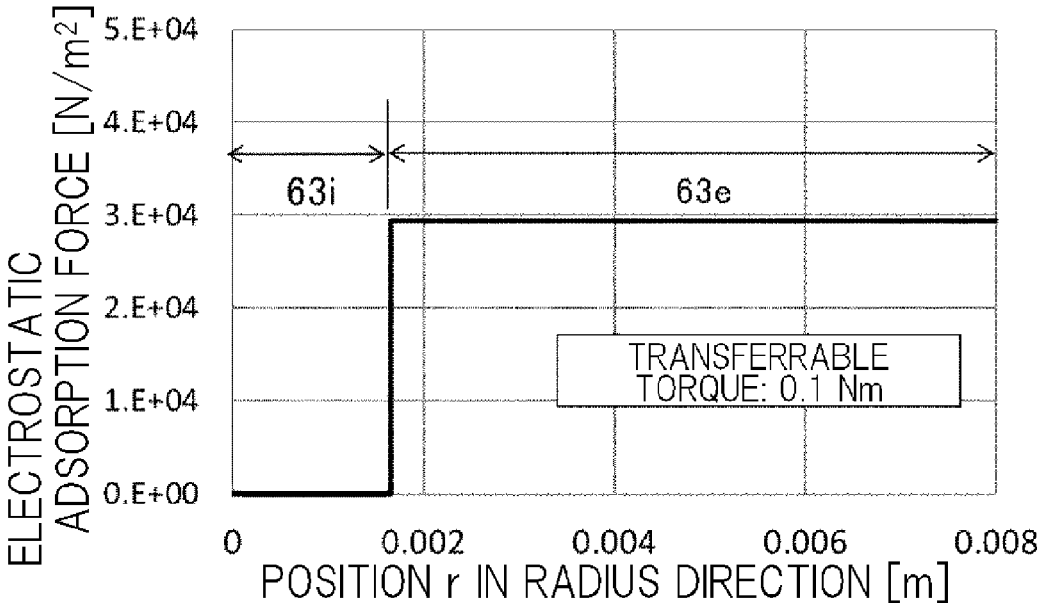
FIG. 30C is a graph depicting the distribution of the electrostatic adsorption force with respect to the position in the radius direction r of the electrostatic adsorption function portion according to Example 8 of the present invention when an intermediate resistance portion and a high resistance portion are formed.

FIG. 30B is a graph depicting the distribution of the volume resistivity with respect to the position in the radius direction r. As mentioned above, the volume resistivity changes depending on the applied voltage, and FIG. 30B shows the volume resistivity when a −400 V voltage is applied to the driving force transfer function portion 90*b*. FIG. 30C is a graph depicting the electrostatic adsorption force in this configuration. According to FIG. 30C, the electrostatic adsorption force is hardly applied to the high resistance electrostatic adsorption function portion 63*i*, and the electrostatic adsorption force is applied to the intermediate resistance electrostatic adsorption function portion 63*e*. When this electrostatic adsorption force is integrated according to Expression (1), the transfer torque is calculated as 0.1 Nm, similarly to Example 1. In this calculation, it is assumed that the outer diameter D of the intermediate resistance electrostatic adsorption function portion 63*e* is D=16 mm, the outer diameter D of the high resistance electrostatic adsorption function portion 63*i* is D=3 mm, and the friction coefficient μ is μ=0.3.

Figure 30D:
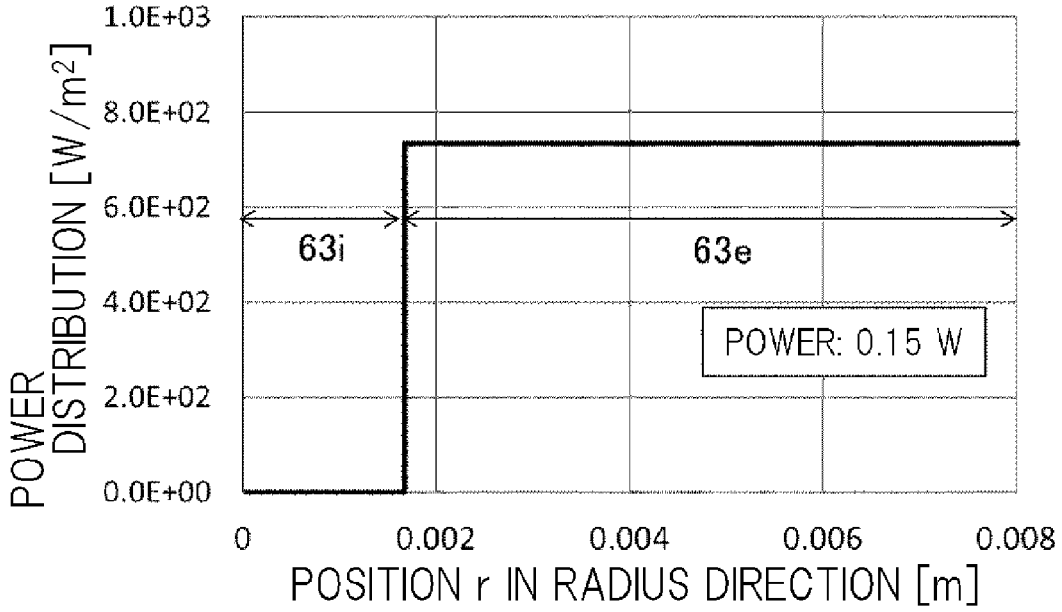
FIG. 30D is a graph depicting the distribution of the power consumption with respect to the position in the radius direction r of the electrostatic adsorption function portion according to Example 8 of the present invention when an intermediate resistance portion and a high resistance portion are formed.

FIG. 30D shows the power distribution calculated from the volume resistivity distribution in FIG. 30B. As shown in FIG. 30D, the power increases in the intermediate resistance electrostatic adsorption function portion 63*e*. By integrating this power distribution, the overall power consumption is calculated, and in this case, the power consumption is 0.15 W. In Example 1, when the volume resistivity and the thickness of the electrostatic adsorption function portion 63*e* are constant, the power consumption is 0.16 W at transferable torque 0.1 Nm. On the other hand, when the electrostatic adsorption force in the outer periphery portion is increased by changing the volume resistivity between the center portion and the outer periphery portion, as in Example 7, the power consumption is 0.15 W at transferable torque 0.1 Nm. In other words, the present invention can decrease the power consumption by 0.16−0.15=0.01 W, which means that the power consumption can be reduced 0.01/0.16≈6%.

Figure 31:
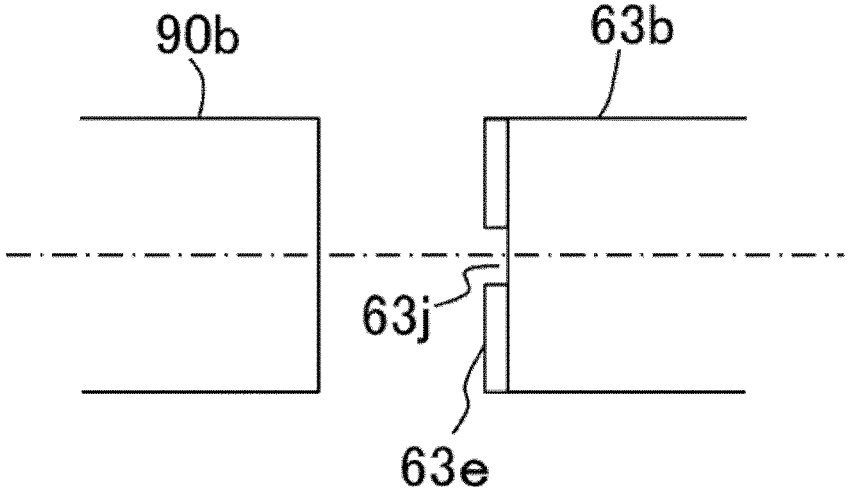
FIG. 31 is a diagram depicting a configuration of the electrostatic adsorption function portion according to Example 8 of the present invention when a hole is formed.

Next another configuration of Example 7 will be described with reference to FIG. 31. FIG. 31 is a diagram depicting a configuration when a circular hole (through hole) 63*j* is formed at a center portion of the electrostatic adsorption function portion 63*e* (a region including the rotation axis of the driven coupling 63 when viewed from the rotation axis direction of the driven coupling 63). In other words, when viewed from the rotation axis direction of the driven coupling 63, the electrostatic adsorption function portion 63*e* is not disposed in the center portion, but in a region surrounding the center portion, that is, the electrostatic adsorption function portion 63*e* has a doughnut shape. By this configuration, air having high insulating properties enters the center portion in which the circular hole 63*j* is formed, and the resistance value (volume resistivity) in the center portion is increased. Therefore the electrostatic adsorption force that is applied to the outer side becomes higher than the rotation center of the driving force transfer coupling, similarly to FIGS. 30A to 30D, and power consumption can be decreased as a whole. The effect of this reduction, which is approximately the same as the values described in FIGS. 30A to 30D, is omitted. To form the circular hole 63*j* at the center portion of the electrostatic adsorption function portion 63*e*, a circular convex shape is formed in the mold of the polyimide sheet, or a polyimide sheet without the circular hole 63*j* is formed in postprocessing after manufacture. In order to prevent discharge between the driving force transfer function portion 90*b* on the driving side and the driving force transfer function portion 63*b* on the non-driving side, the circular hole 63*j* may be half-punched without penetrating through the electrostatic adsorption function portion 63*e*. In this case, it is preferable to dispose a concave surface formed at the center of the electrostatic adsorption function portion 63*e* in a direction facing the driving force transfer function portion 90*b* on the driving side.

By the configuration and functions described above, when the driving coupling 90 and the driven coupling 63 are connected, sufficient electrostatic adsorption force can be ensured in the outer periphery region rather than in the center region around the rotation axis center, similarly to Example 1. In the region around the rotation axis center, the rotary driving force can be transferred, even if the electros adsorption is not applied. In other words, the relative shift of the driving coupling 90 and the driven coupling 63 in the rotating direction can be controlled. Further, power consumption can be reduced in the driving couplings, which are designed to avoid looseness. Furthermore, the volume resistivity and the thickness of the electrostatic adsorption function portion are changed in steps, which makes manufacturing easier.

(Modification 5)

According to Modification 5, the electrostatic adsorption of the electrostatic adsorption function portion 63*e* and the driving coupling 90 of Example 7 are changed to magnetic adsorption. In concrete terms, the electrostatic adsorption function portion 63*e* of Example 7 is changed to magnetic adsorption function portion 63*e*, and the driving force transfer surface 90*b* is changed to a surface of a magnetic body. Then similarly to the configuration in FIG. 31, a circular hole 63*i* is formed at the center portion of the magnetic adsorption function portion 63*e* in a direction perpendicular to the rotation axis direction of the driven coupling 63. Therefore the volume of the magnetic portion 63*e* disposed on the inner side in the radius direction can be decreased, and the volume of the magnetic adsorption function portion 63*e* can be decreased as a whole. Therefore cost and weight of the driven coupling 63 and the cartridge B can be reduced, while suppressing a drop in the transferable torque.

Example 8

Example 8 of the present invention will be described. Example 8 concerns the structure to accurately position the driving side coupling (driving coupling 90) and the non-driving side coupling (driven coupling 63), in addition to reducing the power consumption of the driving force transfer coupling. In Example 8 as well, the configuration and operations of the image forming apparatus, the cleaner unit, the developing unit, the process cartridge and the like are the same as Example 1. In Example 8, only the differences from Example 6 and Example 7 will be described, omitting detailed description of other portions. As described in FIG. 33, the cartridge B is positioned by the positioning portion 80 when the cartridge B is installed in the apparatus main body A. However, if the distance between the positioning portion 80 and the driving coupling is lengthy, the driving coupling 90 and the driven coupling 63 may be misaligned due to a manufacturing error, making adsorption insufficient, or causing major eccentric motion during rotary driving. Such a driving failure causes image defects.

Figure 32:
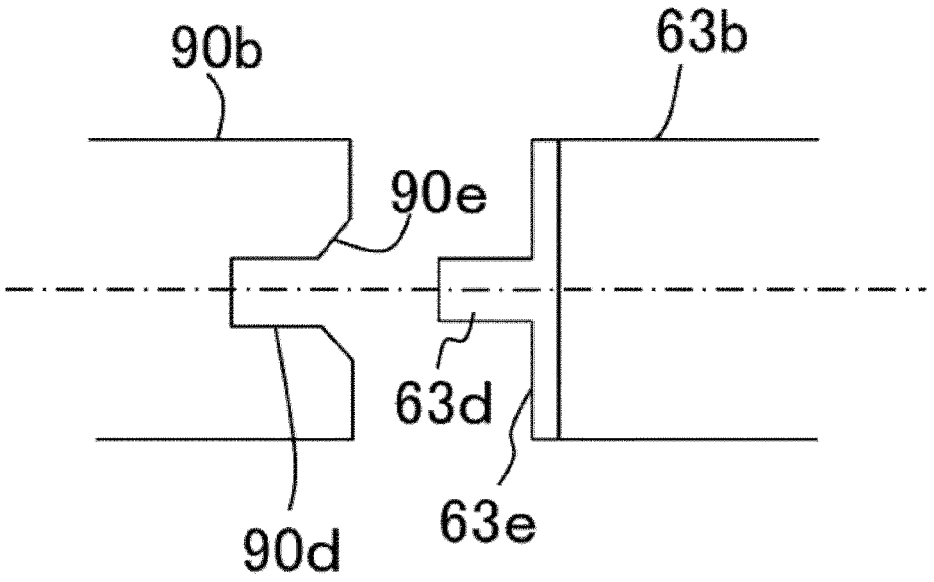
FIG. 32 is a diagram depicting a configuration when a boss is formed in the electrostatic adsorption function portion, and an interfitting hole is formed in the driving side coupling according to Example 8 of the present invention.

Therefore in Example 8, a mechanism to align the driving side coupling and the non-driving side coupling is disposed in the driving couplings. This configuration will be described with reference to FIG. 32, FIG. 33 and FIG. 34. FIG. 32 is a diagram where a circular boss 63*d* (protruding portion) (diameter: 3 mm; length: 5 mm) is disposed in the rotation center position of the electrostatic adsorption function portion 63*e*. On the driving force transfer function portion 90*b* on the driving side, on the other hand, an interfitting hole 90*d* (diameter: 3 mm; length: 6 mm) is formed on the rotation axis line of the photosensitive drum 62, so as to face the circular boss 63*d*. At the entrance of the interfitting hole 90*d*, a C chamfered edge 90*e* is formed, so that the circular boss 63*d* can enter easily. By this configuration, when the cartridge B is installed in the apparatus main body A, the driving side coupling and the non-driving side coupling can be accurately aligned, and driving can be accurately transferred.

Further, by disposing the circular boss 63*d* at the rotation center position of the electrostatic adsorption function portion 63*e*, the power consumption can be reduced compared with the case of not having the circular boss. In other words, if the circular boss 63*d* is disposed at the rotation center, the thickness of the electrostatic adsorption function portion 63*e* becomes large at the rotation center position. Thereby the electrostatic adsorption force in the periphery portion becomes higher than the electrostatic adsorption force at the rotation center position, and the power consumption can be reduced as a whole even if the transfer torque is the same. This amount of reduction, which is the same as FIGS. 30A to 30D, is omitted here.

Figure 33:
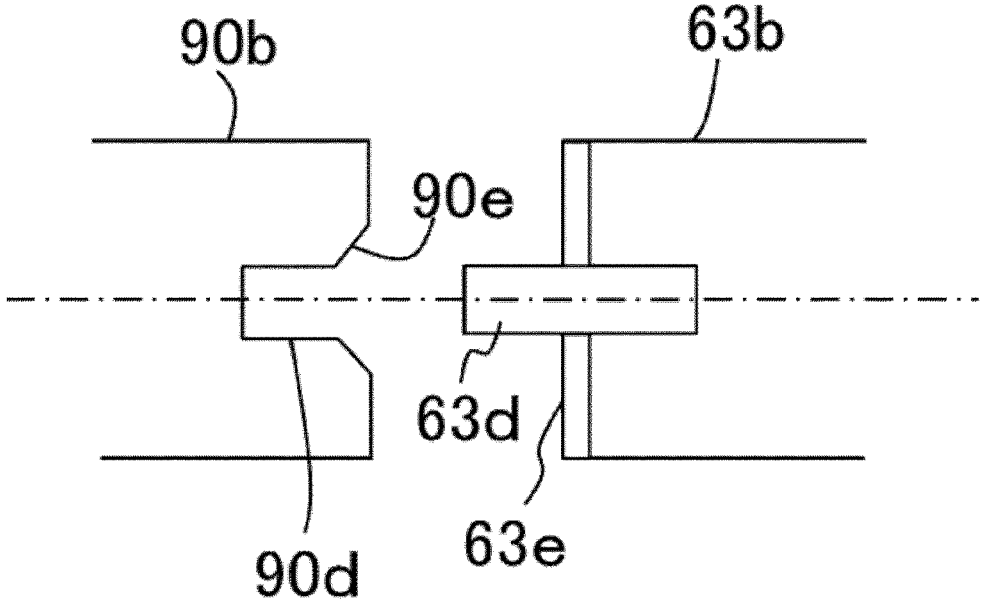
FIG. 33 is a diagram depicting a configuration when a boss of another member is formed in the electrostatic adsorption function portion, and an interfitting hole is formed in the driving side coupling according to Example 8 of the present invention.

The configuration in FIG. 33 will be described next. FIG. 33 is a diagram when the circular boss 63*d* is configured as an aligning member that is separate from the electrostatic adsorption function portion 63*e*. Here in order to dispose the circular boss 63*d*, a whole (diameter: 3 mm) is formed in the driving force transfer function portion 63*b* of the non-driving side coupling, and a through hole (diameter: 3 mm) is formed in the electrostatic adsorption function portion 63*e*. Then one of the circular boss 63*d* is inserted into these holes and firmly fixed by epoxy adhesive. The other end of the circular boss 63*d* is inserted into an interfitting hole (diameter: 3 mm; length: 6 mm) formed in the driving force transfer function portion 90*b*. The method of fixing the circular boss 63*d* to the coupling base 63*a* is not limited to adhesive, such as epoxy adhesive, but may be screws, pressfitting by knurling or the like. The material of the circular boss 63*d* can be any material of which volume resistivity is higher than the driving force transfer function portion 63*e*, and polyacetal, which is an insulating material, is used. The material of the circular boss can also be any material of which volume resistivity is higher than the driving force transfer function portion 63*e*, and may be selected from ceramic, polyester, epoxy resin and the like.

Figure 34:
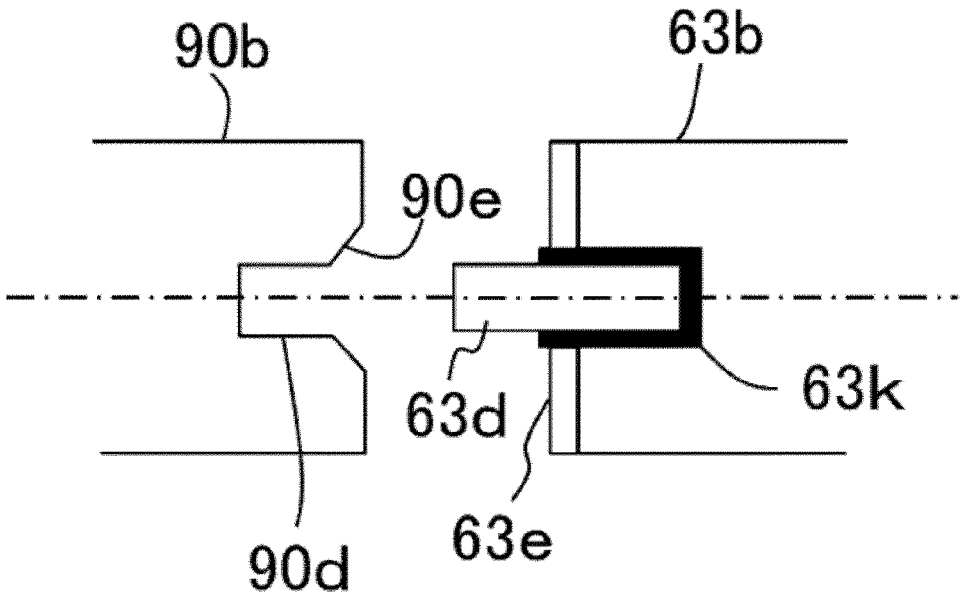
FIG. 34 is a diagram depicting a configuration when a boss is formed in the electrostatic adsorption function portion and the non-driving side coupling is insulated according to Example 8 of the present invention.

The configuration in FIG. 34 will be described next. FIG. 34 is a diagram when the circular boss 63*d* (aligning member) and the driving force transfer function portion 63*b* on the non-driving side are electrically insulated. In order to electrically insulate the circular boss 63*d* and the driving force transfer function portion 63*b* on the non-driving side, an insulating bearing 63*k* is disposed. For the insulating bearing 63*k*, polyacetal, which is an insulating material, is used. This insulating bearing 63*k* is firmly fixed to the driving force transfer function portion 63*b* on the non-driving side with epoxy adhesive. Further, the circular boss 63*d* is firmly fixed to the insulating bearing 63*k* with epoxy adhesive. The material of the circular boss 63*d* can be selected from hard materials suitable for positioning, and here aluminum is used. In this configuration as well, the materials of the insulating bearing 63*k*, the circular boss 63*d* or the like, and the adhering method thereof, can be appropriately selected.

As described above, by disposing the circular boss 63*d* at the rotation center position of the electrostatic adsorption function portion 63*e*, the driving side coupling and the non-driving side coupling can be accurately position, and the power consumption can be reduced compared with the case of not having the circular boss. In other words, by disposing the circular boss at the rotation center, the electrostatic adsorption force in the periphery portion becomes higher than the electrostatic adsorption force at the rotation center position, and the power consumption can be reduced as a whole, even if the transfer torque is the same.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-079264, filed Apr. 12, 2017, No. 2017-079265, filed Apr. 12, 2017, No. 2017-079266, filed Apr. 12, 2017 and No. 2018-073999, filed Apr. 6, 2018 which are hereby incorporated by reference herein in their entirety.

The invention claimed is:

1. An image forming apparatus, comprising:

a power source;

a first coupling member configured to be rotated about a rotation axis by a driving force transferred from the power source, the first coupling member having a first driving force transfer surface that is perpendicular to the rotation axis of the first coupling member; and a cartridge including:

a second coupling member configured to rotate about a rotation axis in a state of being adsorbed to the first coupling member, the second coupling member having a second driving force transfer surface that is perpendicular to the rotation axis of the second coupling member; and a rotating member connected with the second coupling member, wherein the first driving force transfer surface and the second driving force transfer surface contact each other by an electrostatic adsorption force to transfer the driving force from the first coupling member to the second coupling member in a state where the electrostatic adsorption force is generated mutually between the first driving force transfer surface and the second driving force transfer surface, and wherein the first coupling has a first engaging surface that intersects with the first driving force transfer surface, the second coupling includes a second engaging surface that intersects with the second driving force transfer surface, and the driving force is transferred from the first coupling member to the second coupling member in a state where the first engaging surface and the second engaging surface engage with each other.

2. The image forming apparatus according to claim 1, wherein the second engaging surface is disposed in a position closer to the rotation axis than to the second driving force transfer surface in a direction perpendicular to the rotation axis of the second coupling member.

3. The image forming apparatus according to claim 1, wherein the second engaging surface is disposed in a position more distant from the rotation axis than from the second driving force transfer surface in a direction perpendicular to the rotation axis of the second coupling member.

4. The image forming apparatus according to claim 1, wherein the second driving force transfer surface is disposed in a region except for the rotation axis when viewed in the direction of the rotation axis.

5. An image forming apparatus comprising:

a power source;

a first coupling member configured to be rotated about a rotation axis by a driving force transferred from the power source, the first coupling member having a first driving force transfer surface that is perpendicular to the rotation axis of the first coupling member; and a cartridge including:

a second coupling member configured to rotate about a rotation axis in a state of being adsorbed to the first coupling member, the second coupling member having a second driving force transfer surface that is perpendicular to the rotation axis of the second coupling member; and a rotating member connected with the second coupling member, wherein the first driving force transfer surface and the second driving force transfer surface contact each other by an electrostatic adsorption force to transfer the driving force from the first coupling member to the second coupling member in a state where the electrostatic adsorption force is generated mutually between the first driving force transfer surface and the second driving force transfer surface, wherein the first coupling member includes an engaging portion centered on the rotation axis of the first coupling member, and the second coupling member includes an engaged portion centered on the rotation axis of the second coupling member, and wherein the engaging portion of the first coupling member engages with the engaged portion of the second coupling member so as to position the second coupling member with respect to the first coupling member in a direction perpendicular to the rotational axis of the first coupling member.

* * * * *